US008505798B2

(12) United States Patent
Simonelli et al.

(10) Patent No.: US 8,505,798 B2
(45) Date of Patent: Aug. 13, 2013

(54) FASTENER DRIVING DEVICE

(75) Inventors: David Simonelli, Coventry, RI (US); Charles W. Hewitt, Warwick, RI (US); Keven E. Miller, Wyoming, RI (US); Lok C. Lam, East Greenwich, RI (US); Tim Kimball, Uxbridge, MA (US); Andrew P. Leonczyk, Warwick, RI (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 438 days.

(21) Appl. No.: 12/391,016

(22) Filed: Feb. 23, 2009

(65) Prior Publication Data

US 2009/0236387 A1 Sep. 24, 2009

Related U.S. Application Data

(63) Continuation-in-part of application No. 11/432,669, filed on May 12, 2006, now Pat. No. 7,494,037, and a continuation-in-part of application No. 11/806,471, filed on May 31, 2007, now Pat. No. 7,938,305, and a continuation-in-part of application No. 11/806,483, filed on May 31, 2007, and a continuation-in-part of application No. 11/806,484, filed on May 31, 2007.

(60) Provisional application No. 60/680,021, filed on May 12, 2005, provisional application No. 60/809,345, filed on May 31, 2006.

(51) Int. Cl.
*B25C 5/10* (2006.01)

(52) U.S. Cl.
USPC ..... 227/132; 227/120; 227/126; 227/135; 227/136; 227/139; 173/217; 173/162.1

(58) Field of Classification Search
USPC ..... 227/8, 120, 131, 132, 126, 135, 136, 227/139; 173/202, 203, 216, 217, 162.1; 267/162, 166, 148, 149
See application file for complete search history.

(56) References Cited

U.S. PATENT DOCUMENTS 1,656,054 A 1/1928 Gage
1,767,485 A 6/1930 Shallenberger (Continued)

FOREIGN PATENT DOCUMENTS

DE 3037616 A1 5/1982
DE 3320251 12/1984

(Continued)

OTHER PUBLICATIONS

Supplementary European Search Report and Opinion as issued for European Patent Application No. 06770209.2, dated Jul. 1, 2009.

(Continued)

*Primary Examiner* — Michelle Lopez
(74) *Attorney, Agent, or Firm* — Pillsbury Winthrop Shaw Pittman LLP

(57) ABSTRACT

A fastener driving device includes a fastener driver, a magazine for carrying a supply of fasteners to the fastener driver, a spring that moves the fastener driver through a drive stroke, and a motor configured to move the fastener driver through a return stroke. The motor is operable upon completion of the drive stroke, to move the fastener driver partially through the return stroke a predetermined amount to partially pre-compress the spring. The motor is further operable to fully compress the spring after receiving a signal for the drive stroke.

15 Claims, 55 Drawing Sheets

(56) References Cited

U.S. PATENT DOCUMENTS

| | | | | |
|---|---|---|---|---|
| 1,845,617 | A | 2/1932 | Metcalf | 227/96 |
| 2,223,727 | A | 12/1940 | Homen | |
| 2,441,505 | A | 5/1948 | Ochtman | |
| 2,574,875 | A | 11/1951 | Lang | |
| 2,657,383 | A | 11/1953 | Siering et al. | |
| 2,660,281 | A | 11/1953 | Ochtman | |
| 2,852,424 | A | 9/1958 | Reinhart et al. | |
| 2,877,820 | A * | 3/1959 | Ristow | 173/31 |
| 3,042,924 | A * | 7/1962 | Frostad | 227/120 |
| 3,149,681 | A | 9/1964 | Drew | |
| 3,243,023 | A | 3/1966 | Boyden | |
| 3,305,156 | A | 2/1967 | Anthony | 227/132 |
| 3,378,426 | A | 4/1968 | Medney | |
| 3,586,231 | A | 6/1971 | Wilson | |
| 3,589,588 | A | 6/1971 | Vasku | |
| 3,810,572 | A | 5/1974 | Malkin | |
| 3,847,322 | A | 11/1974 | Smith | |
| 3,924,692 | A | 12/1975 | Saari | |
| 3,924,789 | A | 12/1975 | Avery et al. | |
| 3,982,678 | A | 9/1976 | Olson | |
| 4,012,267 | A | 3/1977 | Klein | |
| RE29,354 | E | 8/1977 | Malkin | |
| 4,215,808 | A * | 8/1980 | Sollberger et al. | 227/146 |
| 4,260,143 | A | 4/1981 | Kliger | |
| 4,380,483 | A | 4/1983 | Kliger | 156/169 |
| 4,434,121 | A | 2/1984 | Schaper | |
| 4,450,919 | A | 5/1984 | Cousineau | |
| 4,473,217 | A | 9/1984 | Hashimoto | |
| 4,483,280 | A | 11/1984 | Nikolich | |
| 4,489,792 | A | 12/1984 | Fahim et al. | |
| 4,544,090 | A | 10/1985 | Warman et al. | |
| 4,544,610 | A | 10/1985 | Okamoto et al. | |
| 4,564,048 | A | 1/1986 | Taylor | |
| 4,566,619 | A | 1/1986 | Kleinholz | |
| 4,714,186 | A | 12/1987 | Williamson | |
| 4,724,992 | A | 2/1988 | Ohmori | 227/146 |
| 4,756,602 | A | 7/1988 | Southwell et al. | |
| 4,773,633 | A | 9/1988 | Hinz et al. | |
| 4,865,229 | A | 9/1989 | Schneider et al. | |
| 4,867,366 | A | 9/1989 | Kleinholz | |
| 4,907,802 | A | 3/1990 | Gatin et al. | |
| 4,981,247 | A | 1/1991 | Noll | |
| 4,984,800 | A | 1/1991 | Hamada | |
| 4,991,827 | A | 2/1991 | Taylor | |
| 5,129,383 | A | 7/1992 | Rutten | |
| 5,366,132 | A | 11/1994 | Simonelli | |
| 5,388,749 | A * | 2/1995 | Davignon et al. | 227/67 |
| 5,467,970 | A | 11/1995 | Ratu et al. | |
| 5,503,783 | A | 4/1996 | Nakagawa et al. | |
| 5,511,715 | A | 4/1996 | Crutcher et al. | |
| 5,549,370 | A | 8/1996 | Folsom | |
| 5,558,393 | A | 9/1996 | Hawkins et al. | 267/162 |
| 5,597,431 | A | 1/1997 | Grosjean et al. | |
| 5,603,490 | A | 2/1997 | Folsom | 267/149 |
| 5,605,268 | A * | 2/1997 | Hayashi et al. | 227/8 |
| 5,678,809 | A | 10/1997 | Nakagawa et al. | |
| 5,685,525 | A | 11/1997 | Oguri et al. | |
| 5,720,423 | A | 2/1998 | Kondo et al. | |
| 5,794,325 | A | 8/1998 | Fallandy | |
| 5,842,935 | A | 12/1998 | Nelson | |
| 5,927,585 | A | 7/1999 | Moorman et al. | 227/132 |
| 5,988,612 | A | 11/1999 | Bertelson | |
| 6,068,250 | A | 5/2000 | Hawkins et al. | |
| 6,179,192 | B1 | 1/2001 | Weinger et al. | |
| 6,186,386 | B1 | 2/2001 | Canlas et al. | 227/142 |
| 6,199,739 | B1 | 3/2001 | Mukoyama et al. | |
| 6,296,064 | B1 | 10/2001 | Janusz et al. | |
| 6,364,193 | B1 | 4/2002 | Tsai | |
| 6,394,332 | B2 | 5/2002 | Akiba | |
| 6,431,425 | B1 | 8/2002 | Moorman et al. | |
| 6,454,251 | B1 | 9/2002 | Fish | |
| 6,497,316 | B1 * | 12/2002 | Hsu | 192/223.2 |
| 6,592,014 | B2 | 7/2003 | Smolinski | |
| 6,604,666 | B1 | 8/2003 | Pedicini et al. | |
| 6,612,556 | B2 | 9/2003 | Petrina | |
| 6,729,971 | B2 | 5/2004 | Caldwell | |
| 6,763,897 | B2 * | 7/2004 | Hanke et al. | 173/210 |
| 6,766,935 | B2 | 7/2004 | Pedicini et al. | |
| 6,785,950 | B1 | 9/2004 | Scirbona et al. | |
| 6,814,158 | B2 * | 11/2004 | Bieber et al. | 173/178 |
| 6,820,788 | B2 | 11/2004 | Akiba | |
| 6,857,548 | B1 | 2/2005 | Clark | |
| 6,886,730 | B2 | 5/2005 | Fujisawa et al. | |
| 6,899,260 | B2 | 5/2005 | Sun | |
| 6,905,055 | B2 | 6/2005 | Maier et al. | |
| 6,938,809 | B1 | 9/2005 | Schnell | |
| 6,966,476 | B2 | 11/2005 | Jalbert et al. | |
| 6,971,567 | B1 | 12/2005 | Cannaliato et al. | |
| 6,986,203 | B2 | 1/2006 | Chiu | |
| 6,997,367 | B2 | 2/2006 | Hu | |
| 7,086,573 | B1 * | 8/2006 | Wen | 227/8 |
| 7,121,443 | B2 | 10/2006 | Sun et al. | |
| 7,137,541 | B2 | 11/2006 | Baskar et al. | |
| 7,140,524 | B2 | 11/2006 | Hung et al. | |
| 7,152,774 | B2 | 12/2006 | Chen | |
| 7,213,732 | B2 | 5/2007 | Schell et al. | |
| 7,331,403 | B2 | 2/2008 | Berry et al. | |
| 7,395,874 | B2 * | 7/2008 | Zeiter | 173/179 |
| 7,445,139 | B2 | 11/2008 | Okouchi | |
| 7,513,407 | B1 * | 4/2009 | Chang | 227/132 |
| 2002/0053445 | A1 | 5/2002 | Kim et al. | |
| 2005/0082334 | A1 | 4/2005 | Hu | 227/131 |
| 2005/0167465 | A1 | 8/2005 | Llewellyn | |
| 2005/0218184 | A1 | 10/2005 | Buck et al. | |
| 2006/0102683 | A1 | 5/2006 | Schnell et al. | |
| 2006/0144888 | A1 | 7/2006 | Schnell | |
| 2006/0180631 | A1 | 8/2006 | Pedicini et al. | |
| 2007/0007319 | A1 | 1/2007 | Simonelli et al. | |
| 2007/0095876 | A1 | 5/2007 | Oda et al. | |
| 2007/0102470 | A1 | 5/2007 | Miyashita et al. | |
| 2007/0215665 | A1 | 9/2007 | Ohmori | |
| 2007/0215666 | A1 | 9/2007 | Nayrac et al. | |
| 2007/0290556 | A1 | 12/2007 | Hochhalter et al. | |
| 2008/0017689 | A1 * | 1/2008 | Simonelli et al. | 227/132 |
| 2008/0041914 | A1 | 2/2008 | Simonelli et al. | |
| 2008/0047999 | A1 | 2/2008 | Berry et al. | |
| 2008/0048000 | A1 | 2/2008 | Simonelli et al. | |
| 2008/0073405 | A1 | 3/2008 | Shima et al. | |
| 2008/0099525 | A1 | 5/2008 | Brendel et al. | |
| 2008/0164295 | A1 | 7/2008 | Wu et al. | |
| 2008/0173688 | A1 | 7/2008 | Spasov et al. | |
| 2008/0185416 | A1 | 8/2008 | Deng et al. | |
| 2008/0197165 | A1 | 8/2008 | Chen et al. | |
| 2008/0237294 | A1 | 10/2008 | Tanmoto et al. | |
| 2008/0271552 | A1 | 11/2008 | Arenz et al. | |

FOREIGN PATENT DOCUMENTS

| | | |
|---|---|---|
| EP | 0 775 554 | 5/1997 |
| EP | 1 410 879 | 4/2004 |
| EP | 1 862 262 | 12/2007 |
| EP | 1 884 322 | 2/2008 |
| EP | 1 958 735 | 8/2008 |
| FR | 1200649 | 12/1959 |
| GB | 2 333 729 | 8/1999 |
| JP | 55014247 | 1/1980 |
| WO | WO 2005/027097 | 3/2005 |
| WO | WO 2007/142996 | 12/2007 |
| WO | WO 2008/123482 | 10/2008 |
| WO | WO 2009/001728 | 12/2008 |

OTHER PUBLICATIONS

Extended European Search Report as issued for EP Patent Application No. 10154402.1, dated Aug. 20, 2010.

* cited by examiner

FIG. 22A
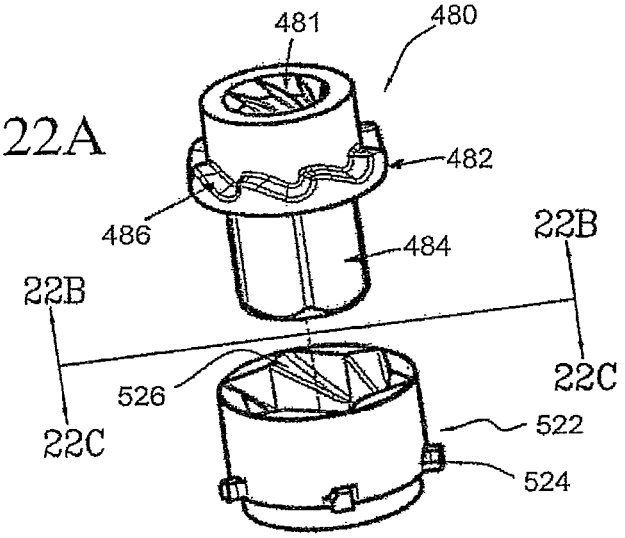
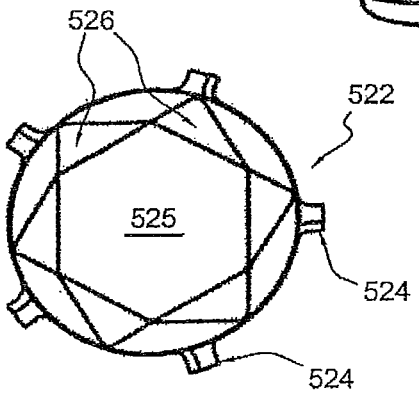
FIG. 22C
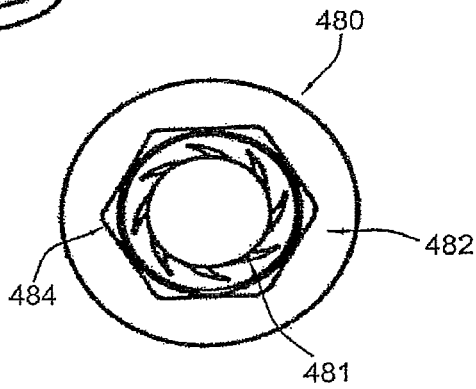
FIG. 22B

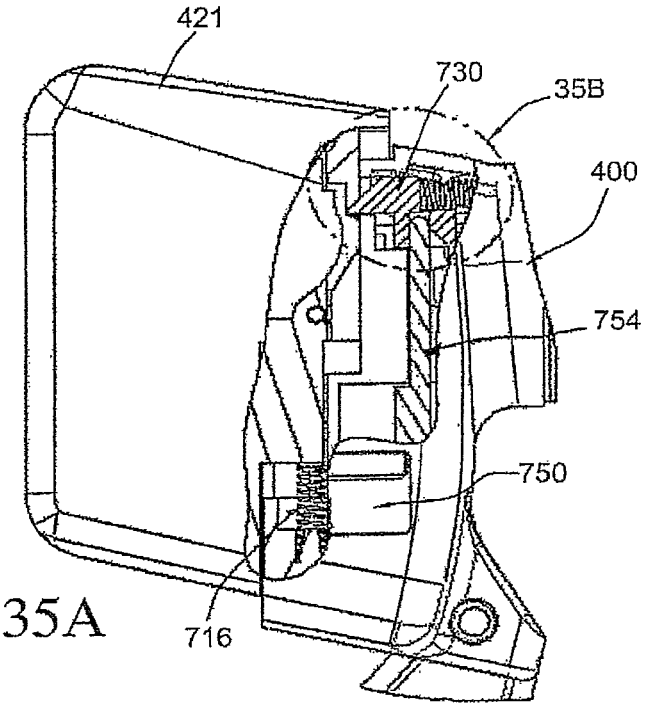
FIG. 35A
FIG. 35B
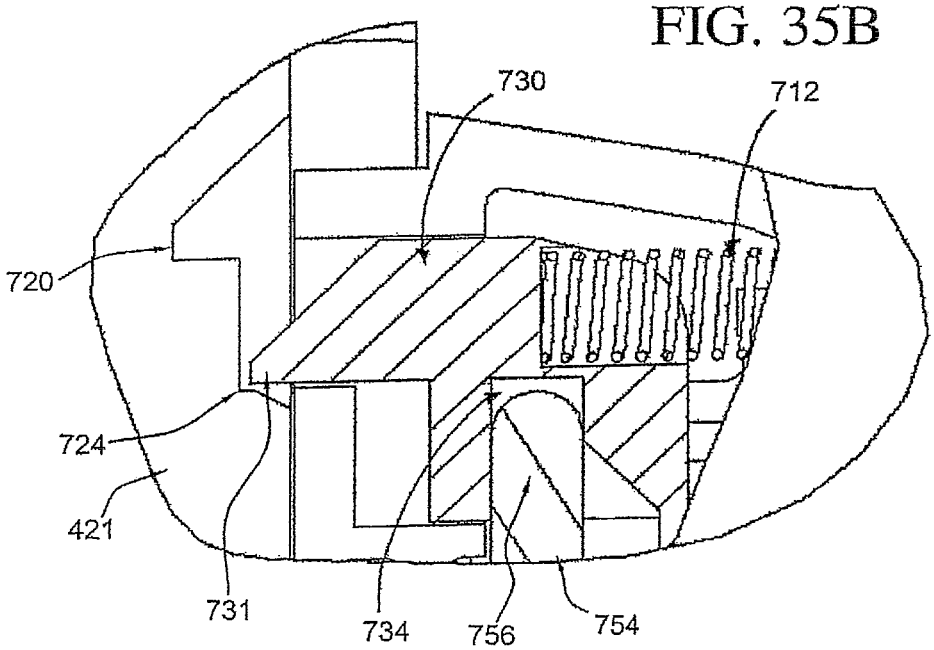

FASTENER DRIVING DEVICE

CROSS-REFERENCE TO RELATED APPLICATIONS

This application is a continuation-in-part of U.S. patent application Ser. No. 11/432,669, filed May 12, 2006, now U.S. Pat. No. 7,494,037, which claimed priority from U.S. provisional application No. 60/680,021, filed May 12, 2005, the contents of both of which are incorporated herein by reference. This application is also a continuation-in-part of U.S. patent application Ser. Nos. 11/806,471, Now U.S. Pat. No. 7,938,305 Ser. No. 11/806,483, and 11/806,484, all of which were filed on May 31, 2007 and claimed priority from U.S. provisional application No. 60/809,345 filed May 31, 2006, the contents of all of which are incorporated herein by reference.

BACKGROUND OF THE INVENTION

1. Field of the Invention

The present invention relates to power tools such as fastener driving devices.

2. Description of Related Art

Fastening tools are designed to deliver energy stored in an energy source to drive fasteners very quickly in a single blow. Typically fastener driving devices use energy sources such as compressed air, flywheels, and chemicals (fuel combustion & gun powder detonation) and for some low energy tools, steel springs are used. In addition to mechanical springs, gas springs have also been taught for use in fastening devices. For example, U.S. Pat. No. 6,899,260 discloses a small cordless brad tool. U.S. Pat. No. 6,997,367 discloses a hand held nailing tool for firing small nails. U.S. Pat. No. 5,720,423 and U.S. patent application 2006/0180631 disclose gas spring fastening devices.

It is desirable for the tool to be of low weight so that it may be used with one hand, and not cause excessive fatigue. It is also desirable for fastener driving devices to provide sufficient energy to effectively drive the fastener, but with minimum recoil. Recoil negatively impacts a tool's ability to drive a fastener, and, it may also increase user fatigue.

Recoil is a function of, among other things, the tool weight/driver weight ratio, and driver velocity or drive time, which is affected by the energy required to drive the fastener. As a fastener is being driven, a reaction force is pushing the tool off of the work surface. The distance the tool moves off of the workpiece is proportional to the drive time and other parameters as noted herein below. A typical pneumatic tool has a tool/driver ratio of greater than 30. Drive time is typically less than 10 milliseconds (msec.) and should not be greater than 20 msec., and preferably, not be greater than 15 msec. Maximum pneumatic tool weight is found with the bigger tools—e.g., framing nailers. An estimated maximum limit to an acceptable tool weight is 10 lbs. Framing nailers in the 8 to 9.5 lb. range are typically used without excessive fatigue. Combining the limits on the tool/driver weight ratio of 30 and a 10 lb. maximum tool weight, the limit on the driver weight becomes about 0.33 lb. That is, the driver weight should preferably be less than 0.33 lb. if the tool weighs 10 lbs. In other words, if the driver (mechanism in the tool that drives the fastener) weighs more than 0.33 lb., the tool weight would have to be greater than 10 lb. to counteract the recoil sufficiently for comfortable operation and adequately drive the fastener into the workpiece in a single blow.

In the process of driving fasteners using impulse, recoil presents several problems. One being that during the drive cycle, the complex tool motion causes a deviation of the drive force vector from the intended penetration direction. That is, the drive force does not remain parallel to the axis of the fastener, and therefore, the driver may actually slide off the fastener before the drive is complete. This can result in bent fasteners, damage to the work piece due to the tool sliding off of the driver, fasteners driven off the edge of the work piece or not being driven in the intended direction and incomplete drives. Another problem is the amount the tool recoils has to be compensated by adding drive stroke and a subsequent addition of driver extension, which results in two additional concerns. First the extension of the drive stroke lengthens the tool by twice the amount that is added. Second, the addition of driver extension results in added complexity of the tool and in a reduction in the structural integrity to the driver.

The amount the tool recoils must be subtracted from the stroke of the tool when considering the energy output of the drive stroke. Also excessive recoil is perceived as undesirable by most operators. Although some recoil is usually desired as it aids in the movement of the tool from drive location to drive location, especially during rapid cycle operation, excessive recoil may result in damage to the tool, damage to the fastener or damage to the work surface. That is, during the drive cycle, the complex tool motion may cause a deviation of the drive force vector from the intended penetration direction. The drive force therefore may not remain parallel to the axis of the fastener and the driver may slide off the fastener before the drive is complete. As noted above, this can result in bent fasteners, damage to the work piece due to the tool sliding off of the driver, fasteners driven off the edge of the work piece or not being driven in the intended direction resulting in incomplete drives.

In most instances, recoil is controlled by having a mass moving in a direction opposite to the direction the fastener driver is moving. This mass is held by a spring and during the impulsive drive, accelerates opposite the drive motion and the force of the spring can usually be neglected due to the nature of the impulsive force.

However, when a spring is used to generate the impulse, concerns associated with recoil increase considerably. First, because the spring is a solid, the spring has about 3-orders of magnitude more mass than gasses used in a pneumatic or combustion impulse device. Accordingly, one third of this amount must be included as part of the moving mass. Secondly, the spring is compressed much slower than a gas would be introduced into an impulse chamber therefore holding the secondary mass with a spring would be ineffective because the mass would be fully biased prior to the drive strike. Also, it would be beneficial to partially compress the drive spring and hold it in position prior to the actual drive. A third problem arises due to the unfavorable geometry constraints in that the center of force of the spring is further away from the tool center of gravity, causing a greater degree of rotational motion. This in turn causes some of the drive energy to be misdirected from the direction of drive as noted hereinabove.

Another reason for the quick drive time requirement is the dual requirement of energy and force. The energy is stored in a moving mass and can be found from Energy=½ mass× velocity squared, i.e. $E=\frac{1}{2}mv^2$. An impulse force is developed from the change in momentum when the driver pushes the fastener into the work piece. Assuming an average force during the drive and the final velocity of the moving driver mass is zero, a simple equation may be set up where force× time=mass×velocity, or time=mass×velocity/force.

In general, the event of driving most fasteners in a single drive stroke occurs in fewer than 10 msec., which would allow for a rate of 100 cycles per second. Of course, this time does not take into consideration the reset time. Pneumatic tool cycle rates typically range from approximately 30 cycles per second for very small energy tools such as upholstery staplers, to approximately 10 cycles per second for larger energy tools, for example, tools that are used in framing. In most applications, the desired rate is no more than 10 cycles per second, which allows for 100 msec. per actuation.

The constraint of the drive time being less than 10 msec. is still desirable to minimize the recoil of the tool and to adequately drive the fastener, as previously described. Of course, these factors are inter-related in that if the tool does not adequately drive the fastener, recoil will typically be more severe. As stated above, recoil is a function of many things, but a primary physical consideration is the ratio between the tool weight and the weight of the driver. This is due to the energy requirement of driving a fastener being constant. Also, the law of conservation of momentum requires that the final velocity of the tool (assuming the tool velocity is zero at the start) will be equal to the ratio between the mass of the tool and the mass of the driver times the final velocity of the driver. The output energy of the tool (when no fastener is driven) is equal to ½ the mass of the driver times the square of the final velocity of the driver ($\frac{1}{2}\times m\times v^2$). Combining these two principles and simplifying, the final velocity of the tool may be found from Equation 1:

$$V_{tool} = \sqrt{\frac{2m_{striker}\text{Energy}}{m_{tool}^2}} \quad (1)$$

Holding the mass of the tool and energy constant, the only practical way to decrease the tool velocity from Equation 1 is to decrease the mass of the driver. As the driver gets lighter, its final velocity has to increase to maintain the required energy. Given that time is equal to distance divided by velocity, and assuming that average velocity is about half peak velocity for most single stroke fastener drive events, the optimal and practical time to drive a fastener in a single drive stroke is between 3 and 10 msec.

One problem with a short drive time is the high power requirement it creates. Given that power is output energy divided by time, as the time decreases for a given energy, the power increases. Although most applications allow 100 msec. per actuation, an improved drive allows 10 msec. or less, and realizes at least a 10 fold increase in power. This creates the need for some sort of energy storage device that can release or transfer it's stored energy in 10 msec., or less.

Direct chemical energy can be released in less than 10 msec., but direct chemical energy in discrete actuations has other costs and complexities that make it limited at the present time (e.g. fuel cost, exhaust gases). However, chemical energy based tools typically cannot practically provide "bump fire" capability where the trigger is depressed, and the contact trip is depressed to start a drive sequence. Another form of energy storage that allows for the storage and rapid release of energy is the flywheel. Mechanical flywheel type cordless fastening tool proposed in U.S. patent application US20050218184(A1) maintains a constant flywheel speed, while the tool proposed in U.S. Pat. No. 5,511,715 does not maintain a constant flywheel speed. However, one recognized problem with a flywheel is long term energy storage, which creates a need to get the total required energy for a first actuation into the flywheel before the perceived actuation delay time which is approximately 70 msec. In particular, from a user's perspective, the maximum delay from when the contact trip is depressed, to when the nail is driven, is approximately 70 msec. Tools having larger actuation delay time will typically be deemed unacceptable for use in bump fire mode. In addition, when a tool is bumped against the work surface to drive a fastener, the tool naturally begins to bounce off the surface, and after approximately 70 msec. has lapsed, the tool may have moved far enough away from the workpiece to prevent complete driving of the fastener into the workpiece. Thus, flywheel based tools must maintain constant rotation of the flywheel while the trigger is depressed to have such bump fire capability, thus wasting energy to maintain the flywheel speed. Another problem with a flywheel is the energy transfer mechanism is complicated and inefficient.

Other devices peripherally related to the fastener driving devices are disclosed in U.S. Pat. No. 5,720,423 that provides a discussion as to why a traditional steel spring cannot be effectively used to drive a nail, U.S. Pat. No. 7,137,541 that discloses a cordless fastener driving device with a mode selector switch, and U.S. Pat. No. 3,243,023 that discloses a clutch mechanism. Moreover, various references related to coil springs in general, are known.

However, there still exists an unfulfilled need for a lightweight and efficient fastener driving device that provides sufficient energy to drive a fastener. There also exists an unfulfilled need for such a fastener driving device that allows bump fire actuation. Further, there is a need to ensure that the increase in power does not result in an increase in recoil and that the resultant recoil is suppressed to the extent possible.

BRIEF SUMMARY OF THE INVENTION

It is an aspect of the present invention to provide a lightweight and efficient fastener driving device that provides sufficient energy to drive a fastener.

Another aspect of the present invention is to provide such a fastener driving device that allows bump fire actuation.

Still another aspect of the present invention is to provide a fastener driving device that advantageously utilizes a drive spring made of a composite material.

In accordance with another aspect of the invention, a fastener driving device is provided with an efficient assembly for compressing a drive spring and releasing the energy from the drive spring to drive a fastener.

Yet another aspect of the present invention is to provide a fastener driving device that enhances functionality while minimizing size by positioning components in the drive spring.

Another aspect of the invention is to provide a fastener driving device that minimizes shock forces exerted on components of the device that is caused by driving a fastener into a workpiece.

Still another aspect of the present invention is to provide a method for operating fastener so as to minimize the time required to initiate the driving operation by pre-compressing the drive spring.

Another aspect of the invention is to provide a fastener driving device with a mode switch that includes a battery mode.

Yet another aspect of the present invention is to provide a fastener driving device including a controller with a timer that can be used to monitor operation of the fastener driving device.

Another aspect of the present invention is to provide a fastener driving device that includes a safety interlock mechanism.

Still another aspect of the invention is to provide a fastener driving device that minimizes the effect of recoil.

Another aspect of the invention is to provide a fastener driving device is provided with an efficient assembly for compressing a drive spring and releasing the energy from the drive spring to drive a fastener while suppressing recoil.

Yet another aspect of the present invention is to provide a fastener driving device that enhances functionality while minimizing size by positioning components in the drive spring.

Another aspect of the invention is to provide a fastener driving device that minimizes shock forces exerted on components of the device that is caused by driving a fastener into a workpiece.

Still another aspect of the invention is to provide a fastener driving device that minimizes the effect of recoil by providing a recoil suppression device.

In view of the above, in accordance with the present invention, a fastener driving device is provided including a fastener driver displaceable to drive a fastener, a spring that moves the fastener driver through a drive stroke, and a motor for compressing the spring in a return stroke, where the counter mass for suppressing recoil is at least a portion of the tool itself. More particularly, the counter mass would include the power train, lead screw, a portion of the spring mass and cap portion of the driver.

In accordance with another aspect of the present invention, a power tool is provided including a spring, a rotatably mounted threaded shaft, and a coupler mechanism for engaging the threaded shaft to allow compression of the spring. The power tool also includes a motor, and a gear train with a clutch connected to the motor, the threaded shaft being connected to the gear train and being rotatable by the motor. At least the motor, gear train and lead screw are mounted in a cap of the tool and are so mounted so as to permit them to be displaced in a direction opposite that of the drive stroke. The coupler mechanism may include a carrier that engages an end of the spring, and a nut that movably engages the threaded shaft, the coupler mechanism being operable to releasably engage the carrier to the nut to lift the carrier along the threaded shaft to compress the spring during the return stroke. In this regard, the coupler mechanism may be implemented with a movable element that is moved radially inwardly to engage the nut to lift the carrier along the threaded shaft to compress the spring during the return stroke, and is moved radially outwardly to disengage the nut to allow the spring to decompress during the drive stroke.

In accordance with still another aspect of the present invention, a fastener driving device is provided including a fastener driver displaceable to drive a fastener, a spring that moves the fastener driver through a drive stroke, and a coupler mechanism for compressing the spring through a return stroke, the coupler mechanism including radially movable components positioned inside the spring. The fastener driving device includes a threaded shaft positioned inside the spring, the coupler mechanism including a carrier that engages an end of the spring, and a nut that movably engages the threaded shaft, the coupler mechanism being operable to releasably engage the carrier to the nut to lift the carrier along the threaded shaft to compress the spring during the return stroke. With the present recoil suppression device, the coupler mechanism or carriage, ⅓ of the spring mass and the driver are considered to be the moving mass, the power train, lead screw and ⅔ of the spring mass are considered to be the cap or counter mass and the remaining portions of the tool, particularly the tool frame, door, nose and magazine are considered to be the tool mass. In the loaded condition, the force of the spring is balanced between the coupler mechanism or carriage and the cap and therefore has no effect on the frame.

In accordance with yet another aspect of the present invention, a power tool is provided including a motor with a drive train, an output shaft, and a driver displaceable along an axial drive direction, wherein the motor is mounted with the output shaft substantially parallel to the axial drive direction. With such a construction, the motor and power train may be movably mounted such that the motor and power train can be displaced in the direction substantially parallel to the axial drive direction thereby creating a counter mass. In this regard, recoil may be suppressed with an axial displacement of the drive train.

With the present invention, it is proposed to let the counter mass, be the cap which includes the power train, including the motor and gears, lead screw and ⅔rds the spring mass. The frame would include the nose, door, frame and magazine assembly forming the toll and considered the tool mass, and the carriage including the driver and ⅓$^{rd}$ the spring mass would be the moving mass or referred to as the carriage.

In accordance with an aspect of the present invention and as noted above, the force of the spring during loading is balanced between the cap and carriage. Therefore the drive spring force is not seen by the frame. To achieve this aspect, the frame is coupled to the cap by way of a spring of much lower force and rate than the drive spring. The coupling spring is sized to prevent movement between the frame and cap which can be perceived by the user. The force is minimal so only a small impulse is transferred to the frame during the drive event.

With another aspect of the present invention, consideration for the sizing of the coupling spring is necessary such that during the wind up of the drive spring the coupling spring is able to fully extend to its initial length. As the wind up time of tool of the present invention is somewhat over 20 times the drive time, the coupling spring can be much lighter than the drive spring in force and rate. So during the drive most of the initial reaction caused by the high acceleration of the driver mass is taken by the counter mass or cap. Therefore the frame and nose remain only slightly affected by any force which can be transmitted thru the coupling spring, until the allowed stroke of the coupling spring is reached.

In view of the above, in accordance with one embodiment of the present invention, a fastener driving device is provided including a fastener driver displaceable to drive a fastener, a spring that moves the fastener driver through a drive stroke, and a motor for compressing the spring in a return stroke, where the spring includes a composite material. In one implementation, the composite material includes glass, carbon, aramid, boron, basal, and/or synthetic spider silk fiber.

In accordance with another aspect of the present invention, a power tool is provided including a spring, a rotatably mounted threaded shaft, and a coupler mechanism means for engaging the threaded shaft to allow compression of the spring. The power tool may also include a motor, and a gear train with a clutch connected to the motor, the threaded shaft being connected to the gear train and being rotatable by the motor. In one embodiment, the coupler mechanism means includes a carrier that engages an end of the spring, and a nut that movably engages the threaded shaft, the coupler mechanism means being operable to releasably engage the carrier to the nut to lift the carrier along the threaded shaft to compress the spring during the return stroke. In this regard, the coupler mechanism may be implemented with a movable element that is moved radially inwardly to engage the nut to lift the carrier along the threaded shaft to compress the spring during the return stroke, and is moved radially outwardly to disengage the nut to allow the spring to decompress during the drive stroke.

In accordance with still another aspect of the present invention, a fastener driving device is provided including a fastener driver displaceable to drive a fastener, a spring that moves the fastener driver through a drive stroke, and a coupler mechanism for compressing the spring through a return stroke, the coupler mechanism including radially movable components positioned inside the spring. In one embodiment, the fastener driving device includes a threaded shaft positioned inside the spring, the coupler mechanism including a carrier that engages an end of the spring, and a nut that movably engages the threaded shaft, the coupler mechanism being operable to releasably engage the carrier to the nut to lift the carrier along the threaded shaft to compress the spring during the return stroke. In one preferred implementation, the coupler mechanism includes at least one pin that is moved radially inwardly to engage the nut to lift the carrier along the threaded shaft to compress the spring during the return stroke, and moved radially outwardly to disengage the nut to allow the spring to decompress during the drive stroke.

In accordance with yet another aspect of the present invention, a power tool is provided including a motor with an output shaft, and a driver displaceable along an axial drive direction, wherein the motor is mounted with the output shaft substantially parallel to the axial drive direction. In such an embodiment, the motor may be movably mounted by a shock mount that allows the motor to be displaced in the direction substantially parallel to the axial drive direction. In this regard, the shock mount may be implemented with an axially displaceable coupling.

In accordance with another aspect of the present invention, a method for operating a fastener driving device is provided, the fastener driving device including a fastener driver displaceable to drive a fastener, and a spring that moves the fastener driver through a drive stroke. In one embodiment, the method includes partially compressing the spring, receiving a user input, further compressing the spring, and releasing the spring to move the fastener driver through the drive stroke. In this regard, in one embodiment, the partial compressing of the spring compresses the spring at least 70% of compression attained by further compressing the spring. In an embodiment, the partial compressing of the spring compresses the spring between about 70% and about 90%.

In accordance with still another aspect of the present invention, a power tool is provided that includes a housing, a motor received in the housing, a battery removably secured to the housing for providing power to the motor, and a mode switch for controlling the operation of the fastener driving device, the mode switch including a battery mode which allows the battery to be at least one of inserted and removed from the housing. In one embodiment, the fastener driving device includes a latch interconnected to the mode switch, the latch allowing the battery to be partially engaged to the housing when the mode switch is moved to the battery mode. In this regard, the battery may be provided with a primary detent and a secondary detent, the latch engaging the primary detent when the battery is fully secured to the housing, and disengaging from the primary detent and engaging the secondary detent when mode switch is moved to the battery mode. In one preferred embodiment, the battery remains connected to provide power to the power tool when the battery is in the partially engaged position.

In accordance with another aspect of the present invention, a fastener driving device is provided that includes a fastener driver movable through a drive stroke to drive a fastener, and movable through a return stroke after completion of the drive stroke, and a controller with at least one timer that monitors the duration of time required to complete, or partially complete, the return stroke.

In one embodiment, the device further includes a spring and carrier where upon moving the fastener driver through the drive stroke, the spring is partially compressed to a pre-compressed position. The timer preferably monitors the duration of the time in which the spring is in the pre-compressed position, the controller operates the fastener driving tool to lower the carrier to a home position to substantially decompress the spring if the time duration exceeds a time limit. In another embodiment, the timer monitors the time duration for the carrier to move from a home position after a drive stroke to the pre-compression position, and indicates a malfunction if the time duration exceeds a time limit.

In other embodiments, the timer further monitors the time duration for completion of the drive stroke, and indicates a jam condition if the time duration exceeds a time limit. The controller may be further adapted to place the fastener driving device in a low power-consumption sleep mode if a drive stroke is not initiated within a predetermined time period. In still another embodiment, the timer monitors the time required to re-activated the fastener driving device from the sleep mode, and an error is indicated if the time required exceeds a time limit.

In still another embodiment, the fastener driving device includes a mode switch with a battery position, and a controller that monitors the position of the mode switch and operates the fastener driving tool to substantially decompress the spring when the mode switch is placed in the battery position.

In yet another embodiment the fastener driving device includes a trigger and a trip, the trigger being actuable to initiate the drive stroke subsequent to actuation of the trip in a sequential mode, and the trip being actuable to initiate the drive stroke subsequent to actuation of the trigger in a bump mode. The fastener driving device further includes a controller that monitors the time duration from actuation of either the trigger or the trip while not initiating the drive stroke by actuation of the other, and de-activates the fastener driving device if the monitored time duration exceeds a time limit.

In accordance with yet another embodiment, the controller monitors voltage and/or current drain on the battery, and does not operate the motor if the voltage is below a predetermined limit and/or the current drain exceeds a predetermined limit for a predetermined period.

In accordance with still another aspect of the present invention, a power tool is provided which includes a safety interlock mechanism. In one embodiment, the power tool includes a trigger that must be actuated to operate the power tool, a contact trip that must also be actuated to operate the power tool, and a safety interlock mechanism that prevents operation of the power tool when only one of the trigger and the contact trip is actuated, the safety interlock mechanism including a wire. The wire may be implemented with a compliant member.

In accordance with yet another aspect of the invention, a fastener driving device is provided that includes a nose/trip assembly. In one embodiment, the fastener driving device includes a nose including a drive channel, a fastener driver movable through a drive stroke to drive a fastener, and a contact trip actuable to initiate the drive stroke. The contact trip includes a land with a contact surface that extends into the drive channel. In another embodiment, the nose has a plurality of prongs, and the land is positioned between the plurality of prongs. Moreover, the contact surface of the land may be angled.

In accordance with another aspect of the present invention, there is provided a fastener driving device that includes a fastener driver, a magazine for carrying a supply of fasteners to the fastener driver, an energy storage source configured to store potential energy that moves the fastener driver through a drive stroke, and a reversible motor configured to move the fastener driver through a return stroke. The motor is operable upon completion of the drive stroke to move the fastener driver partially through the return stroke a predetermined amount to partially pre-energize the energy storage source. The motor is further operable to fully energize the energy storage source after receiving a signal for the drive stroke.

In accordance with another aspect of the invention, a fastener driving device is provided. The fastener driving device includes a fastener driver configured to drive a fastener into a workpiece during a drive stroke, an energy storage source configured to store potential energy and to release the potential energy to the fastener driver to initiate the drive stroke, a motor constructed and arranged to provide energy to the energy storage source, and a drive train operatively connected to the motor and to the energy storage source. The drive train is configured to transfer the energy from the motor to the energy storage source and to restrain the potential energy stored in the energy storage source when the motor is in an off condition.

In an embodiment, the drive train includes a clutch that includes a housing having an inner surface, a drive planet carrier rotationally coupled to the motor and positioned within the inner surface of the housing, the drive planet carrier having a plurality of drive members, an anvil rotatably coupled with the drive planet carrier and positioned within the inner surface of the housing, the anvil having a plurality of projections extending in a radial direction relative to a central axis of rotation, and a plurality of breaking pads. Each breaking pad is supported by the drive planet carrier and disposed between one of the projections of the anvil and one of the drive members of the drive planet carrier. The breaking pads are constructed and arranged to allow rotational movement of the anvil when the motor is providing energy to the energy storage source, and to substantially prevent rotation of the anvil when the motor is not providing energy to the energy storage source.

In an embodiment, the anvil member includes a plurality of cam surfaces located between the projections. Each breaking pad includes a first surface configured to engage one of the cam surfaces when the motor is providing energy to the energy storage source, and a second surface that is angled with respect to the first surface. The second surface is configured to engage a second cam surface when the motor is not providing energy to the energy storage source. When the second surface of the breaking pad engages the cam surface, the breaking pad causes the anvil to be locked relative to the inner surface of the housing.

In an embodiment, the fastener driving device also includes a rotatably mounted threaded shaft, a carrier connected to the fastener driver and configured to engage a part of the energy storage source, and a coupler mechanism configured to engage the threaded shaft and the carrier to allow transfer of the energy from the motor to the energy storage source. The coupler mechanism is operable to releasably couple the carrier to the threaded shaft to lift the carrier along the threaded shaft during a return stroke and to release the carrier to initiate the drive stroke.

In accordance with a further aspect of the invention, there is provided a fastener driving device that includes a nose assembly carried by the housing. The nose assembly has a fastener drive track. The fastener driving device also includes a magazine assembly constructed and arranged to feed successively leading fasteners from a supply of fasteners contained therein along into the drive track, a fastener driver configured to enter the drive track during a drive stroke and drive a leading fastener into a workpiece, and an energy storage source configured to store potential energy. The energy storage source is constructed and arranged to move the fastener driver through the drive stroke. A contact trip is constructed and arranged to be moved from a normally biased inoperative position into an operative position when the contact trip is pressed against the workpiece. A fastener lockout operatively coupled to the contact trip and is constructed and arranged to prevent the leading fastener from being driven by the fastener driver when the contact trip is in the inoperative position.

These and other advantages and features of the present invention will become more apparent from the following detailed description of the preferred embodiments of the present invention when viewed in conjunction with the accompanying drawings.

BRIEF DESCRIPTION OF THE DRAWINGS

Embodiments of the invention will now be described, by way of example only, with reference to the accompanying schematic drawings in which corresponding reference symbols indicate corresponding parts.

FIG. 22A is an enlarged perspective view of a nut and a pin lockout sleeve in accordance with one embodiment of the present invention.

FIG. 22B is a bottom view of the nut of FIG. 22A as viewed along 22B-22B.

FIG. 22C is a top view of the pin lockout sleeve of FIG. 22A as viewed along 22C-22C.

FIG. 35A is a partial cross sectional view of a latch in accordance with another embodiment engaging a secondary detent.

FIG. 35B is an enlarged partial cross sectional view of the in

DETAILED DESCRIPTION OF THE INVENTION

Figure 1:
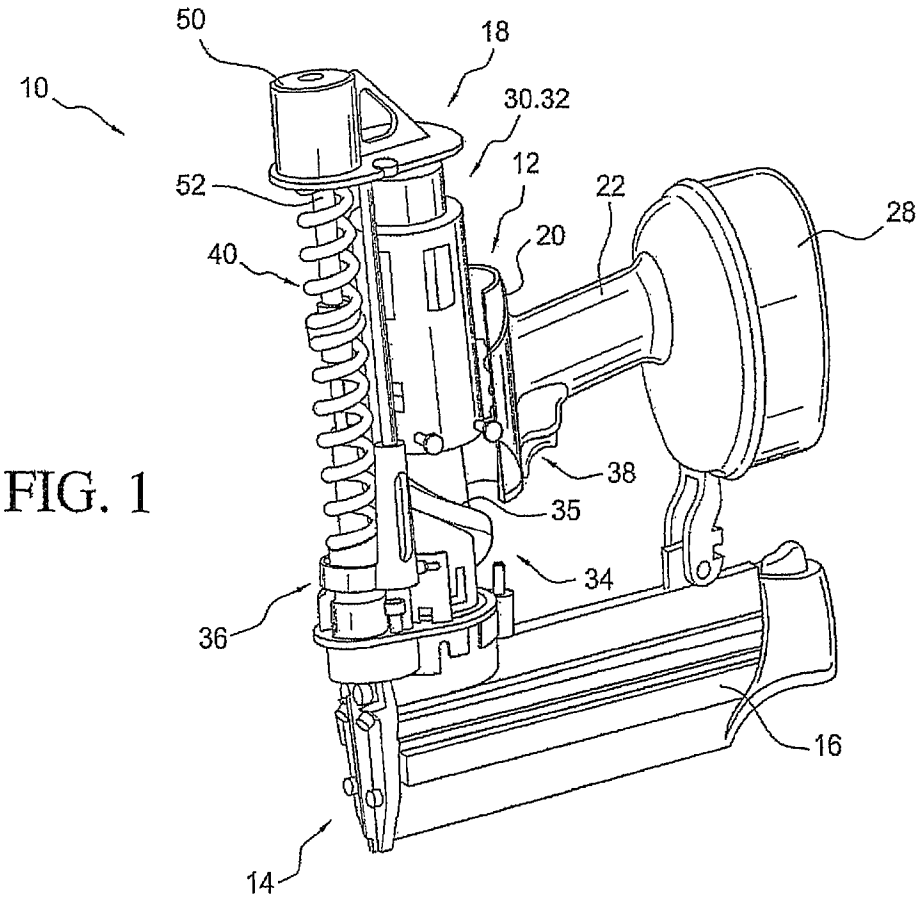
FIG. 1 is a perspective view of a fastener driving device according to one embodiment of the present invention, with a portion of its housing removed.

FIG. 1 illustrates a fastener driving device 10 according to one implementation of the present invention. As shown, the fastener driving device 10 includes a housing assembly 12, a nose assembly 14, and a magazine 16 that is operatively connected to the nose assembly 14 and is supported by the housing assembly 12. The device 10 also includes a power operated system 18 that is constructed and arranged to drive fasteners that are supplied by the magazine 16 into a workpiece. The housing assembly 12 includes a main body portion 20, and a handle portion 22 that extends away from the main body portion 20, as shown in FIG. 1. The majority of the main body portion 20 is removed in FIG. 1 so that features contained within the main body portion 20 may be more easily viewed. The handle portion 22 is configured to be gripped by the user of the fastener driving device 10.

The nose assembly 14 is connected to the main body portion 20 of the housing assembly 12. The nose assembly 14 defines a drive track (not shown) that is configured to receive a fastener driver 26. The drive track is constructed and arranged to receive fasteners from the magazine 16 so that they may be driven, one by one, into the workpiece by the power operated system 18, as will be discussed in further detail below. In the illustrated embodiment, the power operated system 18 includes a power source 28, a motor 30, a reduction gear box 32 connected to the motor 30, a cam 34 that is operatively connected to the motor 30 via the gear box 32, a coupler mechanism 36, a trigger 38, and a drive spring 40.

As shown in the Figures, the power source 28 is a battery, although the illustrated embodiment is not intended to be limited in any way. It is contemplated that other types of power sources may be used for powering the motor. For example, it is contemplated that the motor may be electrically operated with a power cord connected to an outlet, or be pneumatically operated. In addition, a fuel cell may be utilized to allow the fastener driving device to be portably implemented. Of course, these are examples only, and the power source may be implemented differently in other embodiments.

The motor 30 is powered by the power source 28, and is configured to provide rotational movement to the cam 34 via the gear box 32. The gear box 32 is configured to provide the proper gear ratio between the motor 30 and the cam 34 such that the cam 34 rotates the desired amount at the desired speed. For example, the gear box 32 may be a reduction gear box so that the rotational speed of the motor 30 may be reduced prior to rotating the cam 34. The cam 34 includes a cam surface 35 on an outer portion thereof. As shown in the Figures, the cam surface 35 is substantially helical in shape so that it may provide linear translation of a part that follows the cam surface 35, as the cam 34 rotates.

The coupler mechanism 36 is moved upwardly through a return stroke via the cam 34, and more particularly via the cam surface 35. The coupler mechanism 36 includes a carrier 42 and the fastener driver 26, which is attached to the carrier 42. The carrier 42 and the fastener driver 26 are movable between a drive stroke, during which the fastener driver 42 is displaced along an axial drive direction to drive the fastener into the workpiece, and a return stroke. The coupler mechanism 36 also includes a guide 46 for guiding the substantially linear movement of the carrier 42. In one embodiment the guide 46 is disposed such that it is substantially parallel to the drive track, so that the carrier 42, and, therefore, the fastener driver 26 move linearly.

Figure 2:
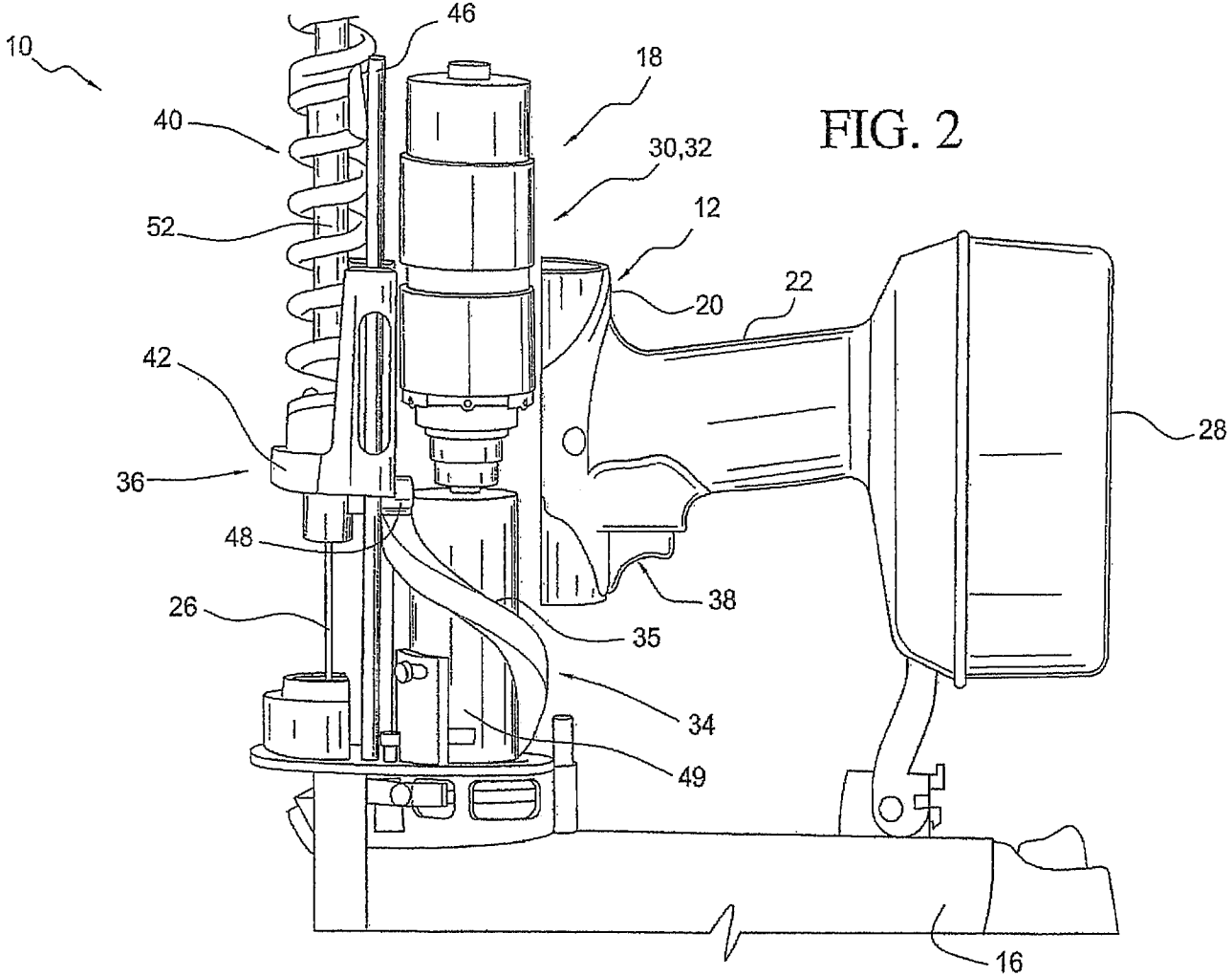
FIG. 2 is another perspective view of the fastener driving device of FIG. 1, with a fastener driver in a ready-to-strike position.

The coupler mechanism 36 further includes a cam follower 48 that is operatively connected to the carrier 42 such that it moves with the carrier 42. The cam follower 48 may be a separate piece that is either directly connected, or connected with an intermediate piece, to the carrier 42. The cam follower 48 is shaped and sized to interact with the cam surface 35 of the cam 34 so that when the cam 34 rotates, the cam follower 48 follows the cam surface 35 and allows the carrier 42 to be pushed upward when the cam 34 is rotated by the motor 30, as shown in FIG. 2.

The drive spring 40 is disposed between, and connected at each end to the carrier 42 and an end cap 50. A spring guide 52 that is connected to the end cap 50 may also be used to help guide the drive spring 40 as it compresses and expands. Thus, as the carrier 42 is pushed upward when the cam 34 is rotated by the motor 30, the spring, 40 is compressed. Once the carrier 42 reaches a predetermined height, the cam follower 48 falls off of the cam surface 35, thereby allowing the carrier 42 to move independently from the cam 34. Without resistance being provided by the cam 34, the energy now stored in the drive spring 40 is released, thereby moving the carrier 42 and the fastener driver 24 through the drive stroke. As the cam follower 48 falls off of the cam surface 35, it typically kicks the cam 34 back in the direction opposite to the direction that compresses the drive spring 40. In this regard, a cam return 49, which may be a torsion spring, ensures that the cam 34 is returned to its initial position so that the cam follower 48 may be reengaged with the cam surface 35, so the device 10 is ready for the return stroke, and the next drive stroke thereafter.

The device 10 also further includes a safety mechanism that includes a trigger 38 and a contact trip assembly (not shown). The contact trip assembly is commonly found on pneumatic fastener driving devices, and such an assembly is described, for example, in U.S. Pat. No. 6,186,386, which is incorporated herein by reference. The device 10 may be used in both sequential and contact modes. The contact trip assembly described in the '386 is not intended to be limiting in any way, and is incorporated merely as an example.

The trigger 38 is also in communication with a controller (not shown), and the controller communicates with the motor 30. Upon receiving a signal from the trigger 38, and/or the contact trip assembly, the controller signals the motor 30 to energize for a predetermined amount of time, which causes the cam 34 to rotate, thereby initiating a drive stroke. After completion of the drive stroke, the controller signals the motor to energize for a shorter time so that the cam 34 may rotate a predetermined amount to partially compress the drive spring 40, which reduces the amount of time needed to fully compress the drive spring 40 during the next drive stroke. The controller is preferably programmed such that after a predetermined amount of time in which the device 10 has not been used, the carrier 42 is allowed to return to a position in which there is no load on the drive spring 40.

Because the energy that is used to drive the fastener during the drive stroke is temporarily stored in the drive spring 40, the power and drive time of the device 10 is a function of, among other things, the design of the drive spring 40. In accordance with one aspect of the present invention, a composite spring is used in order to derive enhanced efficiency and power in comparison with prior art tools that employ metal springs. In one embodiment, the device 10 produces more than 40 joules of driving energy. As will be discussed in further detail below, as the energy requirements of the tool increase, the size and weight of a prior art steel spring increase to the point of becoming undesirable. Also, because the stroke used to drive larger fasteners is longer than the stroke used to drive smaller fasteners, the spring release velocity may become a restriction, and the weight of the spring may become more of an issue. In addition, an acceptable useful life of a steel spring becomes harder to fulfill in a more powerful tool, because as the energy requirements increase, the size of the spring increases, and the stress distribution and, hence, integrity of the material, may become a larger factor. It should be noted that as wire size increases, the tensile strength decreases. Also, problems associated with vibrations tend to get larger due to the weight of the spring itself, as the size and energy storage increases.

It has been found that a composite spring, i.e., a spring that has been manufactured from a composite material, has a high stiffness to weight ratio, has good dynamic efficiency (able to release energy quickly), is able to withstand high dynamic loading, and is able to dampen out oscillations quickly. For example, comparing the values of steel and S-2 Glass (a common glass used in composite manufacture) the following results are obtained. If the values for steel were used in a commonly known energy/volume equation, an energy/volume value would be: E/V=1.5e7, and for S-2 Glass Fiber, E/V=3.4e8, or 22 times as efficient as steel. A further advantage is found in the energy/mass as the density of steel is 7850 kg/m3 and the density of a composite spring made as described is approximately 1915 kg/m3, or 4 times less.

In the area of response, a composite spring in accordance with one embodiment of the invention has a rate of greater than 600 kg/m, a mass of less than 1 lb., and a drive time of less than 20 msec., preferably less than 15, and more preferably less than 10 msec. A sample spring has been designed that has a rate of 1000 kg/m (which would equal 90 kg force or 883 N at 90 mm), with a mass of 0.104 kg. Its first mode natural frequency of the spring itself fixed at both ends may be estimated to be 0.5×[1000×9.8/0.104]½=154 Hz. This is close to twice to the idealized calculated value for a steel spring. Theoretically, to estimate the equivalent drive, one can assume a spring mass system, to yield a frequency response of 1/pi*0.5×[1000×9.8/0.104]½=49 Hz. The cycle time for one full oscillation would be 1/49, or 20.4 msec., so the drive time (half the full oscillation) would be one-half this, or 10.2 msec. for a spring made of fiber glass and epoxy.

Another advantage in the composite spring lies in its ability to release more of its stored energy during the initial drive. A load curve for a steel spring would show more fluctuations than a composite spring as the mass inertia of the individual coils would cause the spring to behave as a number of separate mass spring systems. In general, the release phenomena are closely related to the natural frequency of the spring. The higher the natural frequency, the better the spring will respond, and the lower the influence on life from dynamic loads. Yet another advantage of the weight density of the composite spring is in operator comfort. As the energy requirements get higher, the relative weight advantage increases to a point where the steel spring is no longer practical, but is not a major issue when a composite spring is used.

A strain energy storage source, such as the drive spring 40, should be mechanically coupled to the fastener driver 26 to drive the fastener. The act of coupling the spring 40 to the driver 26 imparts a portion of the mass of the drive spring 40 to the driver 26. A typical value is ⅓ of the spring mass. Based upon a driver weight limit of 0.33 lb. for a 10 lb. tool, the mass of the spring in accordance with one aspect of the invention is less than 1.0 lb. In accordance with one embodiment of the invention, the tool weighs 10 lbs. or less, and the mass of the spring is 1 lb. or less. In addition, the driver 26 that is attached to the spring has some mass so the actual spring/driver subassembly has a weight of 0.33 lbs. or less, so conservatively, the spring itself should weigh approximately less than 1.0 lb. The effectiveness of a spring material may be gauged by its energy storage density. If the spring is assumed to weigh 1.0 lb for simplicity, then a tool that utilizes 400 in-lbs of energy would use a spring material capable of storing 400 in-lb per pound of material and a 200 in-lb tool would use a spring capable storing 200 in-lb/lb, etc.

As discussed, a drive time of less than about 15 msec. can be achieved in accordance with the present invention. Natural frequency of the spring system is used to estimate drive time, because, as shown in the examples above, the drive time is approximately half of the inverse of the natural frequency. In this regard, a spring tool coefficient to compare spring materials has been created, using both energy density and drive time, by dividing the energy density (in-lb/lb) with the equivalent drive time (msec.) yielding a spring tool coefficient (STC) with in-lb/lb-sec. units, as represented by equation (2):

$$STC = \frac{2\Im E}{W} \text{ in-lb/(lb-sec)} \tag{2}$$

where E=spring energy (in-lb), $\Im$=spring natural freq (hz.), and W=spring weight (lbs).

Table 1 below illustrates the difference in the specifications for springs made of different materials if designed to have similar energies of 400 in-lb. With this energy, the minimum tool coefficient was calculated to be at least 26,667 in-lb/lb-sec. in order to properly drive a fastener. In this regard, composite springs having similar energies of 400 in-lb were manufactured out of glass-epoxy and carbon-epoxy, and their spring tool coefficients were calculated. Springs made of conventional metals were then also designed, and the spring tool coefficient was calculated for comparison purposes. It is noted, that coil spring designs were selected for this example because a coil spring has proven to be the most efficient spring geometry, and also have form advantages. Similar tables can be created with other types of spring geometries, but the values will typically be lower. The natural frequencies calculated or measured were based on solutions to equivalent spring mass systems.

TABLE 1

| Typical data for a large coil spring geometry. (Unless noted, calculated based on 400 in-lb optimized spring design) | Target Values | Music Wire | Chrome Vanadium | Berylium Copper | 17-7 Stainless | Glass Epoxy (test data) | Carbon Epoxy (test data) |
|---|---|---|---|---|---|---|---|
| Design Energy (in-lb) | 400 | 400 | 400 | 400 | 400 | 369 | 400 |
| Spring Weight (lb.) | 1 | 1.3 | 1.5 | 2.27 | 2.46 | 0.32 | 0.196 |
| Energy Density (in-lb/lb) | 400 | 308 | 267 | 176 | 163 | 1153 | 2041 |
| Natural Frequency (Hz) | 33 | 10 | 12 | 9 | 14 | 38 | 39 |
| Equivalent Drive time (msec.) | 15 | 48.7 | 41.7 | 54.2 | 35.7 | 13.2 | 12.8 |
| Spring Tool Coefficient (in-lb/lb-sec) | 26667 | 6314 | 6400 | 3249 | 4553 | 87638 | 159184 |

TABLE 1 shows that with spring tool coefficients well less than 26,667 in-lb/lb-sec, commonly used spring materials are inadequate for a 400 in-lb spring powered fastener driving device. In this regard, conventional metals can only be used to drive very small fasteners, such as brad nails. The Glass/Epoxy composite material, however, is shown to be more than adequate with a spring tool coefficient of 87,000 in-lb/lb-sec, which is more than 3 times the minimum spring tool coefficient requirement of 26,667 in-lb/lb-sec. As shown in the table, the spring made from composite material has a weight of less than 1 lb., an energy density of greater than 400 in-lb/lb, a natural frequency of greater than 33 Hz, an equivalent drive time of less than 15 msec., and a spring tool coefficient of greater than 26,667. Using this analysis, the maximum tool energy that the best common spring material (i.e. chrome vanadium wire from TABLE 1) would be able to support may be determined. For example, it is found that 200 in-lbs is the maximum energy a chrome vanadium wire spring powered tool could practically achieve.

TABLE 1 also illustrates the performance of a spring made of Carbon/Epoxy composite material which was found to perform even better than the Glass/Epoxy composite material. In particular, the Carbon/Epoxy composite material was shown to be more than adequate with a spring tool coefficient of nearly 160,000 in-lb/lb-sec, which is about 6 times the minimum spring tool coefficient requirement of 26,667 in-lb/lb-sec, and almost twice that of the Glass/Epoxy composite. As also shown, the Carbon/Epoxy spring was extremely light had the highest energy density, and had the quickest equivalent drive time. Correspondingly, of the materials considered for the drive spring, with the presently available fabrication methods, Carbon/Epoxy spring was found to be superior. It should be noted that based on mechanical properties of the fiber alone, S-2 glass should produce a better performing spring than one made of carbon fiber. Of course, it should also be noted that the present invention is not limited to the particular spring materials discussed above, and further optimization of the spring may be made. In stead, such materials are discussed and presented herein merely as examples.

Figure 4:
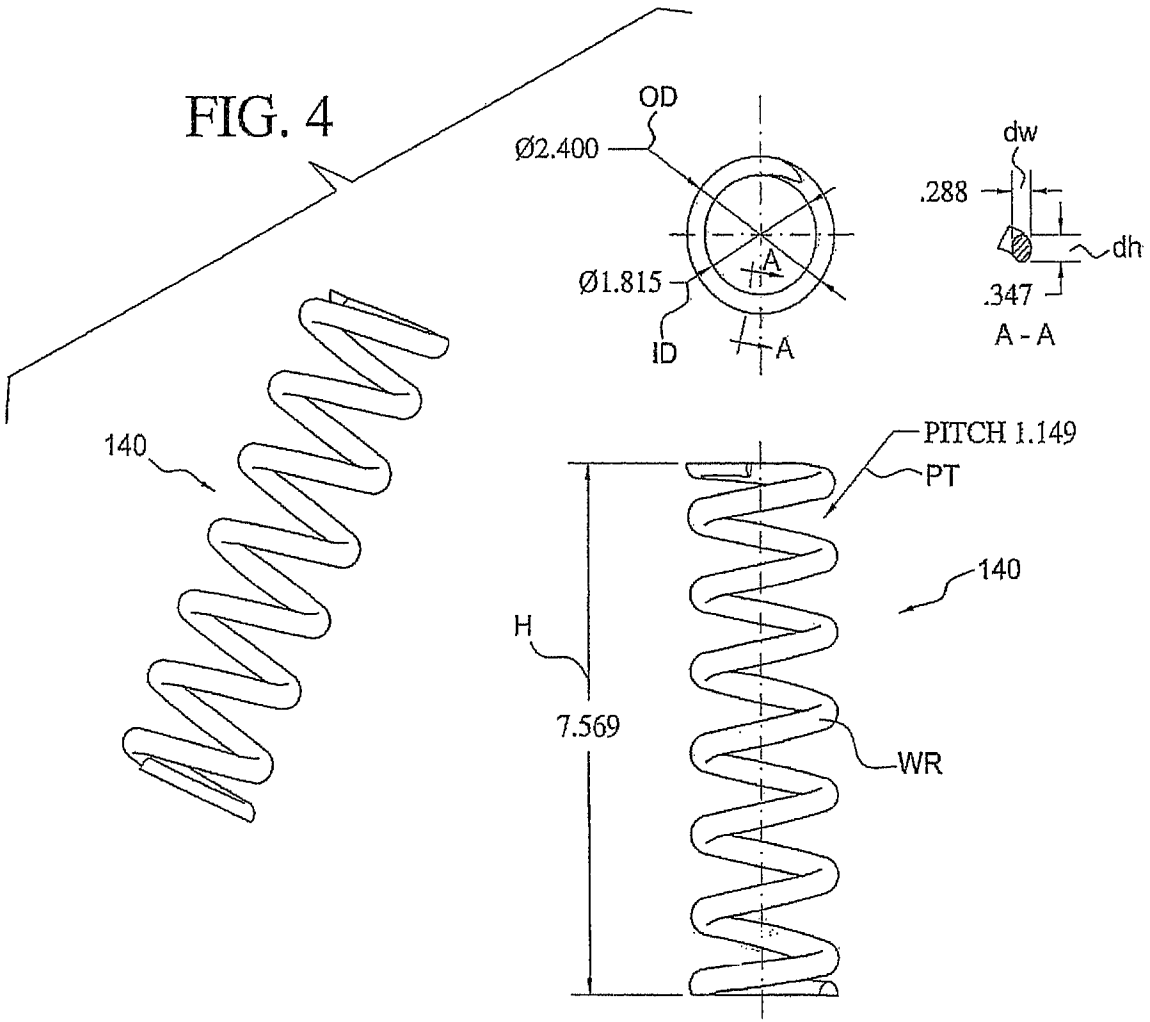
FIG. 4 shows various views of a spring of the fastener driving device of FIG. 1.

A coil spring 140 made from a composite material has been designed to satisfy the target values in TABLE 1 is shown in FIG. 4. The illustrated spring 140 has an outer diameter OD of about 2.400 inches, and inner diameter ID of about 1.815 inches, and a height H of about 7.569 inches. The "wire" WR of the spring 140 has a substantially elliptical cross-section with a major diameter dh of about 0.347 inches and a minor diameter of about 0.288 inches. The spring may be manufactured with glass fiber and epoxy resin. Wetted fiber may be wrapped around a central core to create the wire WR as described in further detail below. The properties of the spring 140 may be varied by changing the pitch PT (and hence pitch angle) and fiber content of the spring 140. The wire WR may then be wound around a lost core mandrel to form its shape. The wire is then subjected to heat, which polymerizes and cures the epoxy resin, and also melts the core. The spring 140 may then be cleaned to prepare it for inclusion in the fastener driving device 10.

The spring 140 is preferably made of fiberglass and epoxy, and most preferably, the fibers are continuous through the spring. In particular, the fiberglass may be Owens Corning SE 1200 Type 30 and/or Owens Corning 346 Type 30, 600 or 1200 Tex (grams/kilometer line weight), 600 Tex being preferred. The epoxy may be Huntsman: Araldite LY3505 hardeners XB3403/XB3404/XB3405 or Huntsman: Araldite LY556 hardener 22962. Various common additives may also be used to improve wetout, preclude aeration, and improve processing. Fiberglass and epoxy is a very good material because of its blend of economics and performance, including modulus of elasticity and tensile strength characteristics. Of course, other fibers and resins may be utilized for the spring in other embodiments of the present invention. For instance, carbon, aramid, boron, basal, and synthetic spider silk, etc. may be used, or in still other embodiments, combinations of fiber materials and other resins may be used, such as polyester, vinyl ester, urethanes, as well as thermoplastic resins, ABS, nylon, polypropylene, peek, etc. Depending on the particular usage parameters, a spring made from such materials may achieve better performance than the fiberglass composite described. However, in view of the blend of economics and performance, the preferred implementation of the spring utilizes fiberglass composite as described above.

Such glass epoxy and carbon epoxy composite springs can be manufactured in any appropriate manner and may be available from composite spring manufacturers such as Liteflex, LLC. of Englewood, Ohio. In accordance with one preferred implementation, a fiberglass core is assembled with multiple fibers being either twisted, braided or bundled together in line and are wetted out individually before bundling or wetted as a bundled assembly. Of course, in other embodiments, composite springs that do not include a core may be used as well. The size of the core can be varied depending on the stiffness of the wire desired and/or the time desired to complete the layup of the wire. The glass epoxy composite spring of the above noted embodiment may be manufactured with core sizes in the range 0.080" to 0.200" in diameter. Wires with smaller cores have been found to yield better fatigue life results.

The wetout core is then wound with wetout fibers at an angle oblique to the core axis. Successive layers of fiber are wrapped around the core at varying angles until the final wire diameter is achieved. The wire is then wrapped in a silicone seal. The seal can be shaped to act to distort the circular shape of the wire to more of an elliptical shape, or other shape, if desired. The sealed wire is then wrapped around a mandrel and pressed into a helical groove having the desired shape of the spring. The groove may also be shaped to distort the wire into the desired form. The wrapped mandrel is then covered with a tight fitting sleeve. The sleeve and the grooved mandrel maintains the cross sectional shape of the wire and the form of the coils during the curing process. The mandrel assembly is heated at a specified rate to properly cure the resin. Near the end of the curing process the heat applied is sufficient to melt the mandrel allowing for easy un-molding of the spring.

The glass content of the glass epoxy composite spring may vary depending on the desired mechanical and durability properties. It was found after significant experimentation that fiber content of 68% to 71% by weight yield the best results. Fiber angle and lay up play an important role in determining the mechanical characteristics of the glass epoxy composite spring 140. Naturally isotropic materials (e.g. metals), when formed into coil springs, function equally well in compression and tension. In general, fiber-reinforced composites are not naturally isotropic. Designers vary the fiber direction (layup) from ply to ply to create essentially isotropic properties or non-isotropic properties depending how the part will be loaded. A composite spring meant only for a compression or a tension application can be wound with fibers all in the same direction, in the direction that resists the torsional shear stress. The actual stress state is more complex with components of direct shear and bending stress but these are small compared with the torsional component. The direction of torsional stress in a round straight bar is 45 deg to its axis. The combined stress state in a coil spring acts to reduce this 45 angle slightly in a round cross section.

Each layer is wrapped with fiber. Wrapping does not produce a weave/braid or any interlocking or overlapping of fibers on a particular layer. The fiber angle alternates from layer to layer and essentially 90 degrees to one another. Doing so, creates a spring that can perform equally well in compression and tension. It is also noted that if the successive layers were wrapped in the same direction, some interlacing of the fibers into the previous ply would occur creating undesirable distortion of the fibers.

Figure 5:
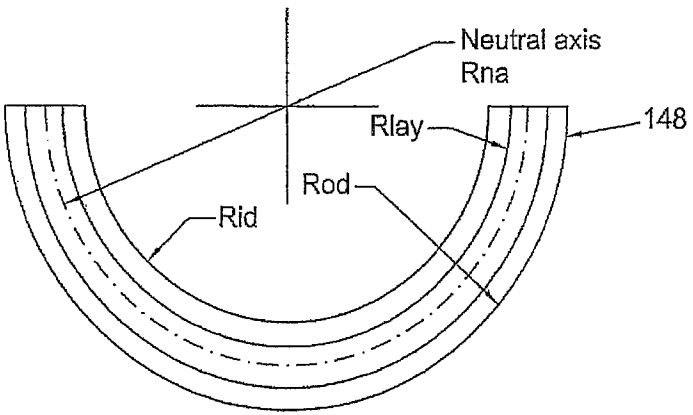
FIG. 5 is a schematic illustration of a partial coiled wire that shows outer diameter strain and the inner diameter strain in a coiled wire.

When the wetout wire is coiled, fiber layers slip relative to each other as well as the individual fibers in each layer so the fibers and layers follow the natural geometric strain effects of the coiling process. It is the goal to have all the fibers aligned in the direction of stress after the spring has been coiled and cured. Referring to FIG. 5 which is a schematic illustration of strain in a coiled wire 148, the strain on the inner diameter being equal to Rid/Rna, where Rid is the radius at the inner diameter, and Rna is the radius at the neutral axis. The strain on the outer diameter of the wire is equal to Rod/Rna, where Rod is the radius at the outer diameter. Similarly, the strain at any particular layer can be calculated with Rlayer/Rna. Knowing the strain imposed due to coiling in each layer, the change in the fiber angle due to the coiling strain can be determined since the unit length of the fiber remains constant. The end result is that the fiber angle increases inside of the neutral axis, and decreases outside of the neutral axis due to the strain imposed during coiling.

TABLE 2 below shows how the fiber angle changes layer by layer in a continuous fiber composite coil spring with a core diameter of 0.1875 inches and Rna=0.97 inches, and layer thickness=0.010 inches.

TABLE 2

FIBER ANGLE CHANGE ID AND OD PLY TO PLY
Core OD 0.1875
Ply Thickness 0.010
Neutral axis radius 0.970

| Ply # | Radius on coiled spring | Strain due to coiling | Start Fiber Angle | ID Finish Fiber Angle | OD Finish Fiber Angle |
|---|---|---|---|---|---|
| 1 | 1.074 | 10.70% | 41.8 | 45.0 | 38.9 |
| 2 | 1.084 | 11.73% | 41.4 | 45.0 | 38.3 |
| 3 | 1.094 | 12.76% | 41.1 | 45.0 | 37.7 |
| 4 | 1.104 | 13.79% | 40.8 | 45.0 | 37.1 |
| 5 | 1.114 | 14.82% | 40.4 | 45.0 | 36.6 |
| 6 | 1.124 | 15.85% | 40.1 | 45.0 | 36.0 |
| 7 | 1.134 | 16.88% | 39.7 | 45.0 | 35.4 |
| 8 | 1.144 | 17.91% | 39.4 | 45.0 | 34.8 |

TABLE 2-continued

FIBER ANGLE CHANGE ID AND OD PLY TO PLY
Core OD 0.1875
Ply Thickness 0.010
Neutral axis radius 0.970

| Ply # | Radius on coiled spring | Strain due to coiling | Start Fiber Angle | ID Finish Fiber Angle | OD Finish Fiber Angle |
|---|---|---|---|---|---|
| 9 | 1.154 | 18.94% | 39.0 | 45.0 | 34.3 |
| 10 | 1.164 | 19.97% | 38.7 | 45.0 | 33.7 |
| 11 | 1.174 | 21.01% | 38.3 | 45.0 | 33.1 |
| 12 | 1.184 | 22.04% | 37.9 | 45.0 | 32.6 |

In TABLE 2 set forth above, the start fiber angles were selected such that the angle after coiling on the inner diameter is 45 deg. As previously mentioned, 45 degrees is the optimal angle for a round torsion bar. Although 45 degrees is not the optimal angle for the ID of a coil spring due to other stress factors such as shear and bending stresses, it is used as a reference for approximation. In addition, in a coiled wire, the highest strains exist on the ID of the coil so it follows that the wire geometry is optimized to support the highest strains on the ID.

A coil composite spring for a fastener driving device such as the glass epoxy composite spring is primarily loaded in compression. However, the fast release of the stored energy creates stress waves that result in tensile loads in the coils. Increasing the spring preload can help reduce the magnitude of the tensile stress but it does not eliminate it. Therefore, the glass epoxy composite spring is preferably implemented so that whereas the majority of the fibers resist compression loads, there are enough opposite angle fiber layers provided to adequately support the layers resisting compression and also to resist the tensile loads.

Extensive experimentation was performed on this plus/minus fiber layering scheme. Through such experimentation, it has been found that the final 4 layers may advantageously be oriented to resist compression, and all other layers successively alternating by approximately 90 degrees as described above.

Another important factor that impacts the mechanical characteristics of the glass epoxy composite spring is the wire cross section. The most weight efficient cross section for a coil spring is a circular cross section with a round hollow core. In practice, it is difficult to produce a spring with a round hollow core, so cross sections are typically solid. Non circular cross-sectional springs may be manufactured as proposed in the art. Deviation from circular section can be advantageous depending on the intended application, design and manufacture of the composite spring. The maximum stress location can also be moved and controlled in the cross section of the wire. For example, depending on the method of manufacture, discontinuities or stress risers may not be eliminated in the cross section. By providing control over the location of maximum stress, the cross section could be designed such that the maximum stress does not coincide with a stress riser.

Bending the wire into a coil form also acts to create a glass content gradient in the cross section. Positive strain tends to squeeze resin out where negative strain tends to draw resin in. The result is a higher local glass content on the inner diameter (ID) of the spring and a lower local glass content on the outer diameter (OD) of the spring. This change in glass content can be computed and the cross sectional wire shape designed such that the glass content is optimum at the peak stress location.

The coil end geometry also contributes to the performance characteristics of the glass epoxy composite spring. Steel compression springs ends are typically closed and ground, or closed and not ground, such that the line of action (direction of the force) is close to the center of the spring. It's advantageous to have the line of action as close to the center of the spring as possible to minimize buckling effects. Buckling effects are a concern since the preferred coil spring geometries for spring driven fastener driving devices have long strokes and small diameters, leading to increased buckling risk.

To center the line of action, it's helpful to maximize the end coils contact patch. The traditional methods of closing coils and grinding coils to achieve large contact areas are not recommended for a composite coil spring. The composite wire gets its strength from the continuity of the fibers. Grinding breaks this continuity and significantly weakens the wire. Grinding is only recommended in areas where the applied torque is very low, i.e. very close to the end of the wire at either end. Closing the coil in the traditional manner also creates a fulcrum contact point under maximum deflection. Coil to coil contact with a composite spring may decrease its fatigue life.

In light of the above problems, a coil end geometry that maximizes the contact area with limited grinding and no coil to coil contact points under maximum deflection is preferably implemented for the glass and carbon epoxy composite spring as proposed. Alternatively or in addition thereto, an open ended composite coil spring may be used with a spring seat that substantially evenly distributes the stress on the composite coil spring, thereby enhancing manufacturability while improving durability thereof.

Various requirements have been found by the present inventors that preferably should be met by a coil spring to be used for a hand held fastener driving tool such as a nailer. TABLE 3 below lists the requirements that are believed to be very important for effectively implementing a spring driven fastener driving device suitable for driving a 15 g finish nail.

TABLE 3

COMPOSITE SPRING REQUIREMENTS FOR A FINISH NAILER

| PARAMETER | REQUIREMENTS |
|---|---|
| Stroke | Working stroke of 3.0" minimum and a total stroke of 3.5" minimum |
| Energy | Total work out in the working stroke is to be 400 in-lbs or greater, based on Work = $\frac{1}{2}Kx^2$, K = spring rate, and x = stroke. |
| Peak load | Not to exceed 215 lbs. at full working compressed height. |
| Spring Size | OD no greater than 3.0", fully compressed Solid height no greater than 4.0". |
| Spring Weight | Less than 0.5 lbs. |
| Spring static hysterisis (energy loss) | Less than 4% as calculated from the work integrals derived from a static load deflection curve. |

TABLE 3-continued

| COMPOSITE SPRING REQUIREMENTS FOR A FINISH NAILER | |
|---|---|
| PARAMETER | REQUIREMENTS |
| Dynamic efficiency | Not less than 85%. Spring must be able to accelerate a mass 3 times that of it own mass to a terminal velocity such that the total kinetic energy of the spring mass system is within 15% of the work input to the spring during compression. |
| Durability | Minimum fixtured dry fire life of 10,000 cycles. The dry fire test is a square wave test - where the spring is fully compressed, latched, and then, freely released without opposing load. |
| Loss of energy (through life of spring) | Less than 10% |

Most of the materials that are commonly used today for producing coil springs do not meet the design criteria for a fastener driving device application above an energy storage capacity of 200 in-lbs. However, a multitude of materials and/or combinations of materials are currently available that when transformed into a coil spring shape (without substantial degradation of their mechanical properties), would meet the design criteria for a fastener driving device. Example of such materials include composites using glass, carbon or aramid fibers with thermosetting (e.g. epoxy, polyester, polyurethane, vinyl ester) or thermoplastic (e.g. polypropylene, ABS, nylon, peek) resins, and the like. Spring patents previously noted above teach the design and manufacture a composite coil springs. It has been found by the present inventors that alternate spring shapes, sulcated, c-shape, stacked belleville, wave or leave springs, etc. do not exhibit an energy release response as well as composite coil springs to allow use in a fastener driving device.

The above discussion set forth spring fastener driving device with a composite spring in accordance with one aspect of the present invention. Of course, the fastener driving device is not limited thereto, and the fastener driving device may be implemented using springs made of different materials, although less preferred than composite materials for the reasons set forth above. Moreover, various different composite materials may be used as described above, including glass epoxy and carbon epoxy. In addition, the spring need not be a coil spring as shown and described, but can be any appropriate type of structural spring that is made of any appropriate materials. Correspondingly, the term "spring" as used herein and throughout, should be broadly understood to encompass any device that allows storage and release of strain energy, for example, any structural spring, such as a coil, Belleville type, leaf, torsion, or sulcated spring. Moreover, the term "spring" as used herein, should be broadly understood to encompass any device that allows storage and release of energy from a volume under pressure that expands to do work, such as a gas spring. However, use of coil springs, and especially such coil springs made of a composite material, allows realization of various advantages to the fastener driving device as discussed hereinabove.

Figure 3:
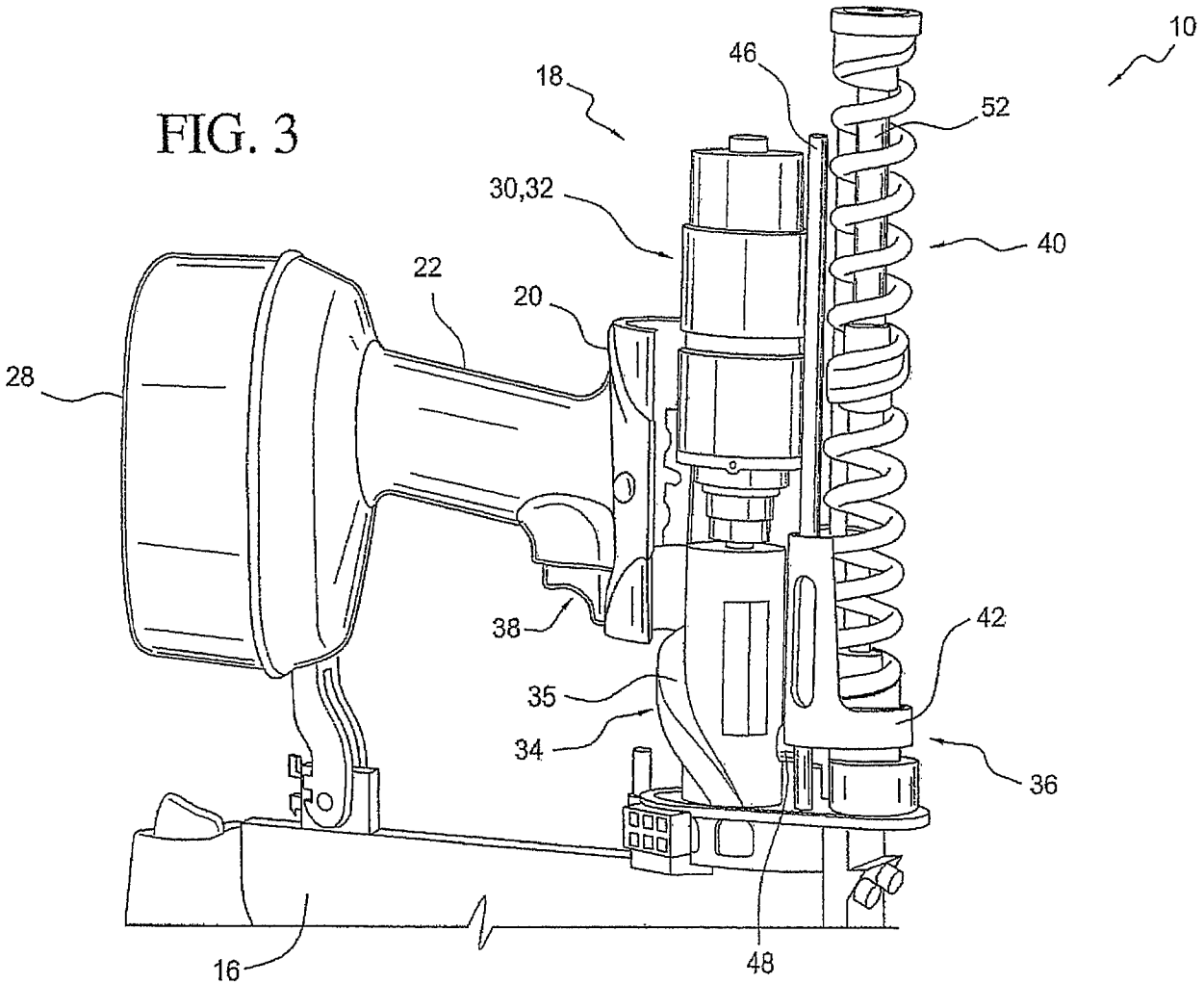
FIG. 3 is another perspective view of the fastener driving device of FIG. 1.

The tool discussed in detail above uses a barrel cam arrangement in combination with a motor and other mechanical and electrical components to compress, and freely release, the spring to drive a fastener dictated by the inputs controlled by an operator. The barrel cam mechanism disclosed, although functional, presents some difficulties for a hand held tool. In particular, the size and arrangement of the particular cam embodiment as shown in FIGS. 1 to 3 can create an overall tool size that may be unacceptable to many users.

Correspondingly, FIGS. 6 to 11 illustrate a fastener driving device 150 that is implemented in a cordless manner in accordance with another embodiment of the present invention. Referring to these figures, and in particular, the assembly view of FIG. 7, the fastener driving device 150 includes housing 218, and a power source such as a removable battery 221. The fastener driving device 150 further includes a nose 219 that includes a drive channel which receives a fastener to be driven into the workpiece by the driver 210. The fastener driving device 150 of the illustrated embodiment is provided also with a magazine 220 that stores a plurality of fasteners therein, and feeds a fastener, one by one, into the drive channel.

As most clearly shown in FIGS. 6 to 8B, the fastener driving device 150 in the illustrated implementation includes a motor 205, a gear train 207, a clutch 206, a threaded shaft 201, a drive spring 203, a top seat 208, and a bumper 209. The threaded shaft 201 is retained at its ends with bearings in the housing 218, and is implemented as a lead screw in the embodiment shown. However, the threaded shaft 201 may be any rotary-to-linear motion converter such as a ball screw, an acme screw, and the like. At one end, the threaded shaft 201 is connected via the gear train 207 to the clutch 206 and the motor 205. A coupler mechanism 160 with a carrier 204 is also provided in the illustrated embodiment to allow compression of the drive spring 203 as described in further detail below.

Figure 7:
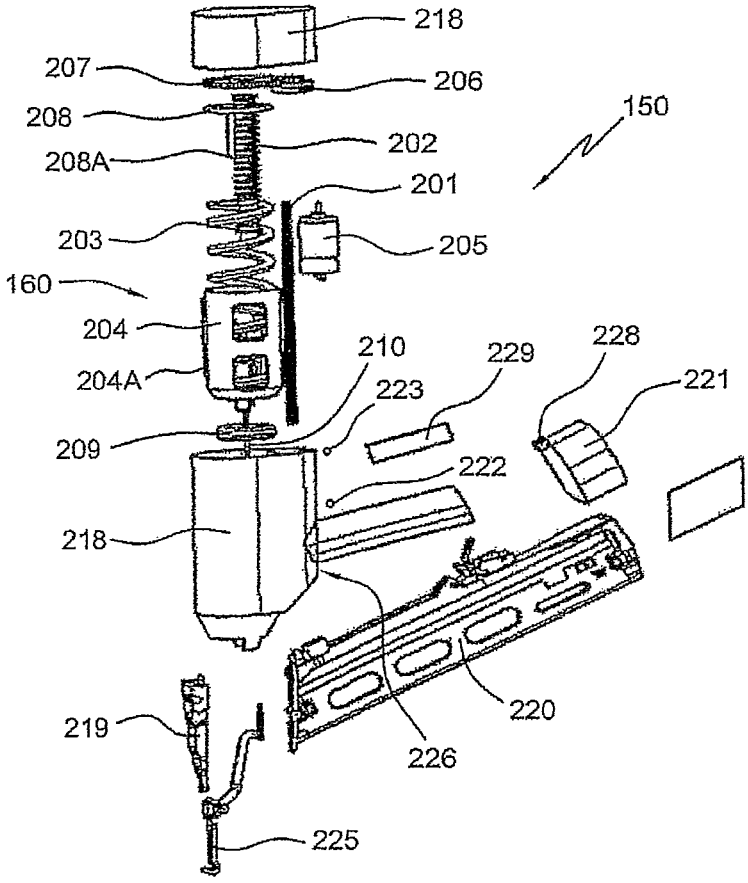
FIG. 7 is an exploded view of the fastener driving device of FIG. 6.
Figure 8B:
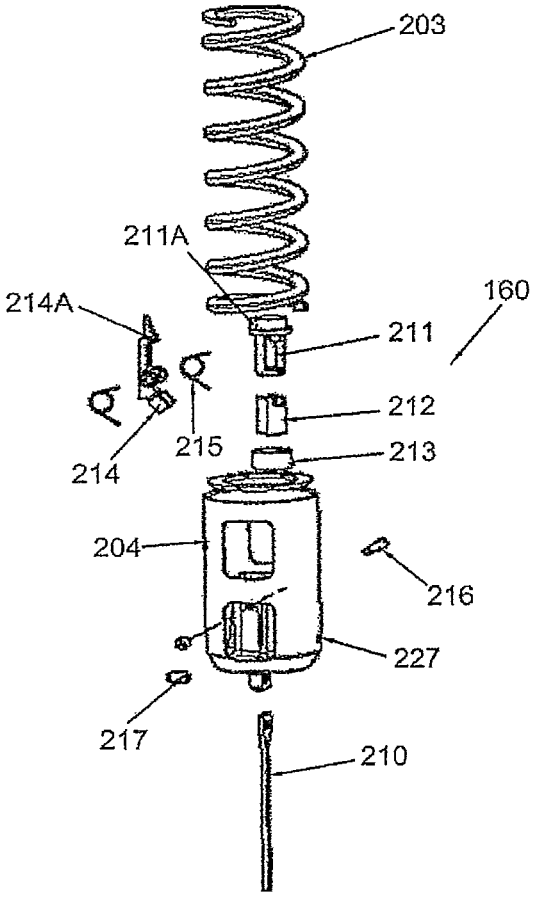
FIG. 8B is an exploded view of the coupler mechanism of FIG. 6.
Figure 8A:
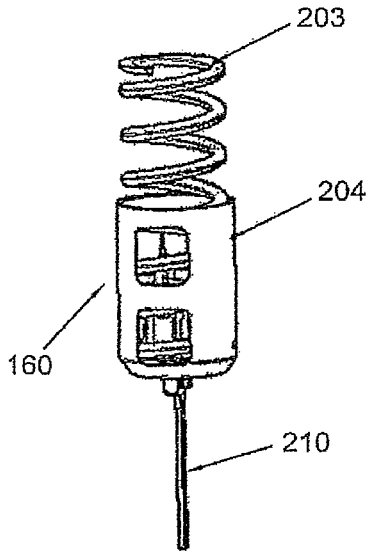
FIG. 8A is an assembled view of the coupler mechanism shown in FIG. 6.

As also shown in FIG. 7, position sensors 222, 223 and 224 may also be provided to indicate the position of the carrier 204. The position sensors 222, 223 and 224 are preferably non-contact sensors (for example, Hall Effect sensors) triggered with a magnet 227 in the carrier 204. Of course, the sensors can be any appropriate type of sensors, and could also be contact type sensors in other embodiments which are mechanically toggled by the motion of the carrier 204, optical sensors, or other sensors.

The gear train 207 may be implemented with spur, helical, bevel and/or planetary gears to optimize arrangements and the final gear ratio. The clutch 206 is similar in functionality to the clutch taught in U.S. Pat. No. 3,243,023. The important functionality of the clutch 206 is that the input shaft of the gear train 207 is free to drive the output shaft (which ultimately rotates the threaded shaft 201) in both directions, but when the input shaft is stationary, the output shaft is restrained from back driving the input shaft. Thus, the clutch 206 precludes back driving of the motor 205, and the drive spring 203 can be maintained in the compressed configuration. By allowing the drive spring 203 to be maintained compressed, the clutch 206 further allows clearing of any jams that may occur in the fastener driving device 150.

It should be noted that in the assembly view of FIG. 7, the threaded shaft 201 has been removed and shown separately. However, as can be seen by examination of the other figures such as FIGS. 6, 8, and 10, the threaded shaft 201 and various components of the coupler mechanism 160 are actually positioned in the drive spring 203. In this regard, the drive spring 203 is implemented as a coil spring, and includes a plurality of loops that encircle the longitudinal axis of the drive spring 203, the loops defining an interior of the spring. It should be noted that the terms "axis", "axial" and derivatives thereof, are used herein in the conventional sense, cylindrical components such as the described drive spring 203 being understood as having a central axis about which the component is centered. The positioning of the threaded shaft 201 and various components of the coupler mechanism 160 in the interior of the drive spring 230 keeps the overall size of the fastener driving device 150 small, and allows the fastener driving device 150 to substantially resemble traditional fastening tools in shape and form. In addition, this positioning of the threaded shaft 201 in the interior of the spring also advantageously aids in centering the compression load of the drive spring 203 during compression of the drive spring 203, thereby reducing overturning moments.

The fastener driving device 150 further includes a contact trip 225, and a trigger 226, which are used as inputs by the user for operating the fastener driving device 150, and a controller 229 that is adapted to electronically control the operation of the fastener driving device 150 in response to the inputs of the user. Of course, it can be appreciated that the controller 229 is merely schematically shown. In the preferred embodiment, the controller 229 may be implemented with an electronic processor, relays, and/or power MOSFETs and switches on a circuit board, the processor receiving electrical signals from the contract trip 225, a trigger 226, position sensors 222, 223 and 24, and optionally, the mode switch 228, to appropriately control the operation of the fastener driving device 150, including the compression and release of the drive spring 203. In this regard, the mode switch 228 allows the user to select the manner in which the fastener driving device 150 is to be used, for instance, in a sequential mode, bump fire mode, and for installation or release of the battery 221, these modes being also explained in further detail below.

Referring to FIGS. 6 to 11, the driver 210 is connected to the carrier 204 by a pin 217, the driver 210 moving linearly in the nose 219 in a drive channel as previously noted. The coupler mechanism 160 is implemented so that the carrier 204 can be displaced through a return stroke to compress the drive spring 203, and to quickly release the carrier 204 so that the drive spring 203 rapidly expands to move the carrier 204 and the driver 210 through a drive stroke. In the above regard, the coupler mechanism 160 of the illustrated embodiment is provided with a nut 212 that threadingly engages the threaded shaft 201, and moves along the length of the threaded shaft 201. As explained, various components coupler mechanism 160 are operable to engage (i.e. couple) the carrier 204 to the nut 212 so as to allow compression of the drive spring 203, and to disengage (i.e. decouple) the carrier 204 from the nut 212 to allow the driver 210 to drive a fastener into a workpiece.

In particular, in the illustrated implementation, the coupler mechanism 160 is implemented with a latch 214 that serves as a movable element that engages the carrier 204 to the nut 212 so that the carrier 204 and the driver 210 are lifted through the return stroke when the threaded shaft 201 is rotated in a return direction. As used herein, the "return direction" refers to the direction in which the threaded shaft 201 must be rotated in order for the nut 212 move on the threaded shaft 201 so as to move the carrier 204 through the return stroke in which the drive spring 203 is compressed. Of course, the actual rotation direction (such as clockwise or counter-clockwise) is dependent on the direction of the screw helix provided on the threaded shaft 201, and thus, can differ depending on the threaded shaft 201.

The carrier 204 houses the latch 214 as most clearly shown in the assembly view of FIG. 5B, the latch 214 being pivotably connected to the carrier 204 by a pivot pin 216. In the illustrated embodiment, the latch 214 is only allowed to rotate about the pivot pin 216, and all other degrees of freedom are restrained. The nut 212 that engages the threaded shaft 201 is keyed to the nut holder 211, and collar 213 is press fit over both the nut 212 and the nut holder 211, interlocking the two parts together into a nut assembly. This nut assembly follows the screw helix of the threaded shaft 201. The return spring 202 is coaxial with the threaded shaft 201 and nut 212, and biases the nut 212 toward the carrier 204 and the latch 214. As can be appreciated from examination of FIGS. 6 to 8B, the nut holder 211 has latching dogs or 211A that come into contact with the side of the latch 214 as the nut 212 rotates into the carrier 204, thereby stopping the downward rotation and displacement of the nut 212. The latch 214 is biased with spring(s) 215 towards the threaded shaft 201 so that it engages the nut holder 212 when the nut assembly is received in the carrier 204.

The frictional loads on the nut 212 and biasing force of the return spring 202 are such that nut 212 spins on the threaded shaft 201 toward the carrier 204 if the carrier 204 is not engaged to the nut holder 211, even when the threaded shaft 201 is rotated in an opposite direction, i.e. in the return direction that would otherwise cause the nut to move through a return stroke if the nut 212 did not spin. In other words, the fit of the nut 212 on the threaded shaft 201 is preferably implemented such that the nut 212 is free to back drive itself. That is, the nut 212 will spin and translate down the threaded shaft 201 according to the helix angle of the threaded shaft 201, i.e. in the direction of the drive stroke. Of course, gravity may contribute to the movement of the nut 212 down the threaded shaft 201 towards the carrier 204. However, gravity is not relied upon to move the nut 212. Instead, the return spring 202 is implemented to sufficiently bias the nut assembly toward the carrier 204 and the home position.

The carrier 204 acts as a down stop for the nut assembly. To raise the carrier 204 and compress the spring 215, the latch 214 is positioned such that the hook 214A of the latch 214 engages the edge of the nut holder 211. If the threaded shaft 201 is rotated in the return direction, and there is sufficient rotational friction on the nut 212 (such as when the nut holder 211 is engaged by the carrier 204), the nut 212 linearly translates upwardly along the threaded shaft 201 sufficiently to allow the hook 214A to engage the latch dog 211A of the nut holder 211, stopping its rotation. The rotational torque of the threaded shaft 201 on the nut 212 also acts to torque the carrier 204 through the latch 214. Thus, a guide 204A on the carrier 204 engages with corresponding guide slots 218A provided on the housing 218 to resist the applied torque and prevent rotation of the cater 204, in effect, limiting the movement of the carrier 204 to the drive stroke and return stroke directions.

As explained, when the nut 212 is precluded from rotating on the threaded shaft 201 and the threaded shaft 201 is rotated in the return direction, the nut 212 linearly translates upwardly along the screw axis of the threaded shaft 201. Since the latch hook 214A is positioned over the edge of the nut holder 211, the latch 214 engages with the nut 212 as it translates upwardly toward the gear train 207. The latch 214 is engaged with the carrier 204 so the carrier 204 also moves upwardly with the nut 212 in the return stroke. The lifting of the carrier 204 compresses the drive spring 203 to store the required energy therein to drive a fastener, and also compresses the return spring 202 that back drives the nut 212 and the nut holder 211 toward engagement with the carrier 204. The torque required to lift the carrier 204 and compress the springs 202 and 203 is a function of various parameters including the spring rates, threaded shaft 201, and nut 212 efficiency, and other mechanical and frictional losses.

Figure 9:
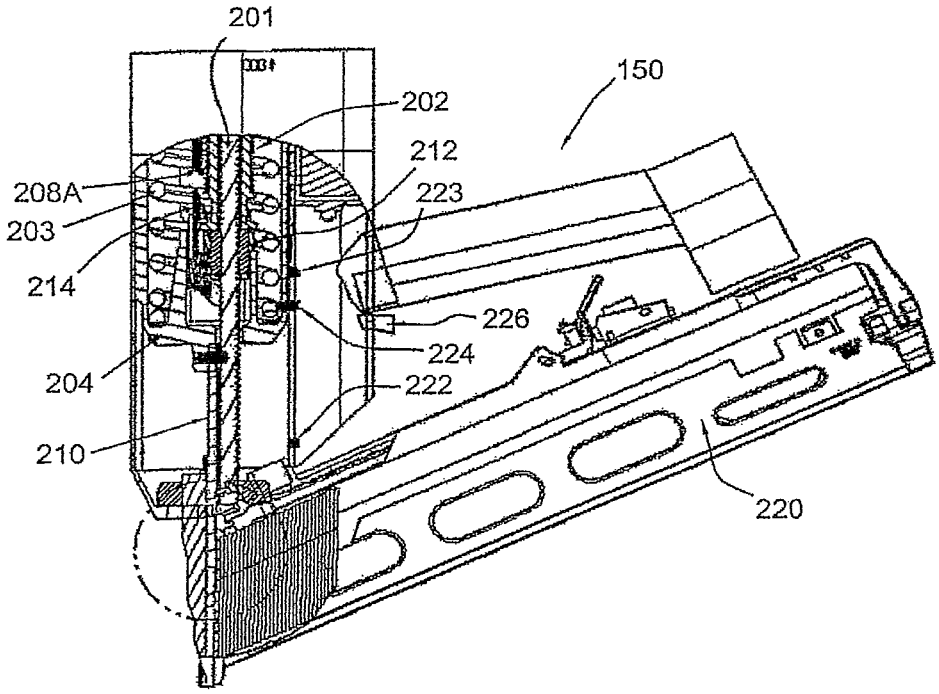
FIG. 9 is a partial cross-sectional view of the fastener driving device of FIG. 6 in the pre-compressed position in accordance with one implementation of the present invention.
Figure 11:
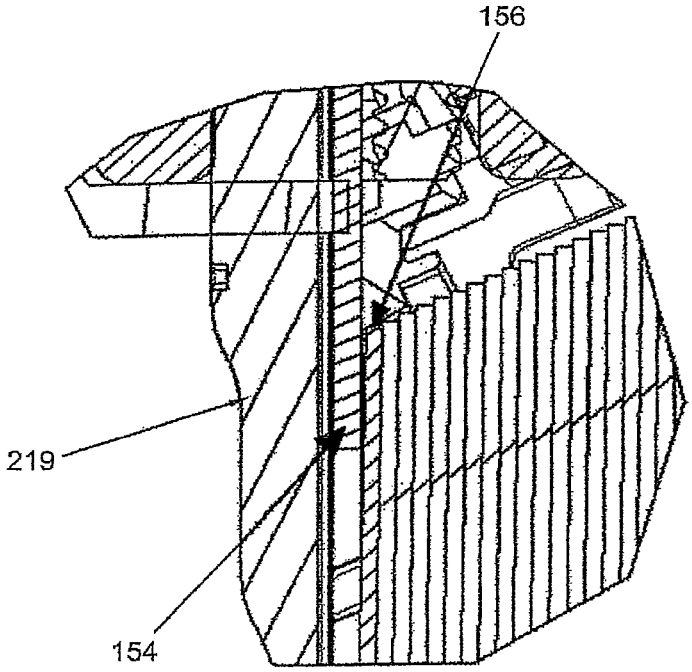
FIG. 11 is an enlarged cross sectional view of the driver tip and the fasteners when the fastener driving device is in the pre-compressed position shown in FIG. 9.

The controller 229 that controls the motor 205, and thus, controls the position of the carrier 204, operates the motor 205 so that the carrier 204 is lifted to a pre-compressed position shown in FIG. 9, this position being detected by the sensor 224. Thus, in this pre-compressed position, the spring 203 is partially compressed, for example, to at least 70% of compression required for a full drive stroke, or between about 70% and about 90% of compression required for a full drive stroke. Depending on the inputs received, the compression can be stopped at the pre-compressed position until further initiation of a subsequent drive sequence so that the compression of the spring 203 is continued, such further initiation including, for example, the user actuating the trigger and/or trip. In addition, at this position, depending on the inputs received, the motor 205 may be stopped so that the rotation of the threaded shaft 201 can also be stopped. The clutch 206 can then be engaged to preclude the force of the springs from back driving the threaded shaft 201 and returning the carrier 204 to the home position shown in FIG. 6. It should also be noted that as shown in FIG. 11, the fastener driving device 150 is preferably implemented so that driver 210 is not positioned above the head 156 of the fastener 154 in the pre-compressed position.

Further moving the carrier 204 in the return stroke direction by operation of the motor 205 causes the driver 210 to be sufficiently displaced so that the head 156 of the fastener 154 is received underneath the driver 210 so that it can be driven into a workpiece. Completion of the return stroke by the carrier 204 causes the latch 214 to contact a release ramp 208A of the top seat 208, which in the illustrated implementation, is mounted to the housing 218. This results in the latch hook 214A being pushed off the edge of the nut holder 211 as shown in the release position of FIG. 10. In the illustrated embodiment, this release position can be detected by the sensor 223. At this position, the carrier 204 is disengaged from the nut 212 and the stored energy in the drive spring 203 is freely released, thereby causing the carrier 204, and the driver 210, to rapidly move through the drive stroke toward the nose 219, and pushing the fastener into a workpiece. The drive spring 203 pushes the carrier 204 through the drive stroke until it engages with bumper 209. The bumper 209 absorbs at least part of the excess energy not used in driving a fastener.

Because the drive spring 203 stores substantial amount of energy, the carrier 204 is instantly displaced through the drive stroke, much faster than the nut 212 and the nut holder 211. Thus, the nut 212 and the nut holder 211 become separated from the carrier 204, and the nut 212 and the nut holder 211 which are threadingly engaged to the threaded shaft 201 are left behind. Simultaneously, once the nut holder 211 (and thus, the nut 212) is disengaged from the latch 214 (and thus, the carrier 204), the nut 212 is again free to rotate down the threaded shaft 201. The free rotation of the nut 212 allows the energy stored in the return spring 202 to back drive the nut 212 and the nut holder 211 toward the carrier 204 to the home position shown in FIG. 6 where the nut assembly is received in the carrier 204, and reengaged by the latch 214 for the next return stroke. In particular, near the home position, the nut 212 begins to push against the latch 214, overcoming the latch spring biasing force exerted by the springs 215. The latch 214 continues to be pivoted by the nut holder 211 until the edge of the nut holder 211 has traveled past the hook 214A of the latch 214. The spring bias of the latch 214 then positions the latch hook 214A to re-engage the carrier 204 and the nut holder 211 together so that the fastener driving device 150 is reset for the return stroke.

When the carrier 204 engages the bumper 209 after a drive stroke, large accelerations are imparted to the latch 214. It has been found to be preferable to have the center of gravity of the latch 214 located near, or at, its pivot point to preclude violent pivoting motion of the latch 214. Ideally it is preferred that the biasing force of the latch spring(s) 215 is sufficient so that the latch 214 is always biased towards engaging the nut holder 211 to thereby minimize the time required for the re-engagement of the carrier 204 to the nut 212. In addition, the clearance between the bottom of the latch hook 214A and the edge of the nut holder 211 when the nut 212 is stopped against the carrier 204 is important in order to correctly account for the relative motions of the parts after a drive stroke.

It should be noted that the threaded shaft 201 of the illustrated implementation would likely still be rotating to lift the nut 212 at the release position when the carrier 204 is released for the drive stroke. Thus, in such an implementation, the nut 212 has to spin in the opposite direction, and rotate at a much faster rate of speed than the threaded shaft 201, in order to back drive toward the carrier 204. In this regard, using a high pitch threaded shaft 201 and nut 212 allows the nut 212 to be moved easily along the axis of the threaded shaft 201 by applying a force parallel to the axis of the threaded shaft 201, for example, via the return spring 202. Thus, when such a force is applied, the nut 212 self rotates due to the high slope of the threaded shaft 201. The high rise/run ratio greatly reduces friction along, the axis of the threaded shaft 201, thereby facilitating self rotation of the nut 212. Correspondingly, by applying an axial force on the nut 212 via the return spring 202, the nut 212 can be moved toward the carrier virtually independent of the threaded shaft 201 rotation.

In the above regard, threaded shaft 201 of the illustrated embodiment may be implemented with a multiple start, hi-helix lead screw, for example, having a 7/16" diameter with a 1.0" lead. The multiple starts allow for higher load capacity with smaller diameter shafts. The hi-helix allows the nut 212 to be back driven very quickly as described. The threaded shaft 201 is preferably made from steel but can be formed from aluminum or other lightweight materials to reduce weight. The material combinations of the nut 212 and threaded shaft 201 can also be selected to achieve the best combination of efficiency, wear and load carrying capacity based on tool requirements, although use of a durable plastic nut has been found to be especially cost effective while providing adequate performance. Such threaded shafts and nuts are available from various manufacturers including Roton Products of Kirkwood, Mo., U.S.A. Of course, as previously noted, other rotary-to-linear motion converting mechanisms may be used instead in other embodiments.

The threaded shaft 201 and the coupler mechanism 160 implementation shown is advantageous with respect to the tool weight and mechanical arrangements, thus, allowing for a more desirable handheld tool. As mentioned above and most clearly shown in FIGS. 6, 9 and 10, positioning the threaded shaft 201 and various components of the coupler mechanism 160 inside the drive spring 203 keeps the overall size of the fastener driving device 150 small and aids in centering the compression load of the spring 230. Of course, the threaded shaft 201 can also be arranged outside the drive spring 203 in other embodiments, but arrangement and mechanical advantages can be attained by providing the mechanism inside the drive spring 203.

Figure 6:
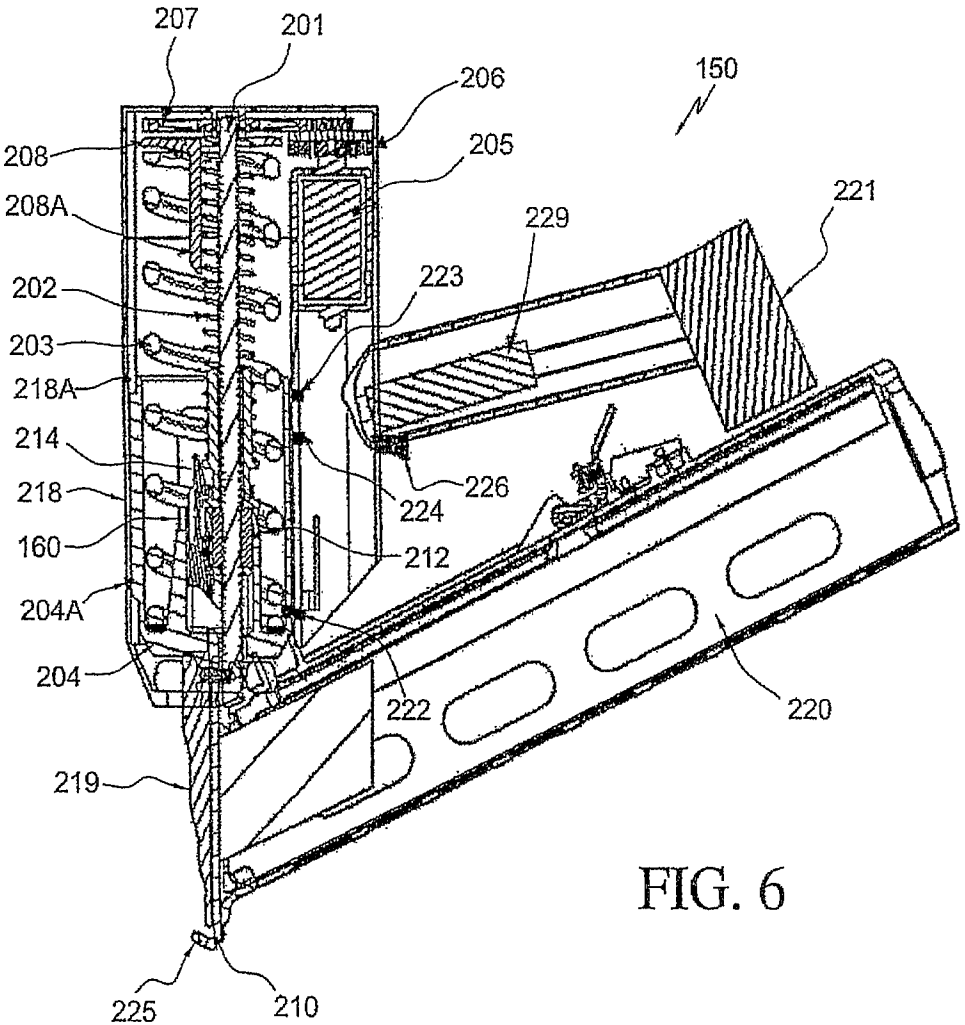
FIG. 6 is a cross-sectional view of a fastener driving device in accordance with another embodiment of the present invention, the fastener driving device being in the home position.

Unlike other fastener driving devices (chemical or mechanical flywheel type), the spring driven tool in accordance with the present invention always has stored energy in the drive mechanism by the virtue of the spring preload compression of the drive spring 203 when the fastener driving device 150 is in the home position shown in FIG. 6. Such spring preload is normally employed to improve spring life by reducing coil surge and resulting stress reversal, and to make the best functional use of the drive spring 203. This stored energy is mechanically restrained in the present invention by the providing a bumper 209 that restrains the movement of the carrier 204, and can do no work. It should be noted that "preload" as used herein differs from "pre-compression" in that preload refers to the amount of compression in the drive spring 203 when it is at its maximum expanded length within the fastener driving device 150. This is in contrast to pre-compression which refers to substantial compression of the drive spring 203 to store drive energy before the drive stroke. The advantage of providing a pre-compression position is more fully described herein below.

In particular, an important performance feature of a fastener driving device is being able to initiate the drive stroke very quickly in a sequential mode of operating the fastener driving device. The inputs a user has to control the nailing operation are through the contact trip 225 and the trigger 226. Typically, in the sequential mode, the contact trip 225 is placed on the workpiece at the location where the fastener is to be driven, and the user squeezes the trigger 226 to initiate driving of the fasteners. By providing the pre-compression position, such rapid initiation of the drive stroke can be attained by the fastener driving device 150. Furthermore, another challenge for fastener driving devices is in providing the capability to bump actuate the tool where users hold the trigger 226 on, and then depress the contact trip 225 on the workpiece to initiate a nail drive, which is referred to as "bump actuation" or bump fire. Bump actuation requires the mechanism of the tool to initiate the drive sequence in less than approximately 70 msec. as previously explained.

Pneumatic tools have no trouble meeting this requirement and have initiation times of around 20 or 30 msec. However, chemically actuated (combustion) tool designs such as that disclosed in U.S. Pat. No. 4,483,280, No. 6,886,730 and the like, have not yet practically proven the ability to inject fuel into the drive chamber, mix it with air, and ignite it in less than 70 msec. Mechanical flywheel type fastener driving devices can meet the 70 msec. threshold by maintaining a constant flywheel rotational speed (revolutions per minute). For example, U.S. patent application US20050218184(A1) maintains a constant flywheel speed. However, continuously driving the flywheel is inefficient and requires higher capacity batteries or lower number of cycles per battery charge in cordless implementations. The flywheel type fastener driving devices could also achieve a 70 msec. drive initiation time by employing a large enough motor and battery to achieve a maximum 70 msec. flywheel spin up time. Unfortunately, present technology and economy of motors and batteries do not support a commercially viable handheld, flywheel based, cordless fastener driving device design that can spin up the flywheel from rest to the required rpm in 70 msec. or less.

Thus, in order to meet this 70 msec. requirement with acceptable motor and battery sizes for a commercially viable cordless handheld fastener driving device, the fastener driving device 150 in accordance with the preferred embodiment is implemented to provide a pre-compressed position (i.e. pre-drive position) where the return stroke is nearly completed as described above, i.e. the drive spring 203 is pre-compressed to at least 70% of compression required for a full drive stroke. In an embodiment, the drive spring 203 may be pre-compressed to between about 70% and about 90% of compression required for a full drive stroke. FIG. 9 shows the drive spring 203 compressed to an 80% pre-compressed position, with the carrier 204 and driver 210 having been moved partially through a return stroke. This pre-compressed positioning of the carrier 204 is detected by sensor 224 shown in FIG. 6 that is positioned between sensor 222 corresponding to the home position after the drive stroke, and sensor 223 corresponding to the release position in which the carrier 204 is to be released for driving the fastener into a workpiece. Once the controller 229 receives the correct sequence of inputs to initiate a fastener drive event, torque from the motor 205 can be re-applied to the threaded shaft 201 and the carrier 204 can be moved to complete the return stroke to the release position shown in FIG. 10 in which the fastener can be driven. Such pre-compression of the drive spring 203 allows the fastener driving device 150 of the present invention to be bump actuated and also significantly reduces the activation time delay in the sequential mode since the drive spring 203 needs only to be compressed slightly more (remaining 20% more) to complete the return stroke of the carrier 204 before it is released through a drive stroke to drive the fastener.

As noted above with respect to FIG. 11, the fastener driving device 150 is preferably implemented so that driver 210 is not positioned above the head 156 of the fastener 154 in the pre-compressed position. In other words, the driver 210 does not engage fastener 154 when the fastener driving device 150 is in the pre-compressed position. The driver 210 becomes positioned above the head 156 of the fastener 154 (so that it can be driven into a workpiece) only after further lifting of the carrier 204 beyond the pre-compression position, for example, return stroke is completed and the carrier 204 is in the release position shown in FIG. 10. Thus, if there is a mechanical failure in the fastener driving device 150 which results in the drive spring 203 freely releasing its energy and moving the driver 210 when the carrier 204 is in the pre-compressed position, no fastener is driven by the fastener driving device 150. This greatly enhances the safety of the fastener driving device 150 and minimizes the likelihood of unintentional discharge of a fastener or injury to the user, while maintaining the capability to rapidly drive a fastener, for example, during bump fire actuation.

The threaded shaft 201, the nut 212 and the return spring 202 can be implemented to return the nut 212 toward the carrier 204 with sufficient speed that the latch 214 can potentially "catch" the carrier 204 if it bounces off the bumper 209 after completion of the drive stroke. Typical return times of 20 to 40 msec. have been attained for the nut 212 to return the home position along the threaded shaft 201 with the threaded shaft 201 being driven in the return direction. In other words, in certain implementations, the carrier 204 may rebound off of the bumper 209 after the drive stroke so as to slightly re-compress the drive spring 203. The coupler mechanism 160 can be implemented to re-engage the carrier 204 during this rebound. This re-captures a portion of the energy released by the drive spring 203 in driving the nail which was unused, thereby increasing overall efficiency of the fastener driving device 150. This energy recapture advantage is not possible with fastener driving devices that utilize compressed air, a flywheel or combustion for drive energy.

Of course, the above described embodiments and implementations of the coupler mechanism 160 for compressing the drive spring 203 is provided merely as an example. In this regard, the engagement and disengagement of the carrier 204 from the nut 212 is not limited to the embodiment shown, and other alternative implementations may be utilized. For instance, the above described embodiment of FIGS. 1 to 3 may be used which includes a different coupler mechanism than that described above relative to FIGS. 6 to 11. In this regard, various other alternative embodiments of the coupler mechanism including those that use pins or balls to engage the carrier to the nut are described in further detail below.

Furthermore, still other implementations of the fastener driving device, various mechanisms may be used for the threaded shaft. For example, a lead screw could be used for the threaded shaft, or a ball screw used for a threaded shaft, together with a nut. The practical efficiency of a ball screw is approximately 90% whereas the theoretical efficiency of a steel hi-lead screw and plastic nut combination is 69%. However, ball screws are much more costly compared with the lead screw and nut combination described, and also have practical lead limitation of approximately 0.5" lead for a 0.50" diameter screw, which would increase the return the time of the nut by more than twice the required time when the added mass of the nut is considered. Correspondingly, lead screws have been found to be preferred for use as the threaded shaft. Of course, still other implementations of the fastener driving device may use other mechanisms, such as cables, to move the driver through the return stroke.

In addition to the packaging advantages that is realized by using a threaded shaft 201 that is positioned within the drive spring 203, other advantages can be realized for the fastener driving device 150 by the virtue of using the threaded shaft 201 itself. In particular, because the threaded shaft 201 is made of metal such as steel, it is rigid and strong. Correspondingly, the threaded shaft 201 itself can be used as the primary structural element of the fastener driving device 150, and be used to resist the load of the drive spring 203 under compression as well as to withstand the impact forces after completion of the drive stroke. The threaded shaft 201 can serve as the structural element on which the housing 218 of the fastener driving device 150 is supported. The threaded shaft 201 can be mounted with thrust and journal bearings at both ends, and may further be preloaded in other embodiments, for example, using springs. In the described implementation where the threaded shaft 201 functions as the primary load bearing member, the housing 218 need not be structurally robust to carry all of the force of the drive spring 203 and impact loads, but may be implemented as substantially a floating shell that carries only a small portion of the impact loads. This implementation further allows enhanced attenuation of the impact loads as well by serving as a shock absorbing mount for various components including the motor 204, the gear train 207, the controller 229, and the battery 221.

As can also be seen in FIGS. 6 and 7, the fastener driving device 150 of the illustrated embodiment is implemented so that the motor 204 as well as the rest of the rotating components (gears and threaded shaft) are arranged to be parallel to the "drive axis" of the fastener driving device 150, i.e. the axial direction in which the carrier 204 and the driver 210 move through the drive stroke. In other words, in the present embodiment of the fastener driving device 150 in which a threaded shaft 201 is used, the motor 204 and the associated gear train and clutch components are mounted so the motor armature and the output shaft and all of the rotational axes are parallel to the threaded shaft 201 and the driver axis. This positioning of the motor 204 is especially advantageous in that adverse effects caused by the motor dimensions can be minimized. In particular, the fastener driving device 150 can be implemented with improved ergonomics, functionality and clearer line of sight, than otherwise possible with alternative motor mounting arrangements. Furthermore, all of the inertial forces of the motor armature and other rotating components are perpendicular to the driver axis, and thus, only minimally affect the quality of the nail drive.

Of course, in other less preferred embodiments, the motor may be mounted perpendicular to the driver and parallel to the handle. However, this may require the motor to be mounted in the handle which has been found to limit the size of the handle and/or motor. In addition, in such an arrangement, the center of gravity of the tool may be impacted if the motor is mounted below the handle, the center of gravity very close to the trigger being optimal. Moreover, if the motor is mounted perpendicular to the driver and the handle, the motor's armature inertial forces would be in the nail drive direction which influences the fastener driving tool's motion during recoil, and thus, negatively impact drive quality. Such an arrangement has also been found to increase the width of the fastener driving tool, thereby degrading the line of sight from behind the tool to the nail exit point.

The primary disadvantage of mounting the motor 205 of the fastener driving device 150 to be parallel to the drive axis in which the carrier 204 and the driver 210 move through the drive stroke is that the motor 205 and its components such as an armature may be subjected to the shock loads parallel to its axis. In this regard, in the preferred implementation of the present invention, the motor 205 is shock mounted as explained in detail below relative to the embodiment shown in FIG. 18. The shock mount may include a spring and an optional dampening element such as a compliant o-ring.

Of course, the above described embodiments of the fastener driving device 150 in accordance with the present invention are merely provided as illustrative examples. Additional features may also be provided in such embodiments. For example, LED lights or a laser that points to where the fastener will exit the nose may be provided to facilitate use of the fastener driving device. A belt book or other features may be provided to facilitate handling of the fastener driving device. In addition, a fastener jam release mechanism and/or a fastener penetration depth adjustment mechanism may also be provided.

Figure 10:
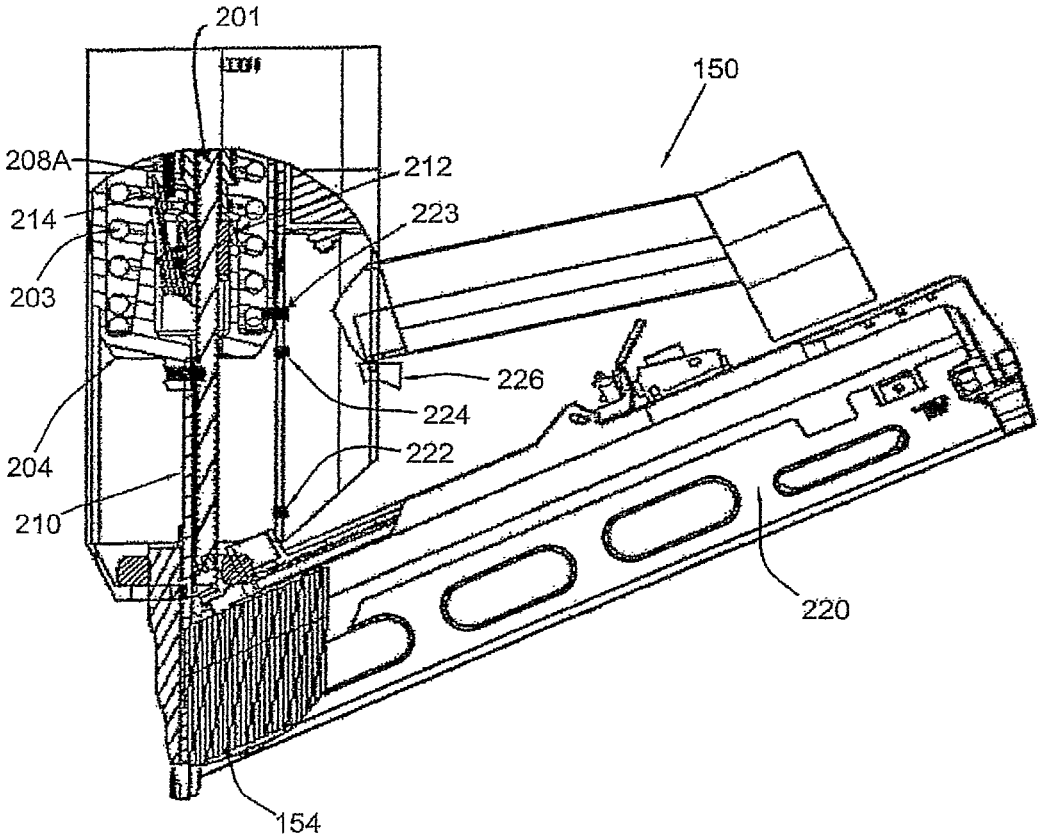
FIG. 10 is a partial cross-sectional view of the fastener driving device of FIG. 6 in the release position.

An exemplary function and operation of the cordless implementation of the fastener driving device 150 as shown and described above relative to FIGS. 6 to 10 is as follows:

1) User positions the 3 position (battery, sequential, bump) mode switch 228 to the battery setting.
2) User plugs the battery into the fastener driving device 150.
3) User switches the mode switch 228 to either sequential mode or bump mode.
4) The controller 229 checks the input from sensor 222 (home position sensor) and verifies that the carrier 204 is in the home position shown in FIG. 6.
5) Upon input from the trip 225 or trigger 226 (depending on the mode selection), the carrier is raised to the 80% pre-compressed position as shown in FIG. 9, and stopped upon detection of position by sensor 223, and mechanically held by a clutch 206.
6) Input from both the trip 225 and the trigger 226, initiates a drive sequence, and the carrier 204 is further raised to the release position shown in FIG. 10 that is detected by sensor 223 where the carrier 204 is disengaged from the coupler mechanism 160 and the drive spring 203 pushes the carrier 204 and the driver 210, which in turn, drives a fastener into the work piece.

7) The nut 212 and the nut holder 211 of the coupler mechanism 160 returns to the home position pushed by return spring 202, to re-engage with the carrier 204 as shown in FIG. 6.
8) The controller 229 verifies whether the carrier has made it back to the home position using the sensor 222 and if so, raises the carrier 204 back to the 80% pre-compressed position as sensed by sensor 224, and waits for further user inputs to initiate the next drive event.
9) If no drive event has been initiated within a preset time limit, the controller 229 reverses the motor 205 and lowers the carrier 204 to the home position as shown in FIG. 6.
10) When the battery 221 is discharged, the user moves the mode selector switch 228 to the battery position. In the described embodiment the mode switch 228 may be implemented so that when the mode switch 228 is manipulated, the controller 229 verifies the carrier 204 is at the home position. If the carrier 204 is not in the home position, the motor 205 is operated in a reverse mode to lower the carrier 204 to the home position, which ensures there is no stored energy capable of being released when the battery 221 is not engaged with the fastener driving device 150.

As previously noted, the controller 229 is preferably implemented with an electronic processor that receives electrical signals from the contract trip 225, trigger 226, position sensors 222, 223 and 224, and optionally, the mode switch 228, to control the operation of the fastener driving device 150, including in a sequential mode, bump fire mode, and battery release mode. The controller 229 is also preferably implemented with timers that measure the time duration of certain sequence of actions to occur, and places time limits on certain actions so that if one or more time limits are exceeded, a fault is triggered or other appropriate action is taken by the controller 229.

Figure 12:
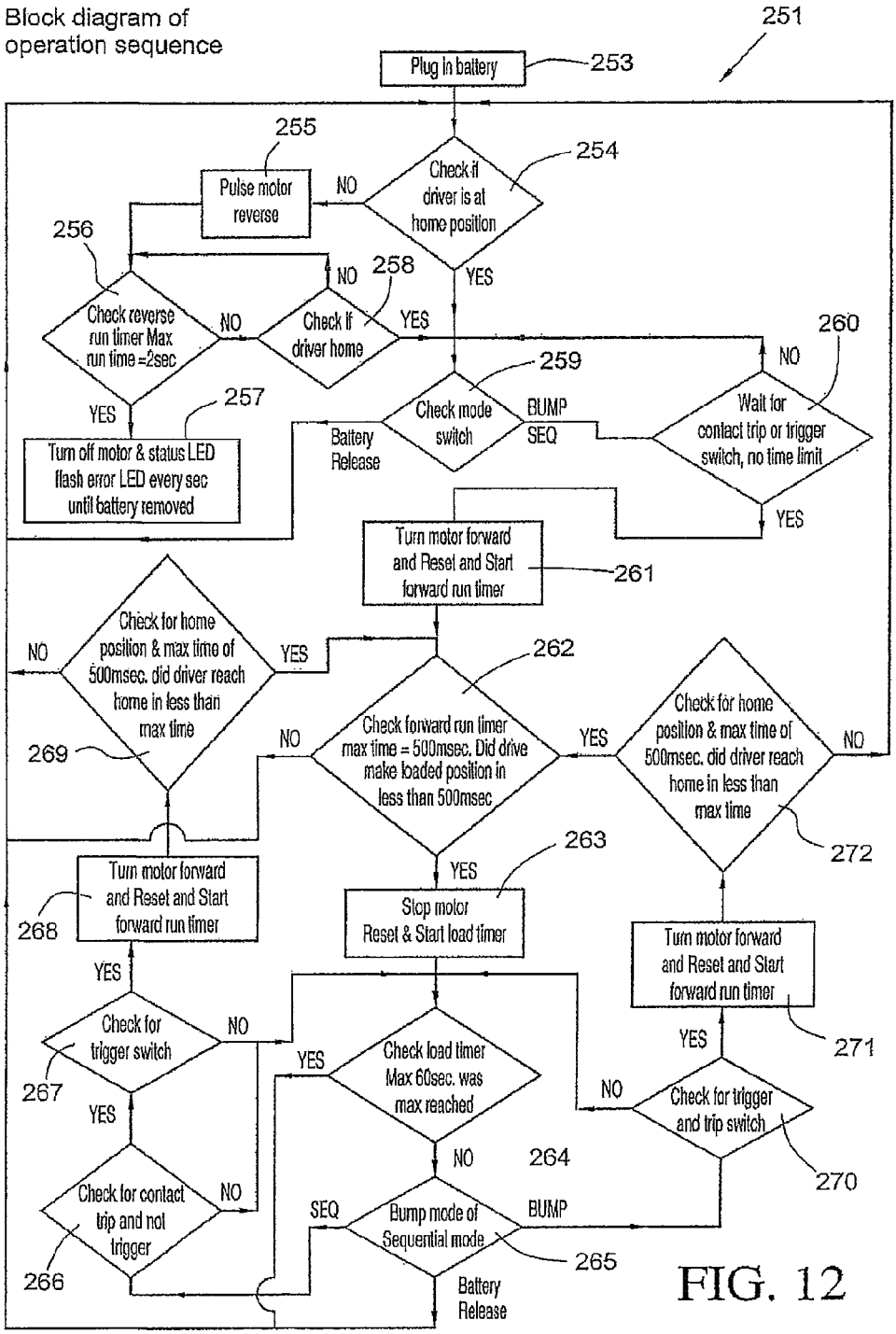
FIG. 12 is a schematic block diagram illustrating operational sequence of a controller in accordance with one embodiment for operating the cordless fastener driving device.

In the above regard, FIG. 12 is a flow diagram 251 showing the operational logic of the controller 229 in accordance with one embodiment that may be used to control the above described cordless implementation of the fastener driving device 150. Of course, it should be apparent that the operational logic described can be employed regardless of the specific implementation of the coupler mechanism. Furthermore, it should be noted that the operational logic shown in FIG. 12 is merely provided as one example, and the operational logic implemented in the controller 229 is not limited thereto. In this regard, the controller 229 may be implemented differently to utilize different operational logic in other embodiments of the present invention.

As can be seen in the flow diagram 251, the initial step of the operational logic includes confirming that a battery is connected in step 253 for powering the fastener driving device. The controller 229 then checks to see if the driver is at the home position in step 254. This is attained by checking to see if the carrier to which the driver is affixed is at the appropriate position using the sensor 222 as previously described. If the driver is not at the home position, the motor is pulsed in the reverse direction in step 255 (opposite to the return direction in which the drive spring is compressed) so that the driver returns to the home position. The controller 229 monitors the time duration of the pulsing of the motor in the reverse direction in step 256 to ensure that it does not exceed 2 seconds. If the driver does not return to the home position within two seconds of reversing the motor, the motor is turned off and an error LED is flashed in step 257 to indicate that there may be a jam that needs to be cleared, or other operation fault that needs to be addressed.

If the driver is determined to be at the home position within the 2 seconds at step 258, or the driver was initially determined to be at the home position in step 254, the controller 229 checks the position of the mode switch in step 259. If the mode switch is in the battery position, then the operational logic reverts back to checking the position of the driver in step 254 as shown. If the mode switch is determined to be in the bump or sequential operation positions, the controller 229 is implemented to wait for the contact trip or the trigger switch inputs in step 260. If no such inputs are received, the controller 229 reverts again to checking the mode switch in step 259 to determine if the mode switch has moved and an alternate mode has been selected.

If inputs from the contact trip or the trigger switch are received in step 260, the motor is turned into forward direction (return stroke direction) and time is monitored in step 261. In step 262, the controller 229 determines whether the driver has moved through its return stroke within the 500 millisecond time limitation, at least to the pre-compressed position. If this time limit was not satisfied, the operational logic reverts to check if the driver is at the home position in step 254 as shown. If the driver did not exceed the 500 millisecond limit, the motor is stopped, and a load timer is reset and again started in step 263.

The load timer is then monitored in step 264 to determine whether a maximum 60 second limit for the load timer is exceeded. If the 60 second limit is exceeded, the operational sequence is reset to determine if the driver is at the home position in step 254 as shown. If the maximum load timer limit of 60 seconds was not exceeded, the controller 229 determines whether the mode switch is in the battery release mode, sequential mode, or the bump mode in step 265. If the mode switch is in the battery release mode, the operational sequence is again reset to check if the driver is at the home position in step 254.

If the mode switch is in the sequential firing mode, the controller 229 monitors for input from the contract trip in step 266. If no input signal is provided by the contact trip, then the operational sequence is looped again to check the load timer in step 264. If input signal from the contact trip is determined to be present in step 266, then the controller 229 checks for input from the trigger switch in step 267. If no such input is detected, then the operational sequence is looped to check the load timer in step 264. If the input signal from the trigger switch is detected, then the motor is operated in the forward direction (direction of the return stroke), and the forward run timer is reset and started in step 268.

Then, the controller 229 checks to determine whether the driver is in the home position and whether it reached the home position in more than 500 milliseconds in step 269. If the maximum time of 500 milliseconds was exceeded, then the operational sequence is reset to check if the driver is at the home position in step 254. If the driver did reach the home position in less than the maximum 500 millisecond time, then the operational sequence is looped to check the forward run timer to determine whether the driver returned to the pre-compressed position in step 262.

If the mode switch was determined to be in the bump mode in step 265, the controller 229 monitors for input from the trigger and the trip switch in step 270. If these inputs are not provided, the operational sequence is looped to check whether the load timer reached the maximum 60 second limit in step 264. If the trigger and trip switch inputs are detected in step 270, the motor is turned forward, and the forward run timer is reset and started in step 271. In addition, the time duration for the driver to reach home position is monitored in step 272 to determine whether the driver reaches the home position by the 500 millisecond limit. If this time limitation is exceed, then the operational sequence is reset to check if the driver is at the home position in step 254. If the time limitation is satisfied, then the controller 229 monitors the forward run timer to determine whether the driver completes the return stroke by 500 milliseconds in step 262. Again, the above described operational sequence is merely provided as one example, and the present invention is not limited thereto. The controller 229 may be implemented differently to utilize different operational logic in other embodiments.

Figure 14:
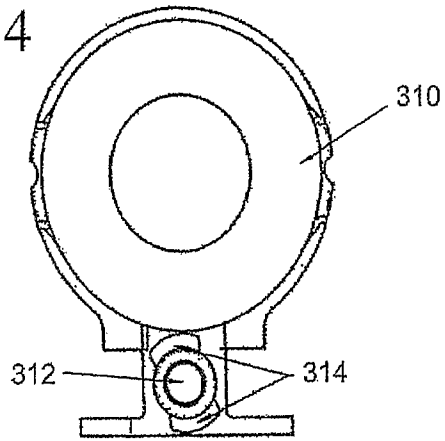
FIG. 14 is a schematic top end view of the coupler mechanism shown in FIG. 13.
Figure 13:
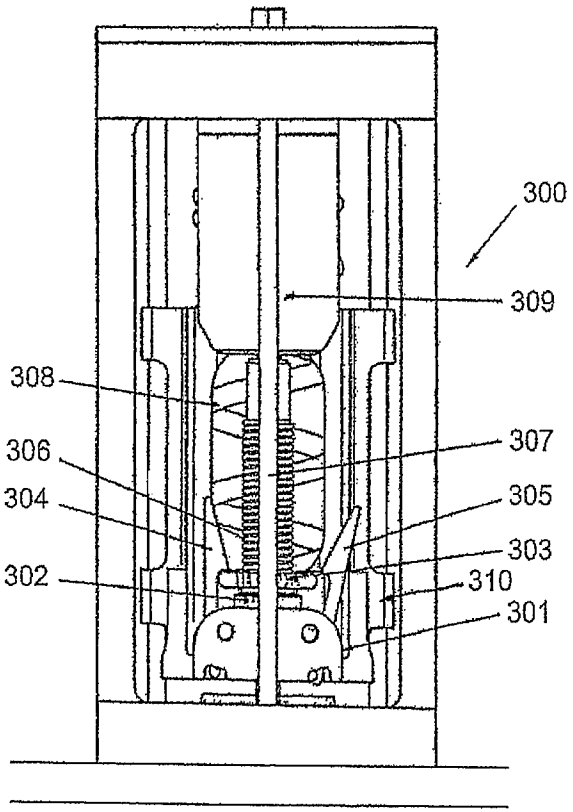
FIG. 13 is an assembly view of a coupler mechanism in accordance with another embodiment of the present invention.

FIG. 13 illustrates an assembled view of a coupler mechanism 300 in accordance with another implementation. The illustrated embodiment includes a drive spring lifter 301, a nut 302, a latch block 303, and a pair of latches that engage the latch block 303, the latch 304 being shown in a closed position, and the latch 305 being shown in an open position. In addition, a return spring 306 is provided for returning the nut 302 to the home position as previously described. The illustrated embodiment further includes a threaded shaft 307 (schematically shown), a drive spring 308, and a latch release block 309. This embodiment primarily differs from the embodiment of the coupler mechanism shown in FIGS. 6 to 10 in that multiple latches are provided, and that the return spring and the threaded shaft are not nested within the drive spring 308. In addition, the re-engagement of the nut 302 is attained by the rotational positioning and axial translation of the nut 302 relative to a nut pocket 314 provided in the carrier 310 as shown in FIG. 14.

Figure 15:
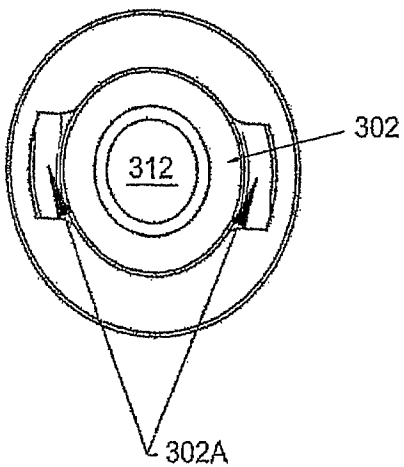
FIG. 15 is an enlarged view of the screw bore of the coupler mechanism of FIG. 13.

Thus, in the present embodiment of the coupler mechanism 300, the drive spring 308 is held in a carrier 310 that is movable along the axis of the drive spring 308, the threaded shaft 307 and nut 302 being arranged parallel to the axis of the drive spring 308. The threaded shaft 307 passes through a screw bore 312 in the carrier 310 as shown in FIG. 14. A radial nut pocket 314 is arranged around the threaded shaft bore 312 to stop the rotation of the nut 302. In this regard, the nut 302 is provided with radially positioned lugs 302A that mate with the nut pocket 314 as shown in FIG. 15. The latches 304, 305 engage the latch block 303 at the home position thereby engaging the carrier 310 to the nut 302. Correspondingly, when the threaded shaft 307 is rotated in a return direction, the carrier 310 is moved through a return stoke as the nut 302 is moved up the threaded shaft 307, thereby compressing the drive spring 308.

As shown in FIG. 13, a release block 309 is also provided. In operation, as the threaded shaft is turned, for example, by an motor, the carrier 310 is moved through the return stroke. Near completion of the return stroke, the latches 304, 305 contact the release block 309, thereby causing the latches to open. The carrier 310 becomes disengaged from the latch block 303, thereby allowing the carrier 310 to be moved through the drive stroke and drive a fastener using the released energy of the drive spring 308. The return spring 306 acts on the nut 302 and the latch block 303 so that they are back driven along the threaded shaft 307 back toward the carrier 310. The lugs 302A re-engage the nut pocket 314 so that the latches 304, 305 re-engage the latch block 303 again, thus, allowing the carrier 310 to be moved through the return stroke again upon rotation of the threaded shaft 307.

Figure 16:
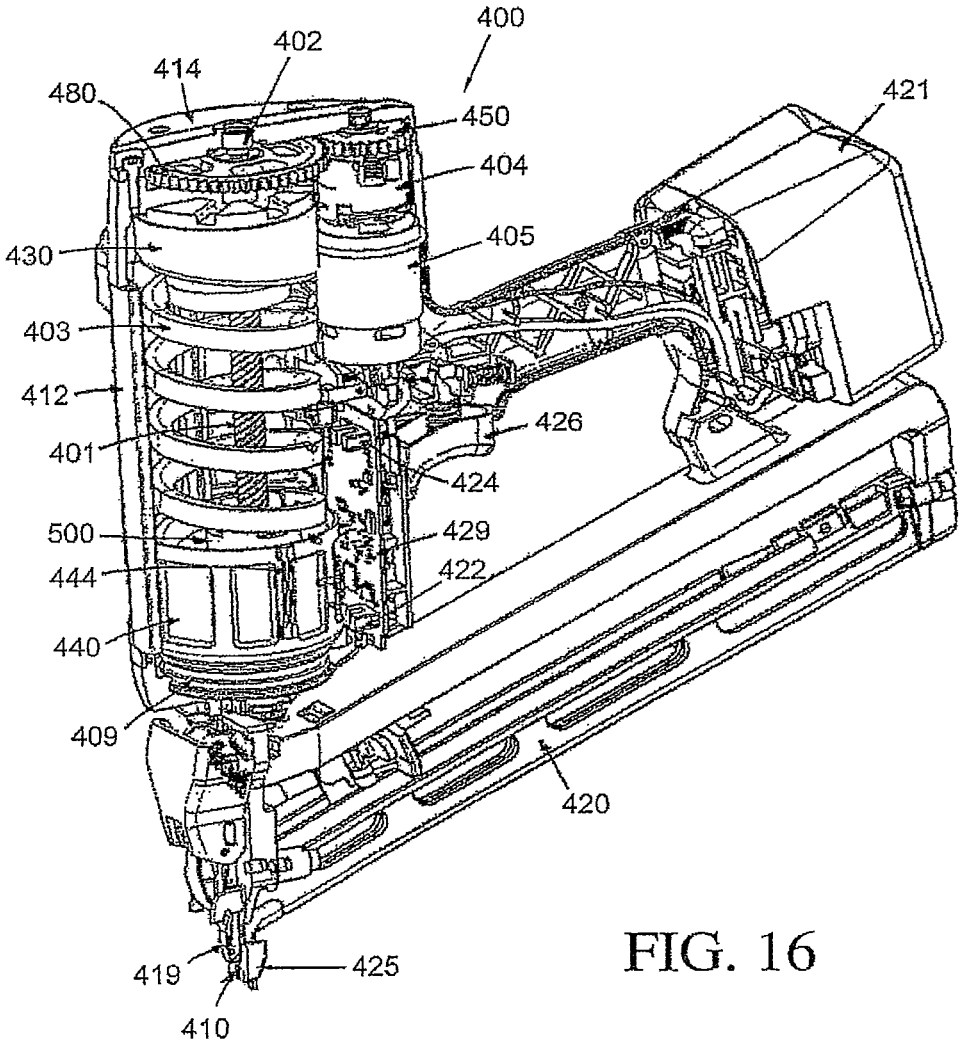
FIG. 16 is a perspective view of a fastener driving device in a home position with a portion of the housing removed in accordance with still another embodiment of the present invention.

FIG. 16 illustrates a partial cutaway view of a fastener driving device 400 that is implemented in a cordless manner in accordance with still another embodiment of the present invention. The fastener driving device 400 is implemented in a manner similar to the previously described embodiment of FIGS. 6 to 11. In this regard, the fastener driving device 400 includes housing 412 with an end cap 414 (that may be implemented as one or more pieces), and a power source such as a removable battery 421. The fastener driving device 400 further includes a nose 419 that includes a drive channel which receives a fastener to be driven into the workpiece by the driver 410. The fastener driving device 400 also includes a magazine 420 that stores, and feeds, fasteners to be driven into the drive channel. The fastener driving device 400 further includes a gear train 404, a motor 405, a clutch 406, a threaded shaft 401, a drive spring 403, and a bumper 409. In the illustrated embodiment, the motor 405 is a reversible motor that can be operated so that the output shaft of the motor can be rotated in opposite directions. The threaded shaft 401 is retained at its ends by bearings 402 (only one shown) in the housing 412. At one end, the threaded shaft 401 is connected via the gear train 404 to the clutch 406 and the motor 405. The threaded shaft 401 may be implemented as a lead screw, a ball screw, an acme screw, or other rotary-to-linear motion converting devices. In this regard, in the illustrated preferred implementation, a lead screw is used for the various advantages previously noted.

The fastener driving device 400 is also provided with a coupler mechanism 440 including a carrier 442 that can be moved through a return stroke by the rotation of the threaded shaft 401 in order to compress the drive spring 403 to store energy therein. In addition, the coupler mechanism 440 further allows the carrier 442 to move through a drive stroke to release the energy stored in the compressed drive spring 403. The details and operation of the coupler mechanism 440 is described in further detail below.

The fastener driving device 400 is further provided with a controller 429, and position sensors 422 and 424 for sensing the position of the carrier 442. The controller 429 functions to receive input signals from the contact trip 495, the trigger 426, and the mode selector switch (not shown) to operate the fastener driving device 400 in the manner desired by the user. For clarity purposes, FIG. 16 does not illustrate a return spring that is provided to back drive the nut toward the carrier 442. The primary distinctions and enhancements of the fastener driving device 400 in comparison to the fastener driving device 150 of FIGS. 6 to 11 are discussed herein below.

Figure 17A:
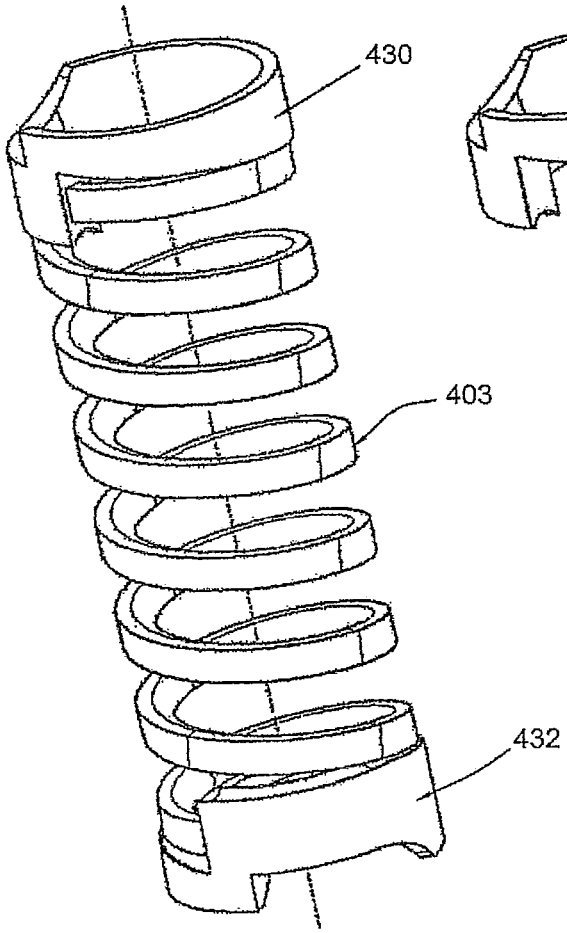
FIG. 17A is a perspective view of the drive spring and upper and lower spring seats in accordance with one example embodiment.
Figure 17B:
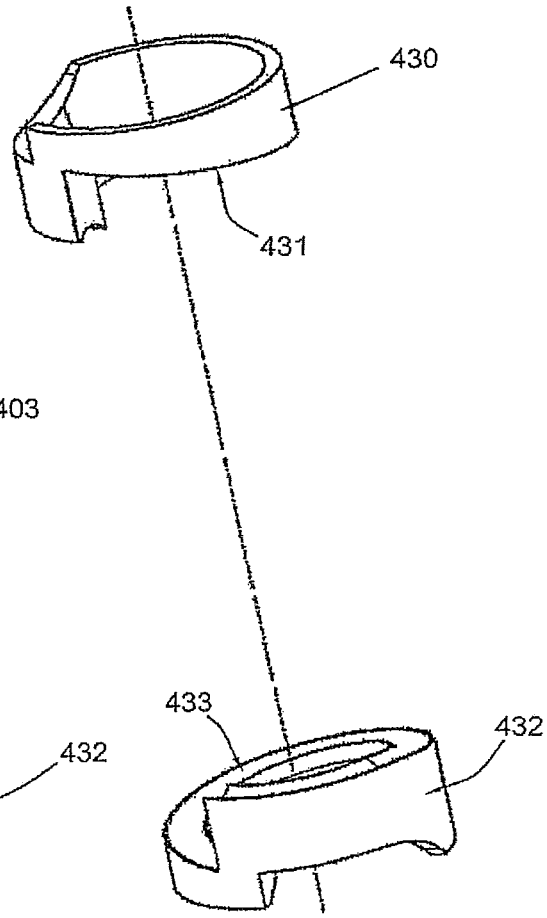
FIG. 17B is a perspective view of the upper and lower spring seats of FIG. 17A.

As shown in FIGS. 17A and 17B, the fastener driving device 400 utilizes an open ended drive spring 403, which in the preferred embodiment, is implemented as a carbon composite coil spring. Such open ended configuration of the drive spring 403 facilitates manufacturing of the drive spring 403. Of course, such open ends do not allow the drive spring 403 to be evenly supported on the ends, which has a detrimental effect of causing the spring's line of action under compression to be not co-linear with the spring axis. However, centering the compression forces about the axis of the drive spring is highly desirable since this allows all of the spring energy to be directed in the release direction.

Correspondingly, as shown in FIGS. 16 to 17B, upper spring seat 430 and lower spring seat 432 are used at the ends of the drive spring 403 to improve the distribution of the stress exerted on the ends of the drive spring 403 so that open ended coil spring may be used with improved durability. The spring seats effectively function to re-align the line of action of the open ended drive spring 403 to be in the release direction, i.e. co-linear with the spring's axis. In this regard, the upper spring seat 430 is provided with a ramped surface 431 that generally corresponds to the angled loop of the upper end of the drive spring 403. Likewise, the lower spring seat 432 is provided with a ramped surface 433 as most clearly shown in FIG. 17B, the ramped surface 433 generally corresponding to the angled loop of the lower end of the drive spring 403. The lower spring seat 432 is positioned within the carrier 442 in the present embodiment. In other implementations where such spring seats are not utilized, the ends of the drive spring 403 can also, or alternatively, be heat set after the drive spring 403 has been fabricated to thereby reduce the pitch at the end coils. The ends of the drive spring 403 may further be slightly ground to improve the line of action as compared to purely open ended springs.

The upper spring seat 430 and the lower spring seat 432 may be implemented using various materials. However, the upper and lower spring seats 430 and 432 are preferably implemented so that under compression, the seats match the load being applied thru the drive spring 403, and resiliently deform therewith along the line of action of the drive spring 403. Correspondingly, the elastic deformation characteristics of the spring seats are important. In this regard, Microcelluar Urethane (MCU) which is manufactured by, and available from, BASF of Florham Park, N.J., U.S.A., has been found to be a desirable material for manufacturing of the spring seats. MCU is lightweight, sufficiently stiff, durable and highly compressible, but does not exhibit excessive outward "bulge" when compressed. Of course, different materials may be utilized in other embodiments.

Referring again to FIG. 16, the bumper 409 is preferably implemented to not only limit the extent of displacement of the carrier 442 during the drive stroke, and to absorb some of the impact force exerted by the carrier 442, but is further implemented to functionally extend the reach of the driver to thereby compensate for recoil of the fastener driving device 400 when the driver 410 drives a fastener into a workpiece. Conventionally, tool recoil is compensated for by extending the driver tip so that it extends beyond the nose when the driver is at the end of the drive stroke. This allows the fastener to be fully driven into the workpiece, even as the fastener driving device itself moves away from the workpiece due to recoil. However, adding more driver extension by extending the driver tip is not a desirable solution since this increases the height of the fastener driving device.

Thus, the bumper 409 is implemented to be sufficiently compressible so that upon compression by the carrier 442, the driver 410 extends out of the nose 419, the amount of extension being based on the degree to which the bumper 409 is compressed by the carrier 442. Thus, described implementation of the bumper 409 provides a dynamic driver extension which does not impact the tool height. Whereas the bumper 409 may be made of any appropriate material including conventional rubber and urethane, such materials are limited in the amount of the compression they can provide while still being durable enough to provide adequate tool life. Correspondingly, the MCU material previously described for use in the spring seats can be also advantageously be used for the bumper 409. The MCU material can be dynamically compressed a large amount without effecting durability, and without causing other issues such as excessive bulging that other materials may exhibit.

Figure 18:
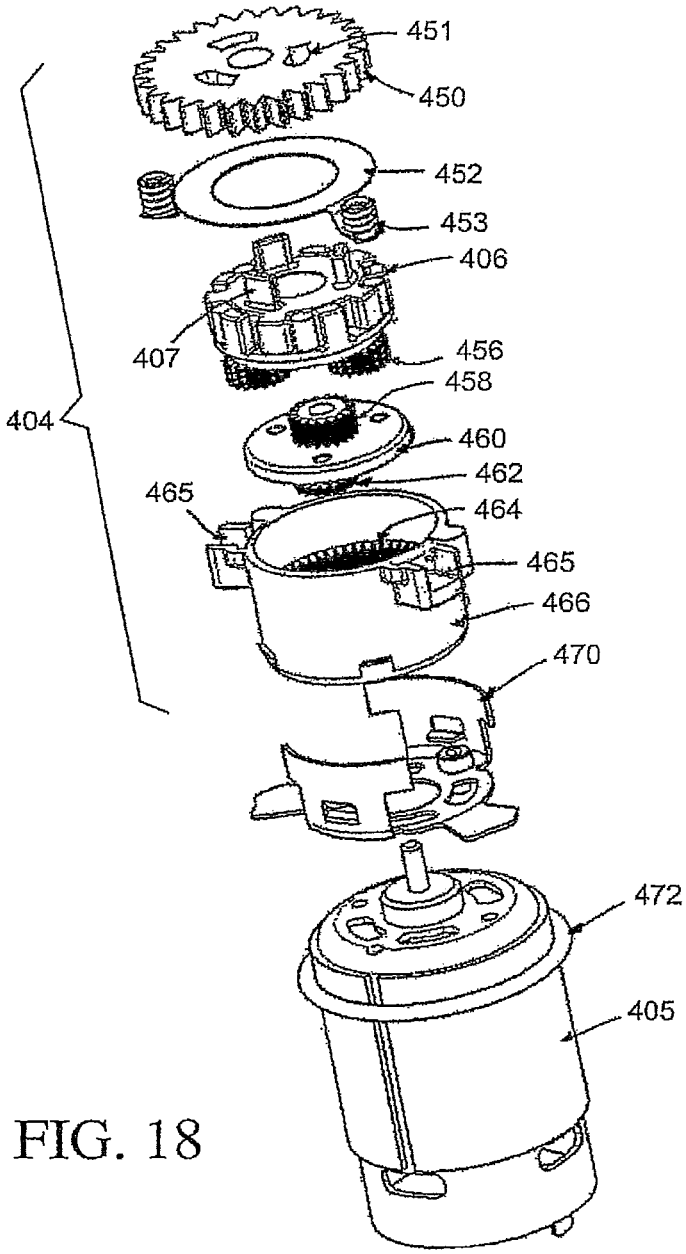
FIG. 18 is an exploded perspective view of the clutch, the gear train, the shock mount and the motor for the fastener driving device in accordance with still another embodiment of the present invention.
Figure 19:
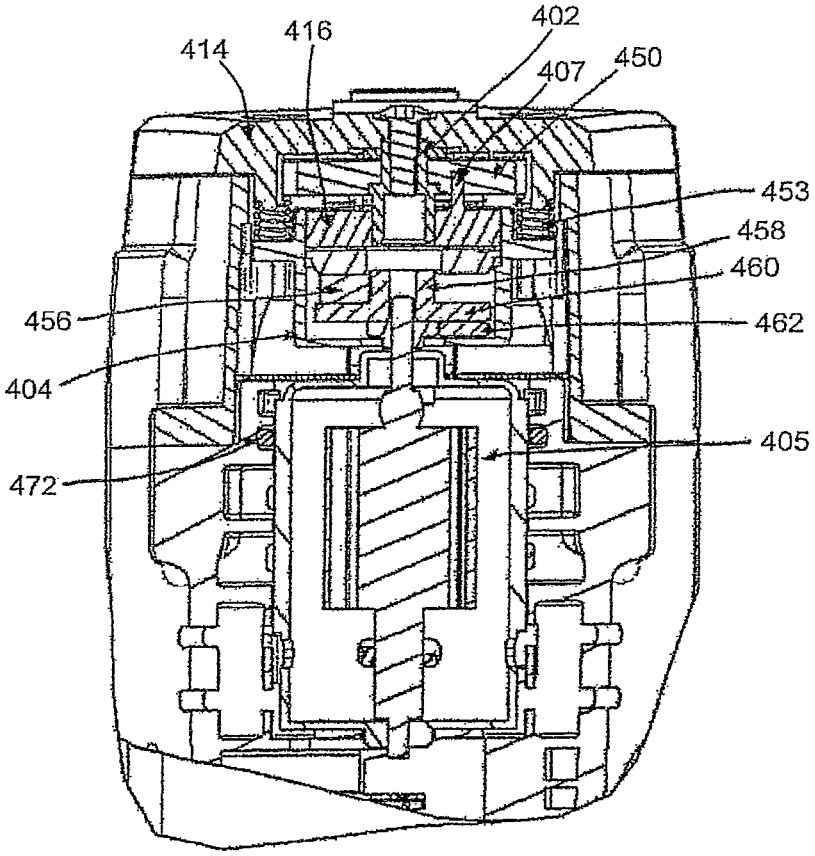
FIG. 19 is a cross sectional view of the components shown in FIG. 18 assembled and mounted in the fastener driving device.

FIGS. 18 and 19 respectively show an exploded assembly view, and an assembled cross sectional view, of the gear train 404 of the fastener driving device 400, including the clutch 406. The clutch 406 ensures that the gear train 404 is free to ultimately drive the threaded shaft 401 in both directions, but prevents unintentional back driving of the threaded shaft 401 and the motor 405 in response to the force exerted by the compressed drive spring 403, thereby enabling the pre-compressed position operation as described above that effectively allows rapid bump fire actuation, and clearance of jams in the fastener driving device 400.

The gear train 404 of the illustrated embodiment is implemented with three reduction stages. As shown in FIGS. 18 and 19, the gear train 404 in the illustrated implementation includes spur gears 450 and 480 which define a third reduction stage. The spur gear 450 engages the clutch 406 and the spur gear 480, spur gear 480 being attached to the threaded shaft 401. The ratio between the spur gear 450 and spur gear 480 provide the desired third gear reduction stage. In addition, these spur gears also facilitate placement of the threaded shaft 401 inside the drive spring 403 by mechanically spanning the distance between the motor 405 which is positioned outside the drive spring 403, and the threaded shaft 401 which is positioned inside the drive spring 403.

The gear train 404 includes retaining shim 452 with springs 453 that bias the clutch 406 (and the motor 405) in the direction away from the end cap 414 in the manner further described below. The gear train 404 further includes a first set of planetary gears 456 that engage a sun gear 458 mounted on a carrier 460, the first set of planetary gears 456 engaged with a ring gear 464 and the sun gear 458 defining the second reduction stage. The carrier 460 includes a second set of planetary gears 462 mounted opposite the sun gear 458, the second set of planetary gears 462 engaging the internal gear 464 provided on the interior of the housing 466. The second set of planetary gears 462 and the ring gear 464 define the first reduction stage. As can also be seen in FIGS. 18 and 19, springs 453 of the retaining shim 452 are received in pockets 465 of the housing 466.

As can be appreciated, the clutch 406 is disposed between the second and third gear reduction stages. Placing the clutch 406 in this position reduces the torque applied to the clutch 406 by the final gear reduction amount, thereby allowing a lighter and less expensive clutch 406 to be used. In addition, such positioning further reduces the backlash resulting from the first two gear reduction stages, thereby allowing more accurate control in the positioning of the carrier 442, such control being especially important for attaining the pre-compressed position. The clutch 406 and the first and second reduction stages are implemented together so as to prevent relative movement thereby enhancing shock suppression. The first and second reduction stages are mounted to the motor 405 by virtue of the housing 466 being mounted to the motor 405 by motor mount 470. Fixing the first and second gear reduction stages to the motor 405 eliminates any potential accelerated gear wear between the motor pinion and the various planetary gears.

Of course, during operation of the fastener driving tool 400, there are impact forces exerted in the fastener driving device 400, and corresponding shock is transmitted there through, especially in the axial direction parallel to the drive stroke direction of the carrier 442. These impact forces can cause undue stress on the motor 405, the clutch 406, and the gear train 404. Thus, in accordance with the illustrated implementation, the motor 405, the clutch 406, and most of the components of the gear train 404, are shock mounted in this axial direction so that these components are essentially decoupled and floating in the axial direction.

In particular, as can be appreciated by close examination of FIGS. 18 and 19, the clutch 406 includes bosses 407 (three being shown) that are received in slots 451 of the spur gear 450 to thereby engage the clutch 406 and the spur gear 450 together. Whereas the spur gear 450 and the clutch 406 are rotationally interconnected together, they can move relative to each other in the axial direction, i.e. along the aligned central axis of the spur gear and the clutch. Thus, an axially displaceable coupling is provided between the spur gear 450 and the clutch 406. In addition, the retaining shim 452 with springs 453 biases the clutch 406, most of the gear train 404, and the motor 405, away from the end cap 414. Correspondingly, the axially displaceable coupling is biased in the present implementation. In addition, a dampening member, such as o-ring 472 in the illustrated implementation, is also provided for dampening the motion of the motor 405. When shock caused by the impact forces is transmitted in the axial direction during operation of the fastener driving tool 400, the springs 453 compress in view of the inertial mass of the motor 405, the clutch 406, and various components of the gear train 404, thereby allowing these components to move, such motion being dampened by the o-ring 472, and helping to isolate these components so that potential for damage is reduced. Moreover, it should be noted that whereas the above shock mounting of the motor and clutch has been described relative to a fastener driving device, the present invention is not limited thereto, and may be applied to other power tools.

Figure 45:
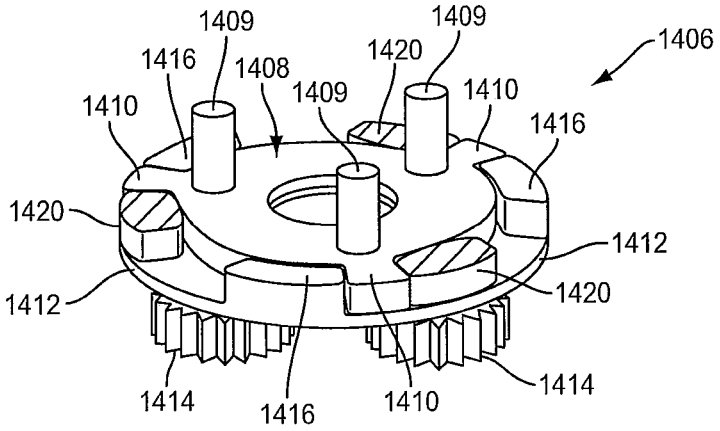
FIG. 45 is a perspective view of a clutch according to an embodiment of the present invention.
Figure 46A:
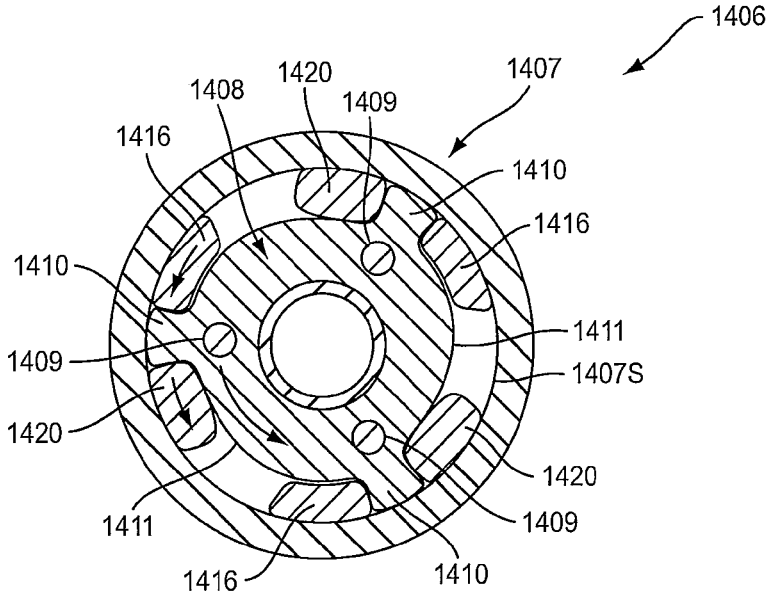
FIG. 46A is a cross sectional top view of the clutch of FIG. 45.
Figure 46B:
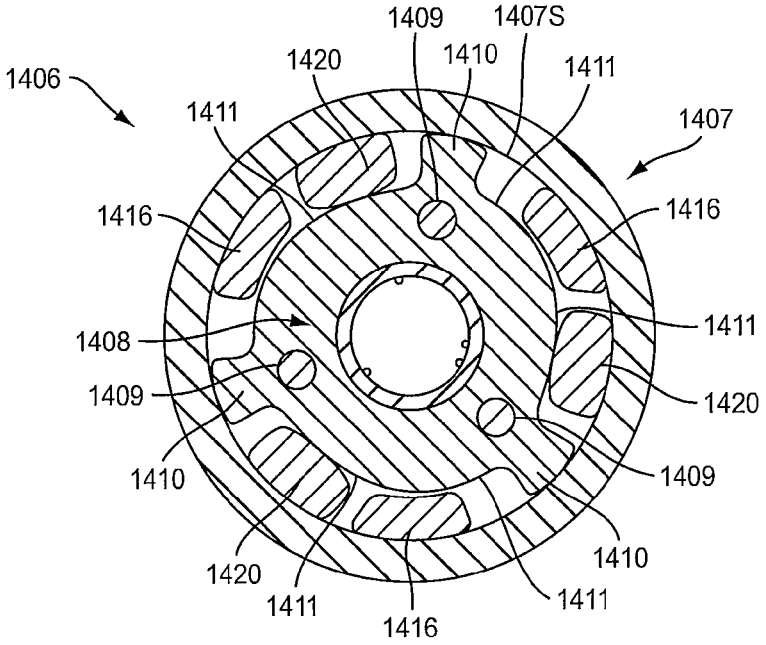
FIG. 46B is a cross sectional top view of the clutch of FIG. 45.

FIG. 45 is a perspective three dimensional view of a clutch 1406 according to an embodiment of the present invention. FIGS. 46A and 46B are cross-sectional views of the clutch showing the various parts of the clutch. The clutch 1406 is provided within a gear train 404 and positioned between gear 450 and carrier 460 (shown in FIG. 18), i.e., between the second and third gear reduction stages, in the same way as clutch 406 described above. The clutch 1406 is positioned within a housing 1407 (shown in FIGS. 46A and 46B) that is similar to the housing 466 that is shown in FIG. 18. As shown in FIGS. 45, 46A and 46B, the clutch 1406 includes an anvil member 1408 that has a plurality of projections or teeth 1410 (for example, three teeth). In an embodiment, the anvil member 1408 has a circular cross-sections and the teeth 1410 are azimuthally spaced apart, for example at equal angles, around a circumference of the anvil member 1408. The anvil member 1408 includes a plurality of bosses or coupling pins 1409 (for example, three bosses). The bosses or coupling pins 1409 are received in openings provided in the gear 450 (shown in FIG. 18) to thereby engage or couple the clutch 1406 and the gear 450 together. Similar to clutch 406, clutch 1406 is rotationally interconnected to the gear 450. However, the clutch 1406 and the gear 450 can move relative to each other in the axial direction, i.e., along the aligned central axis of the gear 450 and the clutch 1406.

The clutch 1406 further includes a drive planet carrier member 1412. The anvil member 1406 is rotatably mounted to the drive planet carrier member 1412. The drive arm planet carrier member 1412 includes a set of planetary gears 1414. In the embodiment depicted in FIG. 45 three planetary gears 1414 are provided (two planetary gears are shown and the third planetary gear is hidden in this view). Although, three planetary gears 1414 are provided, any number of planetary gears 1414 can be used. Similar to the embodiment depicted in FIG. 18, the planetary gears can engage a sun gear 458 mounted on the carrier 460 (shown in FIG. 18). The drive planet carrier member 1412 also includes a plurality of projections or drive arms 1416. In this embodiment, three drive arms 1416 are provided. However, any number of drive arms 1416 can be provided, as desired.

The clutch 1406 further includes a plurality of breaking pads 1420. Each of the plurality of breaking pads 1420 is disposed in a recess space between a tooth 1410 of the anvil member 1408 and a drive arm 1416 of drive planet carrier member 1412. The plurality of breaking pads 1420 are sandwiched between an internal surface of the housing 1407 and a cam surface 1411 of the anvil member 1408. In this embodiment, three breaking pads are provided. However, any suitable number of breaking pads 1420 can be provided. For example, the number of breaking pads 1420 can be equal to the number of drive arms 1416.

Figure 47A:
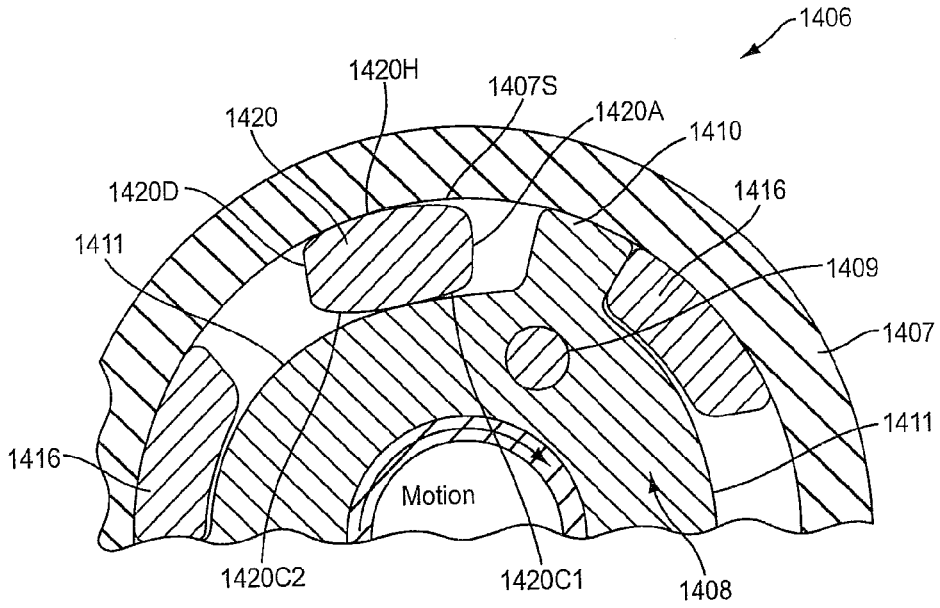
FIG. 47A is a cross sectional top view of the clutch of FIG. 45.
Figure 47B:
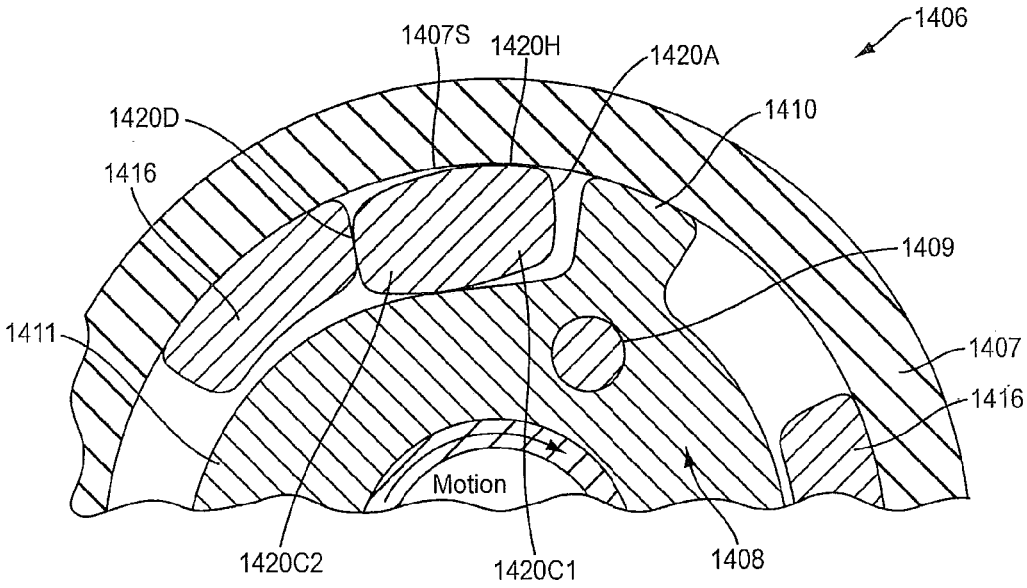
FIG. 47B is a cross sectional top view of the clutch of FIG. 45.
Figure 48:
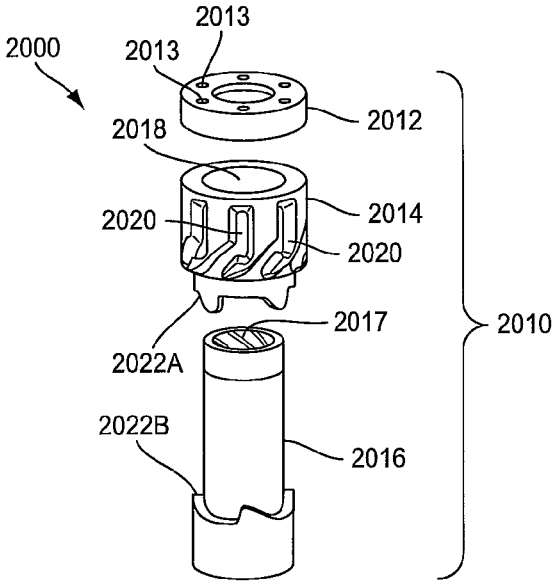
FIG. 48 is an exploded perspective view of a coupler mechanism according to an embodiment of the invention.

Each of the plurality of breaking pads 1420 has a plurality of lateral surfaces (which are normal to the cross-sectional views shown in FIGS. 46A and 46B). As shown more particularly in FIGS. 47A and 47B which depict enlarged cross-sectional views of a portion of the clutch 1406, each breaking pad 1420 has a lateral surface 1420H which faces and can come in contact with the internal surface 1407S of the housing 1407, a lateral surface 1420A which faces and can come in contact with a tooth 1410 of anvil member 1408, a lateral surface 1420D which faces and can come in contact with a drive arm 1416, and lateral surfaces 1420C1 and 1420C2 which face and can come in contact with the cam surface 1411 of anvil member 1408. Lateral surfaces 1420C1 and 1420C2 are angled relative to each other, as shown in FIGS. 47A and 47B. The surfaces 1420C1 and 1420C2 are designed to lock in cooperation with the cam surface 1411. Each of the plurality of the lateral surfaces 1420H, 1420A, 1420D, 1420C1 and 1420C2 are configured to react differently to different inputs.

In operation, when the clutch 1406 is transmitting torque in the forward direction, as depicted in FIG. 46A, the breaking pad 1420 is forced against the tooth 1410 of the anvil member 1408. The lateral surface 1420A facing the tooth 1410 of the anvil 1408 and the surface of the tooth 1410 on which the breaking pad abuts are angled to keep the lateral surface 1420D (which is opposite to the tooth 1410 of the anvil member 1408) biased radially outward such that the lateral surface 1420C2 is away from the cam surface 1411 of the anvil member 1408 (as shown in FIG. 47A). When the motor that drives the drive planet carrier member 1412 via the gears 1414 stops, the gear train is back driven by the stored energy and the anvil member 1408 reverses direction, but the lateral surface 1420C1 of the breaking pad 1420 remains in contact with the cam surface 1411 more radially inward, as shown in FIG. 47A. This lateral surface 1420C1 is then contacted by the cam surface 1411 of the anvil member 1408 and is designed to lock the anvil member 1408 due to the much greater normal force, as compared to the circumferential force, acting on the cam surface 1411 of the anvil member 1408.

When the motor reverses direction, the drive arm 1416 of the planet carrier member 1412 has to travel a distance before reaching or hitting the breaking pad 1420. The drive arm 1416 of the drive planet carrier 1412 pushes directly on the break pad 1420. The face of the drive arm 1416 in contact with the breaking pad 1420 is angled such that the drive arm 1416 forces the breaking pad 1420 to tilt in the opposite direction so that the surface 1420C2 comes in contact with the cam surface 1411 of the anvil member 1408, thereby unlocking it.

When the motor reverses direction, if the anvil member 1408 is back driven faster than the planet carrier member 1412 and contacts the break pad 1420, the interaction of the lateral surface 1420C2 with the cam surface 1411 of the anvil member 1408 is such that no binding will occur, as depicted in FIG. 47B. This causes the anvil member 1408 to drive the break pad 1420 forward and continue its rotation. As a result, chattering is substantially minimized or eliminated.

This configuration of the breaking pads 1420 described above can prevent the breaking pads from rotating out of plane and the multiple surfaces on the break pad 1420 allows the clutch 1406 to be optimized for locking in one direction only when compared to clutch designs that are similar to what is taught in U.S. Pat. No. 3,243,023. As a result issues relating to binding, slipping as well as potential bearing failure can be greatly reduced. The bearing area of the breaking pad 1420 on the housing 1407, between the surface of 1420H of the pad 1420 and the interior surface 1407S of the housing 1407, is greatly increased. Consequently, the material of the housing 1407 can be selected from a material with less durable characteristics as compared to the material of the anvil member 1408. This may provide cost savings as the housing 1407 is a large part of the whole drive system.

The use of breaking pads 1420 does not provide the rolling feature as in conventional rollers. As a result, there may be some friction between the lateral surface 1420H and the surface 1407S of the housing 1407 and some friction between the lateral surfaces 1420C1 and 1420C2 and the cam surface 1411. However, the impact of friction can be reduced or minimized by locating the clutch 1406 in the power train where the speed of the clutch 1406 is lower than the rotation speed of the motor. Also, a small amount of friction is desirable between the break pad 1420 and the housing 1407 to preclude the surface 1420A from moving with the tooth face of the anvil 1408 when the anvil 1408 is back driven.

Figure 20:
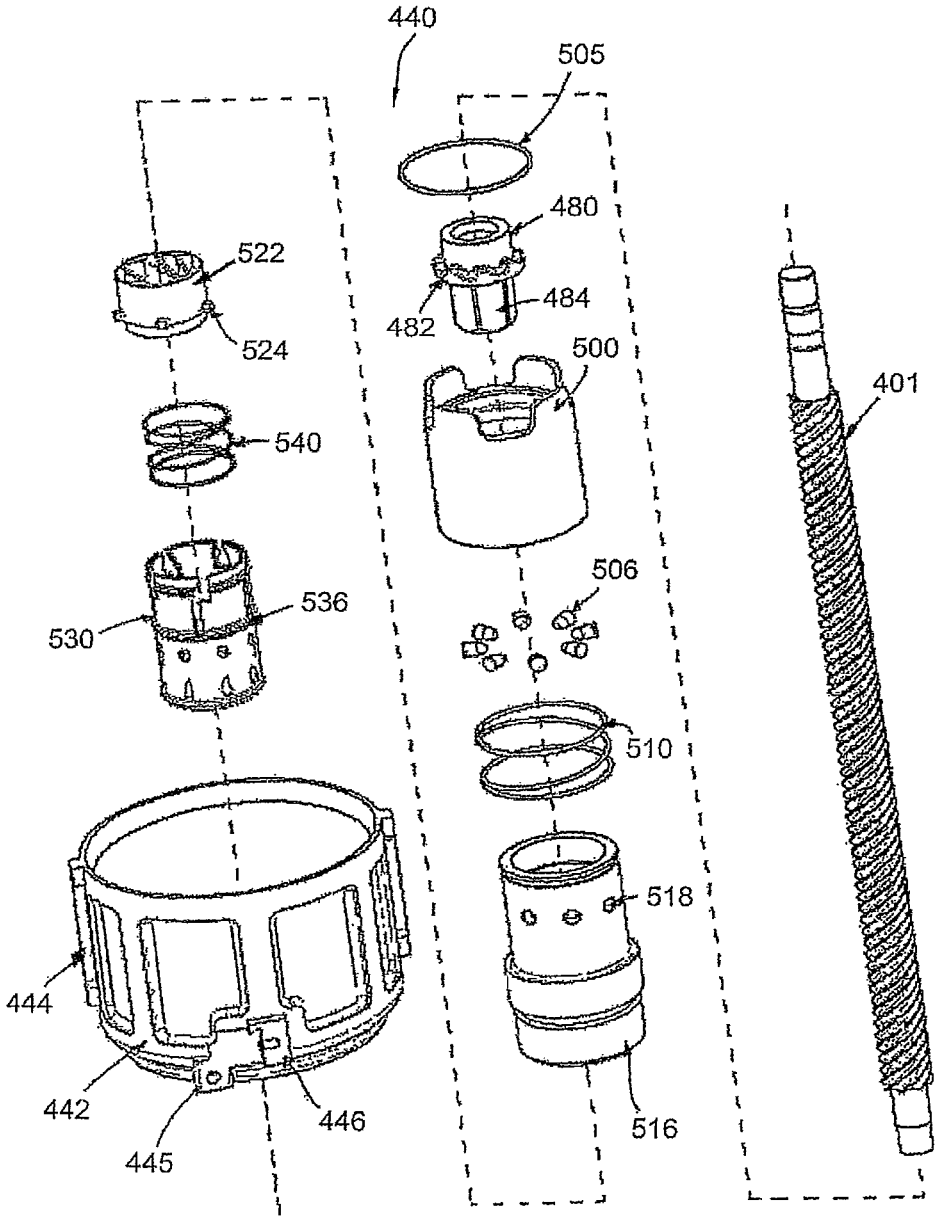
FIG. 20 is an exploded perspective view of a coupler mechanism and a threaded shaft in accordance with one embodiment that is used in the fastener driving device of FIG. 16.

FIG. 20 is an exploded assembly view of a coupler mechanism 440 in accordance with one example implementation that can be used to allow the carrier 442 to be moved along a return stroke and compress the drive spring 403 upon rotation of the threaded shaft 401 in a return direction. As described above relative to the prior embodiments, the compression of the drive spring 403 is attained by engaging the carrier 442 to the nut 480 which engages, and moves along, the threaded shaft 401. Again, the threaded shaft 401 and nut 480 are implemented so that the nut 480 can easily back drive down the threaded shaft 401 by biasing of a return spring (not shown).

The coupler mechanism 440 for engaging (i.e. coupling) and disengaging (i.e. decoupling) the carrier 442 to the nut 480 in the illustrated embodiment includes a release collar 500, a retaining ring 505, a collar spring 510, an element housing 516, a lockout sleeve 522, a drum cam 530, a lockout sleeve spring 540, and at least one movable element which in the present embodiment, is implemented as a plurality of pins 506. In essence, the coupler mechanism is implemented with the plurality of pins 506 which move radially inwardly to engage the nut 480, thereby connecting the carrier 442 to the nut 480 so that the carrier 442 can be moved through the return stroke upon rotation of the threaded shaft 401 in the return direction. Upon completion of the return stroke, the plurality of pins 506 are retracted radially outwardly in the release position to thereby disengage from the nut 480, and releasing the carrier 442 so that it is moved through the drive stroke. As can be appreciated from examination of FIG. 20 as well as FIG. 16, many components of the fastener driving device 400 including the coupler mechanism 440 have a cylindrical shape. Correspondingly, the terms "radially outwardly" and "radially inwardly" are used in the conventional sense, radially outwardly referring to the direction so as to increase the radius of the cylindrical shape, and radially inwardly referring to the opposite direction.

As shown, the carrier 442 of the illustrated embodiment is also provided with a guide 444 that slides within a guide channel (not shown) of the housing 418 to prevent rotation thereof as described relative to the previous embodiment. In addition, the carrier 442 is also provided with an attachment block 445 which can be used to attach a flag 447 (or other device) to allow the sensors 422 and 424 to detect positioning of the carrier 442. A safety block 446 may also be provided which can be engaged by optional safety interlock mechanism that may be connected to the contact trip 425 or the trigger 426 to prevent unintentional displacement of the carrier 442.

The various components of the coupler mechanism including the release collar 500, a collar spring 510, a element housing 516, a lockout sleeve 522, a drum cam 530, and a lockout sleeve spring 540 function together to enable the radial inward and radial outward movement of the plurality of pins 506 at various operational positions of the carrier 442 and the nut 480. The details and operations of these components are described in further detail below in reference to FIGS. 20 to 26B. It should again be noted, however, that the coupler mechanism described is merely provided as one example, and the present invention may be implemented differently in other embodiments.

Figure 21B:
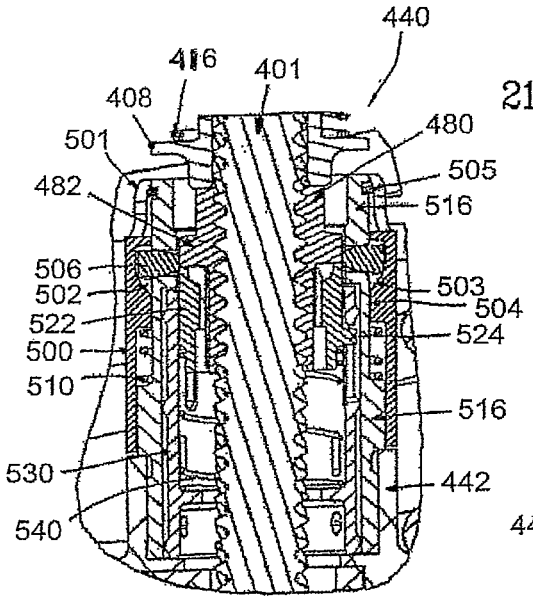
FIG. 21B is an enlarged cross sectional view of the coupler mechanism and threaded shaft of FIG. 21A.
Figure 21A:
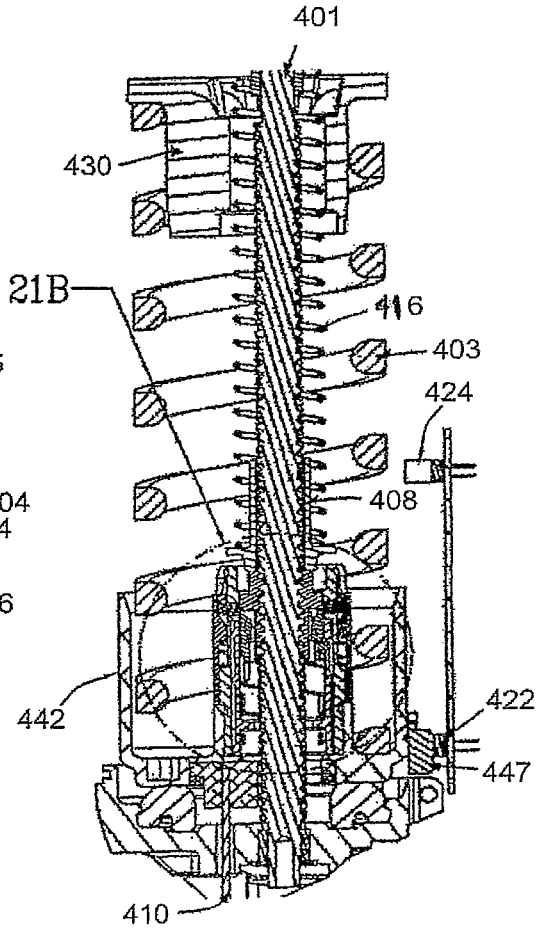
FIG. 21A is a cross sectional view of the coupler mechanism and threaded shaft of FIG. 20 after the drive stroke.

FIGS. 21A and 21B shows the coupler mechanism 440 with the carrier 442 at the home position, shortly after the completion of the drive stroke in which driver 410 drives a fastener into a workpiece using the energy released by the drive spring 403 as it expands and moves the carrier 442 to the position shown. As shown, the nut 480 engages the threaded shaft 401, and is movable thereon, the nut 480 being biased toward the carrier 442 by the return spring 416 that acts upon a spring sleeve 408 which abuts against the nut 480, the spring sleeve 408 being slidably received on the threaded shaft 401. In these figures, the nut 480 has been back driven toward the carrier 442 by the return spring 416 so that the nut 480 is shown immediately prior to being completely back driven. Thus, the carrier 442 is not yet engaged to the nut 480 in FIGS. 21A and 21B.

The release collar 500 is positioned within the carrier 449, and functions to move the plurality of pins 506 radially inwardly to its locked position and allows movement outwardly to its release position. The element housing 516 is coaxially nested in the release collar 500, and the plurality of pins 506 are slidably received in holes 518 of the element housing 516. In this regard, the pins 506 and the holes 518 are implemented and dimensioned so that the pins 506 naturally retract out of the holes 518 in a radially outward direction. In this regard, the pins 506 are pushed radially outwardly by a small force that acts in the radial direction so that the pins quickly retract when the release collar 500 is in the release position. In the embodiment shown, the pins 506 are provided with tapered ends, the angle of which is selected to ensure that the force to release the collar 500 is sufficiently low, but to prevent unintentional release of the collar 500. The pins 506 are also made to be light weight so that a small radial loading will cause the pins 506 to retract radially outwardly, and also to minimize the weight of the coupler mechanism 440 to thereby maximize the driver mass/tool mass ratio as previously explained. It is further noted that use of pins is preferred over an embodiment in which balls are used as explained herein below relative to FIGS. 28 and 29 in that it can be implemented to have a higher contact area, thereby allowing plastic to be used rather hardened steel, for example.

As shown most clearly in FIG. 21B, the release collar 500 is provided with pocket 502. When the release collar 500 is positioned so that the pocket 502 is axially aligned with the plurality of pins 506, the pins 506 move radially outward into the pocket 502 so that they do not protrude out of the holes 518 of the element housing 516 toward the nut 480, thereby allowing the nut 480 and the carrier 442 to move independent of each other. The pocket 502 of the release collar 500 is provided with a ramp surface 503 and a land 504. The release collar 500 is also biased axially away from the element housing 516 by the collar spring 510, the displacement of the release collar 500 being limited by the retaining ring 505 that, in the illustrated embodiment, is mounted to the element housing 516. Correspondingly, the release collar 500 by the action of the collar spring 510, acts to move the plurality of pins 506 radially inwardly toward the nut 480 so that when the nut 480 completes its movement into the carrier 442 (such as in the home position), the pins 506 are displaced radially inwardly to engage the nut 480 with the ends of the plurality of pins 506 abutting the land 504, the engagement allowing the carrier 442 to be moved through the return stroke.

The release collar 500 is further provided with axially extending flanges 501 that contact the upper spring seat 430 when the carrier 442 has been moved substantially through its return stroke so that the coupler mechanism 440 is in the release position. In the release position, the carrier 442 is disengaged from the nut 480, and is immediately moved through the drive stroke. This operational aspect of the coupler mechanism 440 is described in further detail below relative to FIGS. 24A to 26B.

As also shown in FIG. 21B, the lockout sleeve 522 is received in the drum cam 530, the lockout sleeve 522 being biased upwardly toward the return stroke direction by the lockout sleeve spring 540. The lockout sleeve 522 functions to prevent the plurality of pins 506 from moving radially inwardly to extend beyond the holes 518 of the element housing 516 when the nut 480 is disengaged from the carrier 442. This feature is important in order to ensure that the nut 480 can be received back in the carrier 442 for re-engagement in preparation for the return stroke. In particular, at the release position, the carrier 442 and the nut 480 are disengaged, and the drive spring 403 is instantly expanded to drive the carrier 442 through the drive stroke. The nut 480 which is disengaged from the carrier 442 but still threaded to the threaded shaft 401 must be back driven down to the carrier 442 by the return spring 416. Correspondingly, the plurality of pins 506 must remain retracted and radially outward so that the nut 480 can be received in the carrier 442 for re-engagement therewith, to thereby allow the carrier 442 to be moved through the return stroke.

The features of the nut 480, the lockout sleeve 522, and the drum cam 530, and the interconnection between these components, are more clearly shown in the various views of FIGS. 22A to 23B. In particular, referring to FIGS. 22A and 22B, the nut 480 includes threads 481 that engage the threaded shaft 401, and a shank 484 that is sized to be received within the lockout sleeve 522, the shank 484 having a hexagonal shape in the present embodiment. As shown in FIG. 22A, the nut 480 further includes a flange 482 with a ratchet surface 486 on which the plurality of pins 506 engage. As can be appreciated, with the pins 506 contacting the ratchet surface 486 of the flange 482, the nut 480 is prevented from rotating in one direction while pins 506 are maintained in the engaged position by the land 504 of the release collar 500, thus, allowing the carrier 442 and the driver 410 to be moved through the return stroke. However, the ratchet surface 486 is shaped to allow engaged pins 506 to slip past its surface, allowing the nut 480 to rotate (counter clockwise in the present embodiment), and not be driven into the carrier 442 when the threaded shaft 401 is rotated in a reverse direction (opposite the return direction), for instance, when the tool is operated in response to a timeout condition or other fault condition as described in further detail below relative to the controller 429. When the nut 480 is ratcheting along the ratchet surface 486, the lockout sleeve 522 and the drum cam 530 are also turning. If the nut 480 is not allowed to ratchet in the reverse direction while the pins 506 are engaged, and the lockout sleeve 522 and the drum cam 530 are prevented from rotating, a jam would occur and stall the motor 405. Thus, this feature allows for over driving of the threaded shaft 401 when the motor 405 is used to back drive the carrier 442 to the home position (opposite the return position), and is desirable to limit the need for precise control of the motor 405 during the back drive.

Thus, the fastener driving device 400 of the illustrated embodiment allows the drive spring 403 to be expanded and the carrier 442 to contact the bumper 409 so that the drive spring 403 can do no work, this feature being important for enhancing safety and durability of the fastener driving device 400. In particular, the controller 429 can be implemented to monitor duration of the time in which the fastener driving device 400 is in the pre-compressed state, and if this time duration exceeds a predetermined amount which suggests that the user is no longer actively using the device, the motor 405 can be driven in the reverse direction so as to position the carrier 442 and the driver 410 in the home position thereby reducing the likelihood that a fastener would be driven unintentionally when the user resumes use of the fastener driving device 400. In addition, by releasing the stored energy of the drive spring 403, the durability of the drive spring 403 can be improved since the drive spring 403 would not be subjected to the stress and strain of the pre-compressed position for extended duration.

Figure 23B:
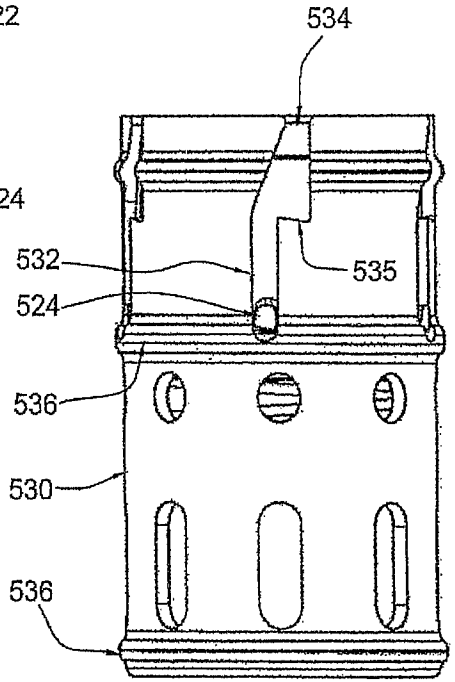
FIGS. 23A and 23B show side perspective views of the pin lockout sleeve received in a drum cam in accordance with one embodiment of the present invention.
Figure 23A:
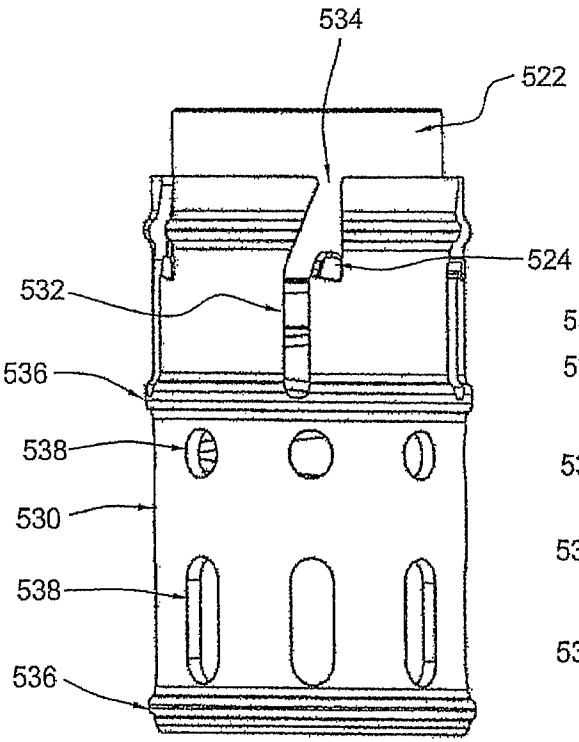

As shown in FIG. 22C, the lockout sleeve 522 includes a nut pocket 525 sized to receive the hexagonally shaped shank 484 of the nut 480. In this regard, the nut pocket 525 is provided with angled surfaces 526 that allows the nut 480 to engage with the lockout sleeve 522, such design being disclosed in U.S. Pat. No. 6,170,366. The sliding friction of the nut shank 484 against the angled surfaces 526 causes the lockout sleeve 522 to begin to rotate as the nut 480 is progressively received within the nut pocket 525. The rotation of the lockout sleeve 522 causes the rotation of the bosses 524 that are provided on the peripheral surface of the lockout sleeve 522. FIGS. 23A and 23B illustrate the coaxial nesting of the lockout sleeve 522 in the drum cam 530. The drum cam 530 is received within the element housing 516, and is rotatable therein. In this regard, the drum cam 530 of the illustrated embodiment is provided with annular contact rings 536 as shown in FIGS. 23A and 23B, that contact the interior of the element housing 516 to facilitate its rotation, and holes 538 to reduce its weight. It should be noted that there is frictional drag on the drum cam 530 against rotation which allows the lockout sleeve 522 to rotate independently of the drum cam, this frictional drag being produced by the reaction force of the lockout sleeve spring 540 in the illustrated embodiment. This decoupling of the lockout sleeve 522 and drum cam 530 rotation allows the bosses 524 on the lockout sleeve 522 to rotate off of the shelf 535, allowing the lockout sleeve 522 to be pushed down the slot 534 in the drum cam 530 by the nut 480.

As can be seen in FIGS. 23A and 23B, the drum cam 530 includes a plurality of slots 532 with openings 534 that are sized to receive the bosses 524 of the lockout sleeve 522. In this regard, the plurality of slots 532 each include a shelf 535 that is positioned directly below the openings 534 of the plurality of slots 532. Thus, as the lockout sleeve 522 is received in the drum cam 530, the bosses 524 enter the openings 534, and rest on the shelf 535 of the slots 532 as shown in FIG. 23A. As clearly shown in FIG. 23B, the shelf 535 is slightly angled to retain the bosses 524 supported thereon. However, as the nut 480 engages and is received within the nut pocket 525 of the lockout sleeve 522, it causes the bosses 524 to rotate within the slots 532, thereby causing each boss 524 to clear the shelf 535, and allowing the lockout sleeve 522 to recess further into the drum cam 530 as shown in FIG. 23B with the bosses 524 correspondingly extending further into the plurality of slots 532. In such a position, the lockout sleeve 522 is completely below the holes 518 so that the plurality of pins 506 can be displaced radially inwardly to engage the flange 482 of the nut 480 if the nut 480 is at the appropriate location for engagement. In addition, it should also be appreciated, the angled ramping of the slot 532 as shown in FIGS.

23A and 23B allows the bosses 524 of the lockout sleeve 522 to pass over the shelf 535 of the drum cam 530 when the lockout sleeve 522 is released and pushed up by the lockout sleeve spring 540. The provision of a shelf 535 and the engaging bosses 524 is important because under the high impact loads when the carrier 442 hits the bumper 409, the lockout sleeve 522 tends to slip by the pins 506 due to its inertia, to potentially allow the pins 506 to move radially inwardly. However, because the bosses 524 contact of the shelf 535, such unintentional movement of the lockout sleeve 522 is prevented in the present implementation.

Figure 24B:
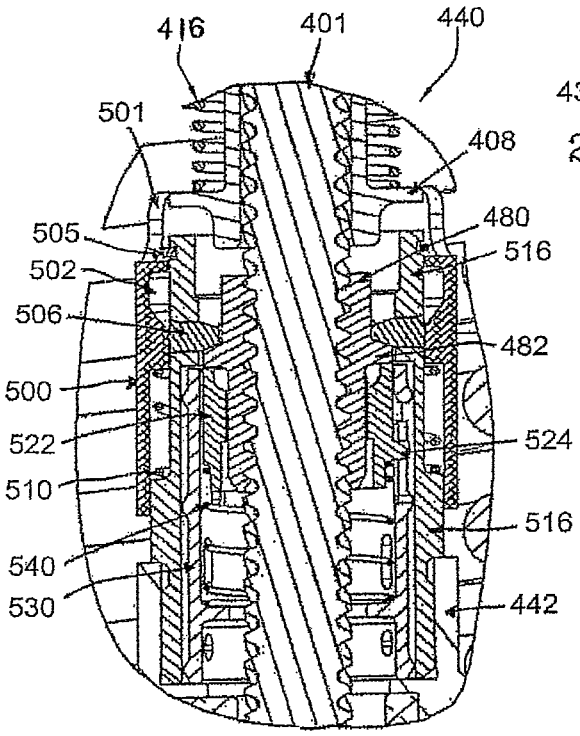
FIG. 24B is an enlarged cross sectional view of the coupler mechanism and threaded shaft of FIG. 24A.
Figure 24A:
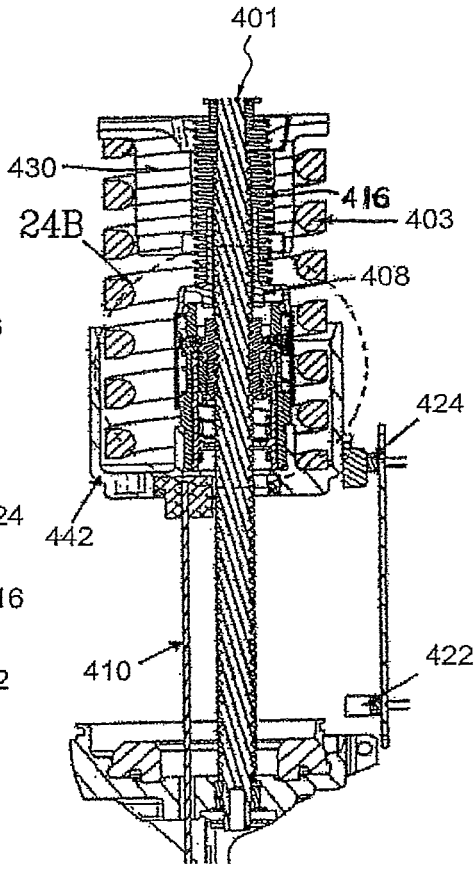
FIG. 24A is a cross sectional view of the coupler mechanism and threaded shaft of FIG. 20 at a pre-compressed position.

FIGS. 24A and 24B illustrate various components of the fastener driving device 400 and the coupler mechanism 440 of the above described embodiment in the pre-compressed position in which, as explained relative to the previous embodiment, the carrier 442 is moved through a substantial portion of the return stroke, for example, at least 70% of the compression required for a full drive stroke, or between about 70% and about 90% of the compression required for a full drive stroke. As can be seen, in contrast to FIGS. 21A and 21B, the release collar 500 is positioned so that the plurality of pins 506 are positioned radially inwardly and engage the flange 482 of the nut 480 with the ends of the plurality of pins 506 abutting the land 504. This allows the carrier 442 to be moved through the return stroke as the threaded shaft 401 is rotated in the return direction. In addition, the lockout sleeve 522 is recessed into the drum cam 530 as shown in FIG. 23B, so that the lockout sleeve 522 is below the holes 518. As can be seen, attainment of the pre-compressed position is detected by sensor 424.

Figure 25B:
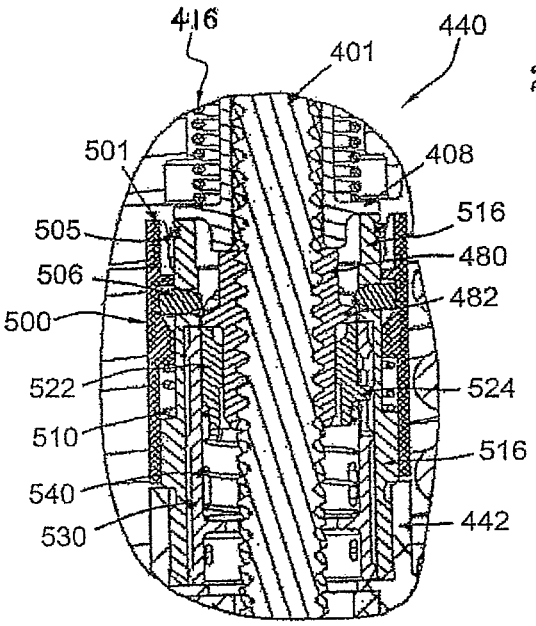
FIG. 25B is an enlarged cross sectional view of the coupler mechanism and threaded shaft of FIG. 25A.
Figure 25A:
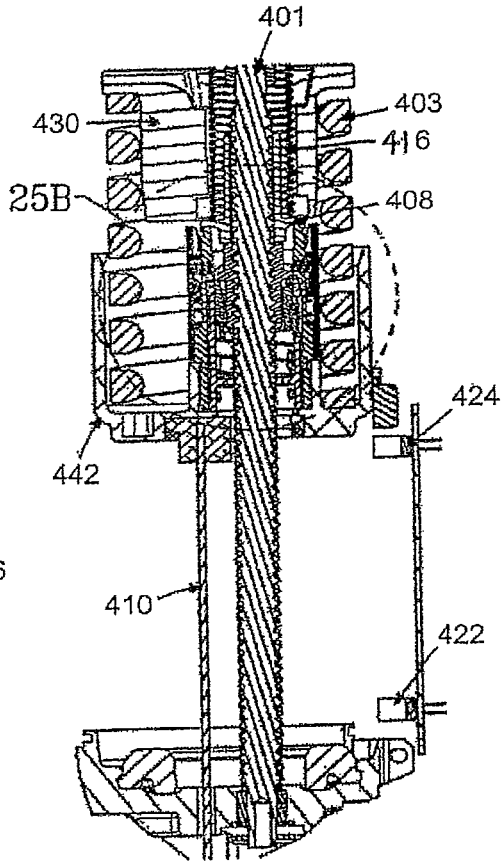
FIG. 25A is a cross sectional view of the coupler mechanism and threaded shaft of FIG. 20 at a release position.

FIGS. 25A and 25B illustrate various components of the fastener driving device 400 and the coupler mechanism 440 of the above described embodiment in the release position when the carrier 442 is disengaged from the nut 480 so that it can be instantly moved through the drive stroke by the expansion of the drive spring 403. In particular, as the carrier 442 completes its return stroke from the pre-compressed position shown in FIGS. 24A and 24B, the axially extending flanges 502 of the release collar 500 contacts the upper spring seat 430. As the return stroke is continued, the release collar 500 is displaced downwardly relative to the element housing 516 against the bias of the collar spring 510, FIG. 25B most clearly showing the downwardly displaced collar 500. Correspondingly, the pins 506 are pushed radially outwardly into the pocket 502 of the release collar 500, thereby disengaging the carrier 442 from the nut 480 so that the carrier 442 can be moved through the drive stroke. Because the pins 506 need to be retracted only a short distance to disengage the carrier 442 from the nut 480, the carrier 442 can be released almost instantaneously. In addition, at the immediate instant of the release position shown, the lockout sleeve 522 remains recessed in the drum cam 530. At the instant the carrier 442 is released and pulls away from the nut 480, the lockout sleeve 522 maintains contact with the flange 482 of the nut 480 via the lockout sleeve spring 540 so that as the flange 482 moves past the holes 518 of the housing 516, there is no gap created that may allow the pins 506 to be moved radially inwardly, thereby allowing the lockout sleeve 522 to move into position to block the holes 518.

It should also be noted that in contrast to the prior embodiment in which three sensors were used to detect the position of the carrier, including the release position, the fastener driving device 400 is implemented with only sensors for detection of the carrier 442 at the home, and pre-compressed positions, the release position being presumed to be reached upon further rotation of the threaded shaft 401 in the return direction even after carrier 442 is detected to be at the pre-compressed position.

Figure 26B:
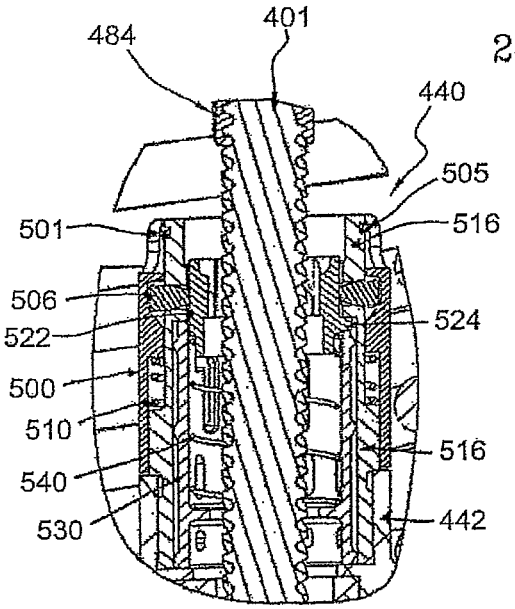
FIG. 26B is an enlarged cross sectional view of the coupler mechanism and threaded shaft of FIG. 26A.
Figure 26A:
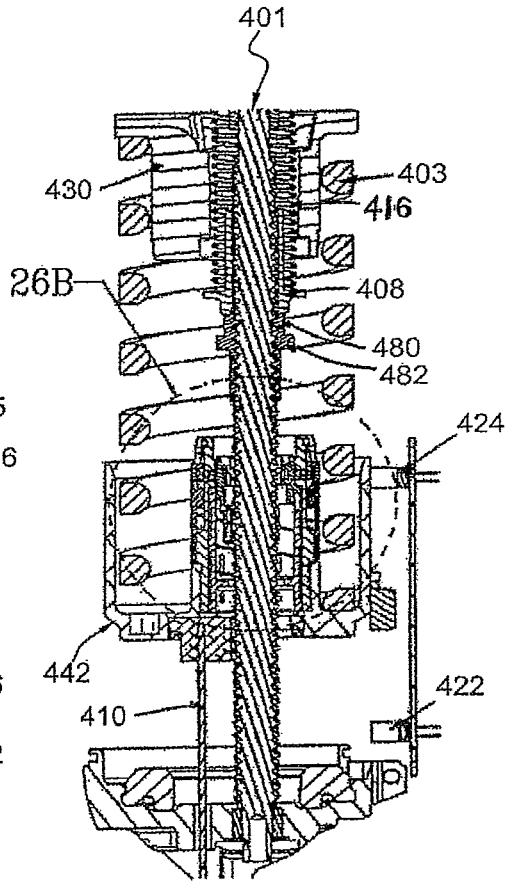
FIG. 26A is a cross sectional view of the coupler mechanism and threaded shaft of FIG. 20 during the drive stroke.

FIGS. 26A and 26B illustrate various components of the fastener driving device 400 and the coupler mechanism 440 of the above described embodiment during the drive stroke, shortly after the release position described above relative to FIGS. 25A and 25B. As can be seen, the carrier 442 is disengaged, and separated from the nut 480, the carrier 442 being moved through the drive stroke very rapidly by the expansion of the drive spring 403. As explained, the driver 410 is attached to the carrier 442, the driver 410 engaging a fastener and driving the fastener into a workpiece as the carrier 442 is moved through the drive stroke. The nut 480 is still near the top of the threaded shaft 401 and is back driven down to the carrier 442 by the return spring 416. Of course, the back driving of the nut 480 occurs rapidly as well, but occurs at a slower rate than the drive stroke of the carrier 442 which is driven by the substantial energy that is stored in the compressed drive spring 403. The rate in which the back driving of the nut 480 can be controlled by the selection of the appropriate return spring 416.

As can be seen most clearly in FIG. 26B, the plurality of pins 506 remain retract radially outwardly, ends of the pins 506 being received in the pocket 502 of the release collar 500. In addition, the lockout sleeve 522 is positioned to cover the holes 518 of the element housing 516, the lockout sleeve 522 being biased upwardly toward the return stroke direction by the lockout sleeve spring 540. Thus, the lockout sleeve 522 functions to prevent the plurality of pins 506 from moving radially inwardly when the nut 480 is disengaged from the carrier 442 so that the nut 480 can be received back in the carrier 442 for re-engagement in preparation for the return stroke.

Figure 27:
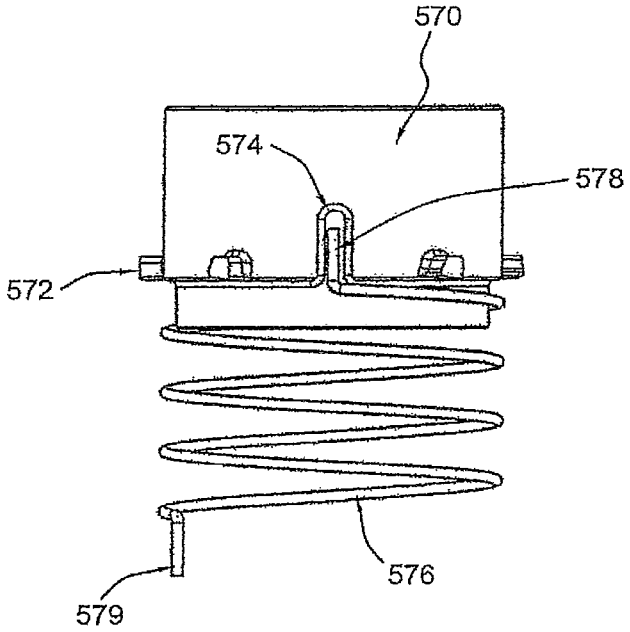
FIG. 27 is a side view of a pin lockout sleeve and lockout sleeve spring in accordance with yet another embodiment of the present invention.

FIG. 27 shows an alternative embodiment of the lockout sleeve 570 and a lockout sleeve spring 576. The lockout sleeve 570 includes bosses 572 that are received in the plurality of slots 532 of the drum cam 530 described relative to FIGS. 22A to 23B. However, this embodiment differs from the above described embodiment in that the lockout sleeve 570 includes a spring end channel 574 that receives a first axially extending end 578 of the lockout sleeve spring 576. The lockout sleeve spring 576 further includes a second axially extending end 579 that is received in a similar spring end channel (not shown) provided in the drum cam 530. This allows the lockout sleeve spring 576 to function as a torsion spring to bias the lockout sleeve 570 in a rotational direction, in addition to the axial direction. Thus, the bosses 572 can be biased in the desired direction, for example, direction of the shelf provided in the slots of the drum cam. Moreover, the shelf may be implemented without any angling thereof since the lockout sleeve spring 576 would rotationally bias the lockout sleeve 570 to remain on the shelf.

Figure 28:
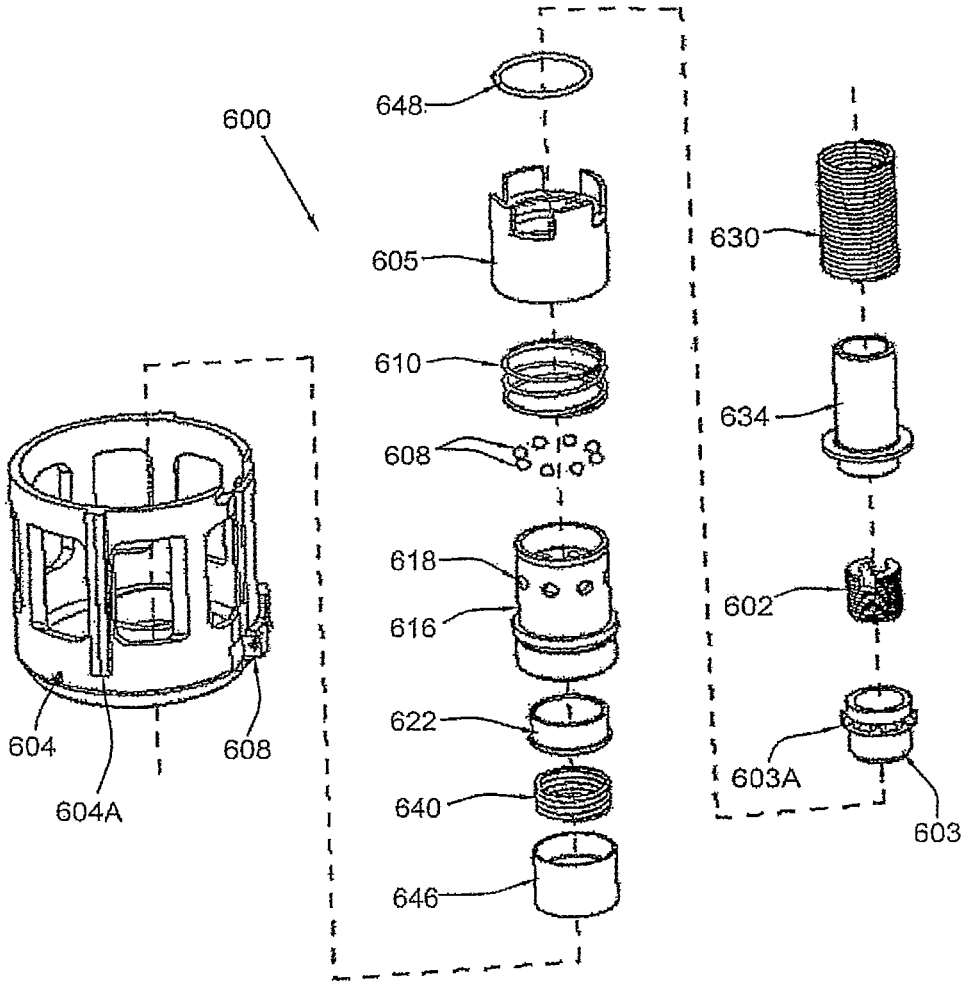
FIG. 28 is an exploded perspective view of a coupler mechanism and a threaded shaft in accordance with another embodiment that can be used in a fastener driving device.
Figure 29:
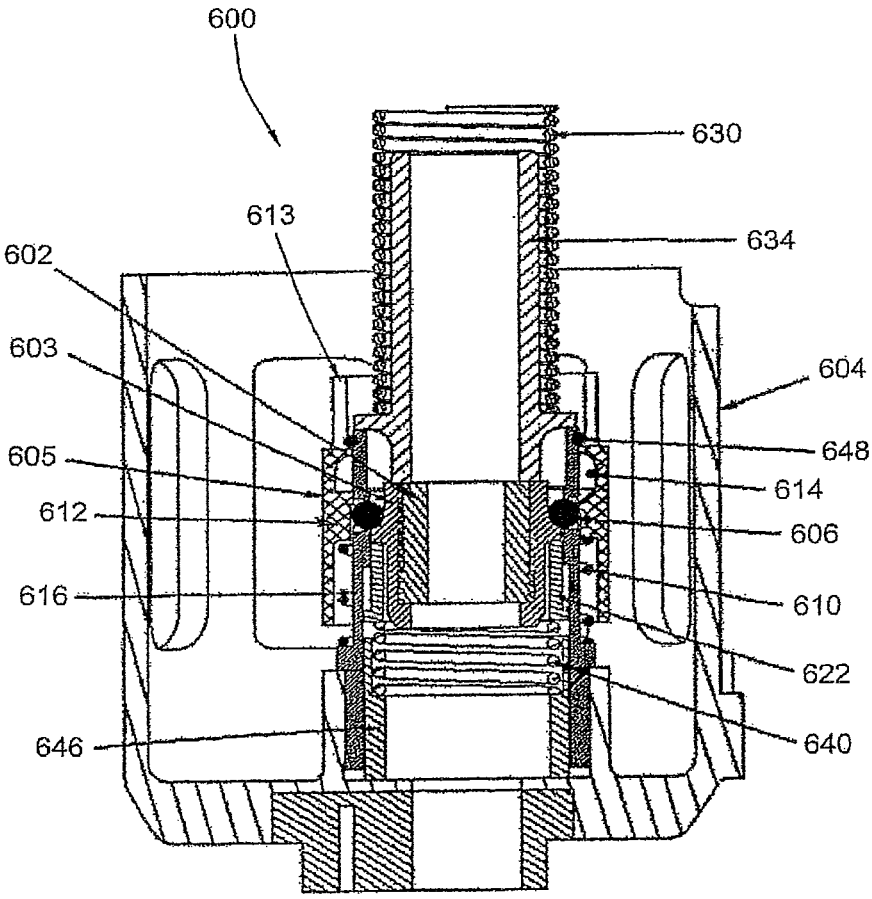
FIG. 29 is a cross sectional view of the components shown in FIG. 28.

FIGS. 28 and 29 show a coupler mechanism 600 in accordance with yet another embodiment of the present invention that can be used in a fastener driving device to engage, and disengage, the carrier 604 from the nut 602 that engages a threaded shaft (not shown). The coupler mechanism 600 shown in these figures operate in a similar manner to the coupler mechanism 440 described above relative to FIG. 20, the primary distinction being that a plurality of balls 606 are used as the movable element instead of the plurality of pins previously described. The plurality of balls 606 are moved radially inwardly to engage the nut 602, to thereby connect the carrier 604 to the nut 602 so that the carrier 604 can be moved through the return stroke upon rotation of the threaded shaft in the return direction. Upon completion of the return stroke, the plurality of balls 606 are retracted radially outwardly in the release position to thereby disengage from the nut 602, thus, releasing the carrier 604 so that it is moved through the drive stroke.

As most clearly shown in FIG. 28, the coupler mechanism 600 for engaging and disengaging the carrier 604 to the nut 602 in the illustrated embodiment also includes a release collar 605, a collar spring 610, a element housing 616 with holes 618 that are sized to receive the balls 606 therein, a lockout sleeve 622, a return sleeve 634 received in a return spring 630, a lockout sleeve spring 640, and a sleeve spring seat 646. The holes 618 are preferably provided with beveled surfaces in the illustrated embodiment, and dimensioned so that the balls 606 cannot pass entirely through the holes 618, but can protrude inwardly therefrom. The nut 602 is received and retained in a nut retainer 603 that includes a flange 603A with a ratchet surface that the plurality of balls 506 engage. The carrier 604 of the illustrated embodiment is also provided with a guide 604A and an attachment block 608 which can be used in the manner previously described. The coupler mechanism 600 also includes a ring 648 that maintains the interface between the release collar 605 and the element housing 616. The nut 602 and the nut retainer 603 are also biased toward the carrier 604 by the return spring 630 which acts upon return sleeve 634.

FIG. 29 shows a cross sectional view of the coupler mechanism 600 with the carrier 604 completing its return stroke and about to be positioned in the release position. Thus, the carrier 604 is engaged to the nut 602 and the nut retainer 603 so that upon rotation of the threaded shaft, the carrier 604 is lifted to compress the drive spring (not shown). In particular, the release collar 605 is positioned so that the plurality of balls 606 are positioned radially inwardly, and engage the flange 603A of the nut retainer 603, the balls 606 abutting the land 612 of the release collar 605. In addition, the lockout sleeve 622 is positioned below the flange 603A of the nut retainer 603, and correspondingly, below the holes 618 of the element housing 616, the lockout sleeve spring 640 being compressed as shown.

When the carrier 604 is in the release position, the axially extending flanges 613 of the release collar 605 contacts an upper spring seat (not shown) thereby displacing the release collar 605 downward relative to the element housing 616. This causes the pocket 614 of the release collar 605 to be aligned with the balls 606 so that the balls 606 retract radially outwardly into the pocket 614. In this regard, the holes 618 may be provided with a chamfer as shown, to facilitate radial outward movement of the balls 606. This allows the nut retainer 603 and the nut 602 to be disengaged from the carrier 604. Of course, as described relative to the previous embodiments, the carrier 604 is rapidly moved through a drive stroke while the nut retainer 603 and the nut 602 are back driven down the threaded shaft at a slower rate by the return spring 630.

To prevent the balls 606 from protruding radially inwardly beyond the holes 618 upon separation of the nut retainer 603 and the nut 602, the lockout sleeve 622 moves upwardly relative to the element housing 616, thereby blocking the holes 618. As the nut retainer 603 and the nut 602 are back driven into the carrier 604, the lockout sleeve 622 is displaced downwardly by the nut retainer 603 against the bias of the lockout sleeve spring 640, thereby causing the balls 606 to be moved radially inwardly to re-engage the carrier 604 to the flange 603A of the nut retainer 603, stopping the rotation of the nut 602, and allowing the carrier 604 to be moved through the return stroke. Upon re-engagement of the carrier 604 to the nut retainer 603, the carrier 604 can be moved through the return stroke, and the above described operation can be repeated. In addition, as can also be seen in FIG. 28, the flange 603 of the nut retainer 603 is provided with a ratchet surface thereon that is engaged by the balls 606 to allow the nut 602 rotate in the reverse direction in a manner described relative to the embodiment of FIG. 22A.

Figure 30:
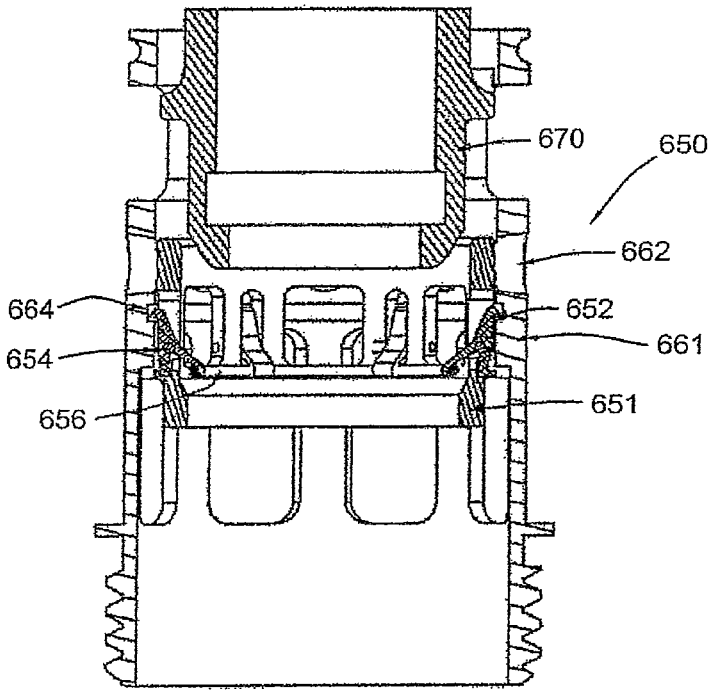
FIG. 30 is a cross sectional view of various components of a coupler mechanism in accordance with yet another embodiment of the present invention.

Of course, the above described implementation of the coupler mechanism that utilizes balls for engaging the carrier to the nut is merely one example. The coupler mechanism may be further modified to enhance performance thereof in other implementations. In this regard, FIG. 30 illustrates another implementation of a coupler mechanism 650 that utilizes a lockout sleeve 651 received in the element housing 661 with holes 662. Various other components have been omitted in FIG. 30 since they are the same as those described above relative to FIGS. 28 and 29.

As can be seen, the lockout sleeve 651 is provided with a plurality of sleeve latches 652 that engage a groove 664 provided in the interior of the element housing 661. Each sleeve latch 652 is pivotably mounted by a pin 654, and biased to the engaged position shown by a resilient ring 656. In the position shown, the lockout sleeve 651 blocks the holes 662 so as to prevent the balls (not shown) from unintentionally moving radially inward when the nut is separated from the carrier during the drive stroke. By implementing such sleeve latches 652, relative axial movement between the lockout sleeve 651 and the element housing 661 is prevented, even when the carrier is subjected to very high impact forces. Thus, the proper positioning of the lockout sleeve 651 can be ensured at the completion of the drive stroke when the carrier impacts against the bumper of the fastener driving tool.

The sleeve latches 652 are retracted when the nut 670 contacts the sleeve latches 652 as the nut 670 is back driven and received in the lockout sleeve 651. This contact causes sleeve latches 652 to pivot about the pins 654, thereby disengaging the sleeve latches 652 from the groove 664 of the element housing 661, and allowing relative axial movement between the lockout sleeve 651 and the element housing 661. The lockout sleeve 651 is moved further down into the element housing 661 as the nut 670 is further back driven, uncovering the holes 662 and allowing the balls to move radially inwardly to thereby engage the flange 672 of the nut 670 when the flange 672 moves past the holes 662. Thus, the carrier can then be moved in a return stroke and the operation repeated.

Figure 31B:
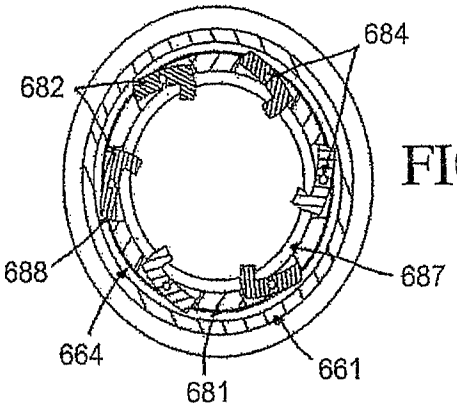
FIG. 31B is a cross sectional view of the coupler mechanism of FIG. 31A as viewed along 31B-31B, the sleeve latches being shown in the outwardly pivoted position.
Figure 31C:
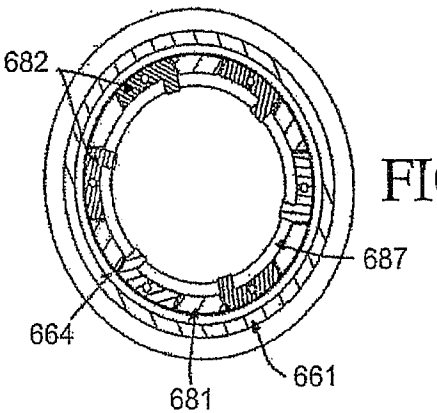
FIG. 31C is a cross sectional view of the coupler mechanism of FIG. 31A as viewed along 31B-31B, the sleeve latches being shown in the inwardly retracted position.
Figure 31A:
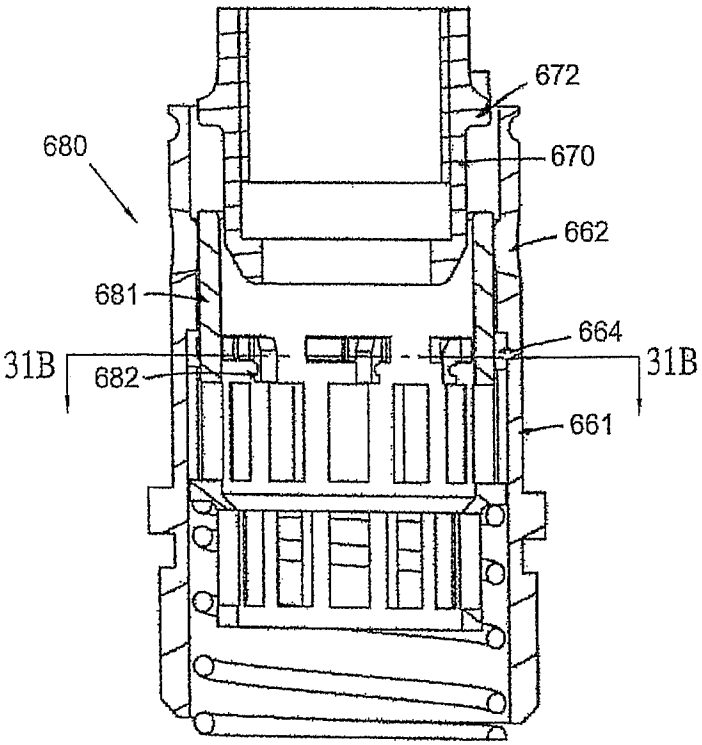
FIG. 31A is a cross sectional view of various components of a coupler mechanism in accordance with yet another embodiment of the present invention.

FIGS. 31A to 31C illustrate yet another implementation of a coupler mechanism 680 including a lockout sleeve 681 received in the element housing 661 with holes 662, various other components having been omitted for clarity. Like the embodiment of FIG. 30, the lockout sleeve 681 is provided with a plurality of sleeve latches 682 that engage a groove 664 provided in the interior of the element housing 661, these sleeve latches 682 being most clearly shown in the cross sectional views of FIGS. 31B and 31C. Unlike the embodiment of FIG. 30, the sleeve latches 682 are pivotably mounted by pins 684 which are oriented parallel to the vertical axis in which the carrier (not shown) is displaced. Thus, the sleeve latches 682 are implemented to pivot about a plane transverse to the axis of the drive spring.

In this regard, FIG. 31B illustrate the sleeve latches 682 in the outwardly pivoted orientation in which the distal ends 688 of the sleeve latches 682 are pivoted into the groove 664, thereby preventing relative movement between the lockout sleeve 681 and the element housing 661. The sleeve latches 682 are also biased to the engaged position shown in FIG. 31B by a resilient ring 687. Thus, in the position shown in FIG. 31B, the lockout sleeve 681 blocks the holes 662 so as to prevent the balls (not shown) from unintentionally moving radially inward when the nut 670 is separated from the carrier during the drive stroke, even when the carrier is subjected to very high impact forces.

As the nut 670 is back driven and contacts the sleeve latches 682, the sleeve latches 682 are retracted to the configuration shown in FIG. 31C. In particular, the sleeve latches 682 pivot about the pins 684, thereby disengaging the sleeve latches 682 from the groove 664 of the element housing 661, and allowing relative axial movement between the lockout sleeve 681 and the element housing 661. The lockout sleeve 681 is moved further down into the element housing 661 as the nut 670 is further back driven, uncovering the holes 662 and allowing the balls to move radially inwardly to thereby engage the flange 672 of the nut 670 when the flange 672 moves into the carrier beyond the holes 662.

During re-engagement of the embodiments of the coupler mechanism described above, the threaded shaft 401 may rotate at speeds greater than 600 rpm. Engaging the threaded shaft nut with any fixed mechanism may be difficult due to the fact that any drag/torque applied to the threaded shaft nut may result in the nut being pulled away from the coupled mechanism it is engaging with. FIGS. 48 to 50D illustrate an embodiment of a coupler mechanism 2000 that includes a nut assembly 2010 that includes a retaining cap 2012, a free nut 2014, and a fixed nut 2016. The fixed nut 2016 is internally threaded (i.e., includes threads 2017 on an inside surface) to transmit power from the threaded shaft 401 (described above) and also serves as the shaft that the free nut 2014 spins on. The free nut 2014 has an internal smooth bore 2018, outer pin engagement features 2020, and secondary engagement (ratchet) features 2022. When the nut assembly 2010 re-engages with the threaded shaft 401, the return spring 416 forces the nut assembly 2010 down the threaded shaft 401 into a pin housing 2024 (shown in FIGS. 50A-50D), while the threaded shaft 401 is continuously spinning.

Figure 49:
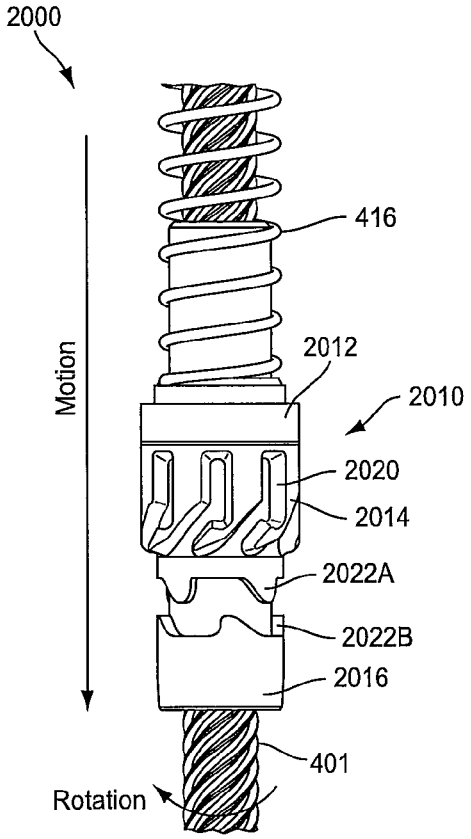
FIG. 49 is a side view of the coupler mechanism of FIG. 48 that is coupled to the threaded shaft.

During primary engagement, the free nut 2014 is biased towards the retaining cap 2012, as shown in FIG. 49, by inertia, magnetic force, or other means, thereby allowing the free nut 2014 to spin about the fixed nut 2016. In the embodiment illustrated in FIG. 48, the retaining cap 2012 includes a plurality of magnets 2013 that are constructed and arranged to attract the free nut 2014 by magnetic force. The free nut 2014 should be allowed to spin when the outer pin engagement features 2020 are engaged with pins 2021 (shown in FIGS. 50A-50D), as any torque applied to the fixed nut 2016 will cause the nut assembly 2010 to be driven up the threaded shaft 401 and out of engagement with the engagement features 2021 (e.g., pins) in the housing 2024. Allowing the free nut 2014 to spin about the fixed nut 2016 lets the return spring 416 seat the nut assembly 2010 into the pin housing 2024 without resistance from the fixed nut 2016 spinning with the threaded shaft 401. Once the nut assembly 2010 has been engaged with the pin housing 2024, then the ratchet features 2022A, 2022B of the fixed nut 2016 and free nut 2014 should engage and lock together to allow the fixed nut 2016 to lift the entire assembly against the drive spring 403. In an embodiment, the secondary engagement may be executed by using a magnet 2026 contained in the housing 2024 to pull the free nut 2014 down into the fixed nut 2016. Many other suitable methods may be employed to create this secondary engagement by pulling/pushing the free nut 2014 down while the fixed nut 2016 remains stationary, or by lifting the fixed nut 2014 into the free nut 2016.

Figure 50A:
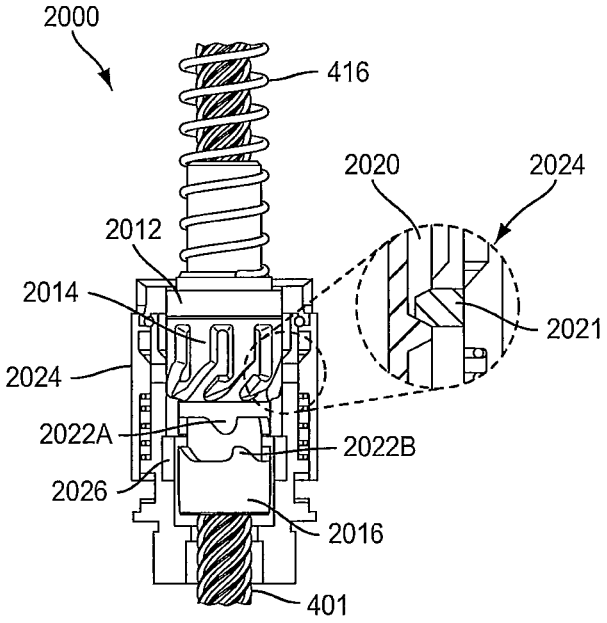
FIG. 50A is a cross sectional view of the coupler mechanism of FIG. 48 in a pin housing as a nut assembly of the coupler mechanism enters the pin housing.
Figure 50B:
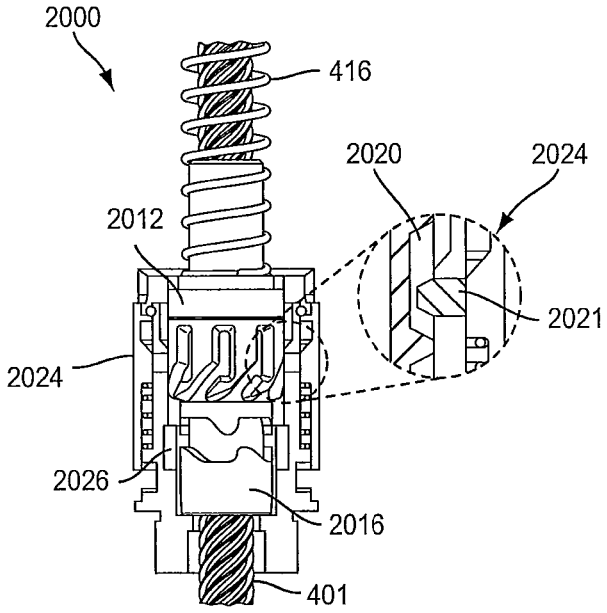
FIG. 50B is a cross sectional view of the coupler mechanism of FIG. 48 in the pin housing after primary engagement has been completed.
Figure 50C:
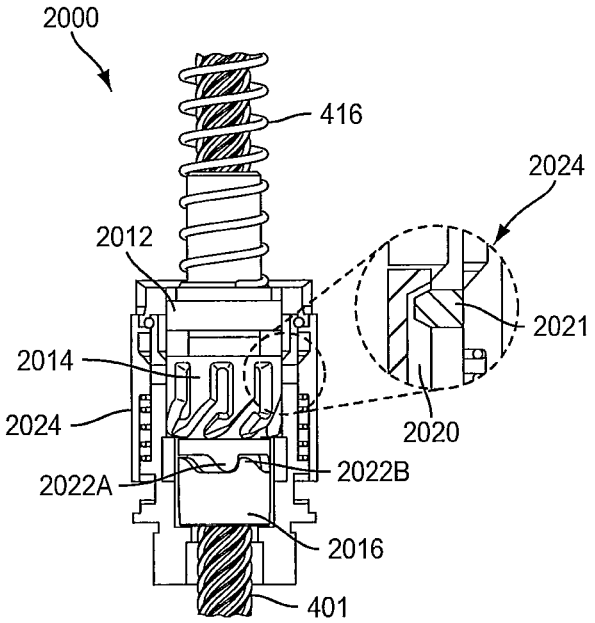
FIG. 50C is a cross sectional view of the coupler mechanism of FIG. 48 in the pin housing with a free nut and a fixed nut of the nut assembly engaged.
Figure 50D:
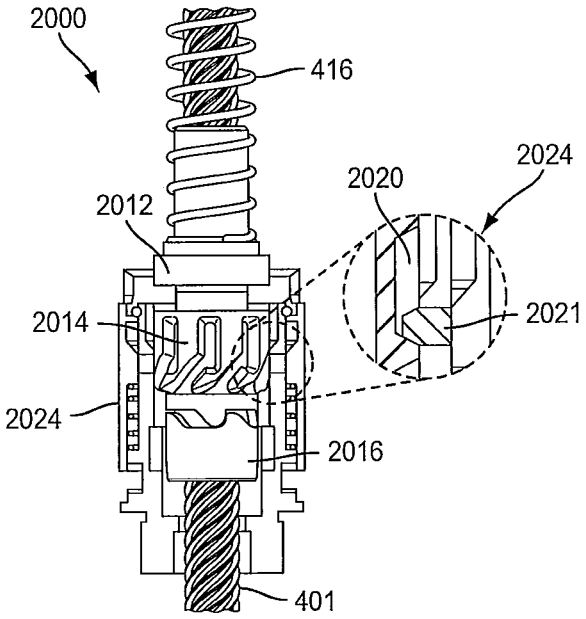
FIG. 50D is a cross sectional view of the coupler mechanism of FIG. 48 in the pin housing as the free nut and the fixed nut are fully engaged and moving upward.

FIG. 50A illustrates the nut assembly 2010 entering the pin housing 2024. The pins 2021 engage the outer pin engagement features 2020 of the free nut 2014. FIG. 50B illustrates primary engagement of the nut assembly 2010 to the pin housing 2024. FIG. 50C illustrates the ratchet features 2022A, 2022B of the free nut 2014 and fixed nut 2016 in an engaged configuration, and FIG. 50D illustrates the nut assembly 2010 fully engaged and climbing up the threaded shaft 401 as the threaded shaft 401 is lifting the carrier, as described above. The ratchet features 2022A, 2022B are designed to be one directional, which allows the fixed nut 2016 to spin with the threaded shaft 401 in the reverse direction, which may prevent a stall condition when the carriage 442 is at its rest position against the bumper 409.

Figure 51:
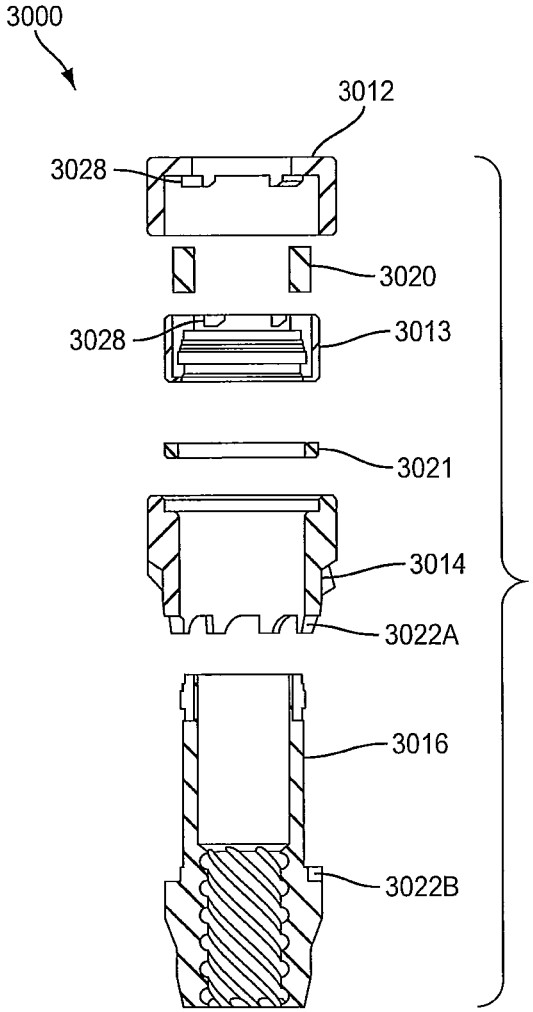
FIG. 51 is a cross sectional exploded view of an embodiment of a coupler mechanism.
Figure 52:
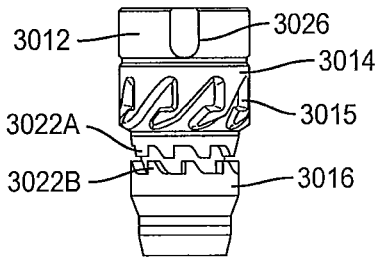
FIG. 52 is a side view of the coupler mechanism of FIG. 51.
Figure 53:
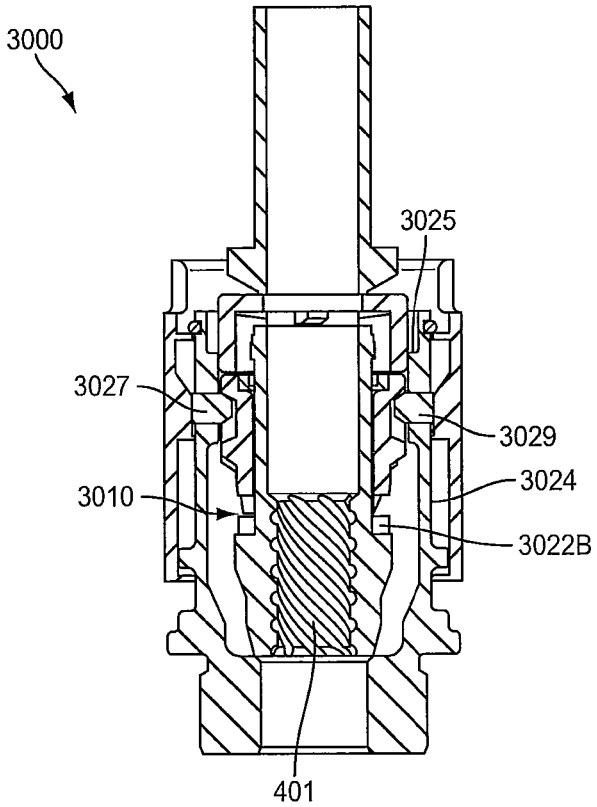
FIG. 53 is a cross sectional view of the coupler mechanism of FIG. 51 in a pin housing.

FIGS. 51 to 53 illustrate an embodiment of a coupler mechanism 3000 that incorporates a nut assembly 3010 that includes a free cap 3012, a fixed cap 3013, a free nut 3014 and a fixed nut 3016 and uses essentially the same fixed nut and free nut concept described above, but instead uses small magnets 3020 to hold ratchet teeth 3022A on the free nut 3014 away from the fixed nut 3016. The magnets 3020 should be strong enough to hold the free nut ratchet teeth 3022A away from the fixed nut 3016, but to also allow engagement of the free nut 3014 and the fixed nut 3016 once the nut assembly 3010 is fully inserted into a pin housing 3024. A steel plate 3021 may be press fit into the free nut 3014 and is attracted to the magnets 3020 so that the free nut 3014 may be biased away from the fixed nut 3016. A cam follower surface 3026 on the free cap 3012 is used to engage with a cam surface 3025 molded into the pin housing 3024.

When the nut assembly 3010 is fully inserted into the pin housing 3024, the rotational motion of the fixed nut 3016 may be constrained in the following manner. First, the free cap 3012 is prevented from being rotated by the steep rise of the cam surface 3025 on the pin housing 3024, and the fixed cap 3013 is constrained from rotating by ratchet teeth 3028 between the caps 3012, 3013. The fixed cap 3013 is held fixed to the fixed nut 3016 by the small magnets 3020 that are used to bias the free nut 3014 towards the fixed cap 3013.

Once the rotation of the fixed nut 3016 is constrained, and while the threaded shaft 401 is rotating, the fixed nut 3016 will move axially against the return spring 416, thereby causing the ratchet teeth 3022 (see FIG. 52) between the fixed nut 3016 and the free nut 3014 to engage. Once the fixed nut 3016 and free nut 3014 are engaged, all of the axial and rotational loading may be transmitted via the ratchet teeth 3022A at the bottom of the free nut 3014. Because the cam surface 3025 and locating holes 3027 for engagement pins (which may be magnets) 3029 are both fixed on the housing 3024 and the position of the cap follower and ratchet teeth 3022B of the fixed nut 3016 are controlled, the circumferential positions of the two nuts 3014, 3016 are fixed during engagement. The engagement pins 3029 are configured to engage openings 3015 in the free nut 3014. The two caps 3012, 3013 may be used to lower the torque in the reverse direction. A single cap would give the desired ratcheting motion, but some torque would be developed as the free nut 3014 would have to turn faster than the threaded shaft 401 to allow for the counter axial movement of the nut 3014 as the cap slides up the cam surface against the downward force created by the reversing threaded shaft 401 and the return spring 416.

The fixed circumferential design may be used for better control of the engagement of the ratchet teeth 3022 between the fixed nut 3016 and the free nut 3014, as the teeth 3022A, 3022B bear the full load of compressing the drive spring 403, so that there is not a partial meshing of the teeth 3022A, 3022B. This may allow for lower contact stresses which may allow for and lower strength materials to be used for teeth 3022A, 3022B. The design may also allow for lighter parts, because the magnetic engagement may be removed. Lighter parts may allow the fastener driving device to be more efficient, because the return spring energy, which is not used to drive the fastener, may be lower for a fixed engagement time. By creating a nut assembly, as described above, that allows for free rotation of the features/parts that engage with the fixed part of the coupler mechanism, the rotating nut assembly may engage the fixed part without having to counter the lifting force of the threaded shaft. After the nut assembly is coupled to the fixed part, the nut assembly may then transfer load to the threaded shaft and allow the carrier to lift.

It should be apparent from the above discussions relative to FIGS. 6 to 10, 13 to 16, 20 to 31C, and 48 to 53 that the coupler mechanism of the present invention may be implemented in many different ways, including with balls, pins, latches, hex/spin re-engagement, linear latching re-engagement, rotary re-engagement, and so forth. Of course, the present invention is not limited to the specific embodiments disclosed, but may be further modified and implemented differently. In addition, it should be appreciated that whereas the above threaded shaft and coupler mechanism were described relative to a fastener driving device, the present invention is not limited thereto, and may be applied to other power tools. However, it should be apparent from the above discussions that the coupler mechanism of the present invention performs an important task of reliably coupling/engaging the driver to a rotary-to-linear motion converter such as a threaded shaft, so that the driver can be moved through a return stroke, and reliably de-coupled/disengaged so that the stored energy is released and the driver can be moved through a drive stroke to drive a fastener. Moreover, such actions can be performed very quickly, for instance, less than 30 msec.

In addition, in the preferred implementation, the coupler mechanism can be operated to re-engage the carrier to the threaded shaft any point of the drive stroke, for example, to restrain stored energy to facilitate clearing a jam or to recapture drive energy, as previously explained. Of course, upon engagement, the coupler mechanism should be sufficiently rigid to minimize energy loss, and to restrain the stored energy. Furthermore, it should be evident that the coupler mechanism is operable to controllably decrease the stored energy or increase the stored energy to a maximum value for driving as also discussed. The above described operations should be performed reliably and robustly so that it does not unintentionally disengage due to vibration or other external influences. As also discussed, the engagement and disengagement of the coupler mechanism of the present invention is preferably attainable regardless of the rotation or speed of the threaded shaft or the motor so that they do not have to stop rotation, or reverse direction, in order to engage or disengage. In this regard, it should be evident how the present invention also allows disengagement of the coupler mechanism with minimal additional motor torque input, and minimal lost energy by, for example, minimizing moving mass, friction, and displacement of the movable members.

Referring again to FIG. 16, the fastener driving device 400 may be provided with a mode switch which allows the user to select the manner in which the fastener driving device 400 is used, for instance, in a sequential mode, or a bump fire mode. FIGS. 32A to 33C show a mode switch 700 in accordance with one embodiment of the present invention, the mode switch 700 being positioned near the battery 421 of the fastener driving device 400 in the embodiment described. Referring to these figures, FIG. 32A shows the mode switch 700 in the default home position. With the mode switch 700 in the home position, and with the battery 421 attached (i.e. mounted) to the fastener driving device 400 in the fully engaged position as shown in FIG. 33A, the fastener driving device 400 can be operated in the sequential mode. In addition, with the mode switch 700 in the bump position shown in FIG. 32C, and with the battery 421 in the fully engaged, the fastener driving device 400 can be operated in the bump mode. A detent spring (not shown) or other mechanism can be used to resist easy movement of the mode switch 700 between the various modes so that unintended operation of the mode switch 700 can be prevented.

In the illustrated embodiment, the mode switch 700 is also implemented to allow partial release (i.e. partial engagement), and removal, of the battery 421 from the fastener driving device 400. As explained herein below, partial release of the battery 421 is distinguished from the removal of the battery 421 in the illustrated embodiment in that the battery 421 is partially engaged to the fastener driving device 400, and requires further movement of the battery 421 by the user to overcome the partially engaged latch in order to fully remove the battery from the fastener driving device 400. In particular, upon moving the mode switch 700 to the battery position shown in FIG. 32B, the battery 421 is partially released from the fastener driving device 400 to the partially engaged position as shown in FIG. 33B, the battery 421 being biased to the position shown by springs (shown in FIGS. 34A to 34C). The mode switch 700 itself, is also biased to the home position. Thus, upon releasing the mode switch 700 from the battery position shown in FIG. 32B, the mode switch 700 reverts to the default position as shown in FIG. 33B.

As explained in detail below, the fastener driving device 400 is also preferably implemented so that the battery 421 is electrically connected to the fastener driving device 400 to provide electrical power to the controller 429 and the motor 405 when the battery 421 is in the partially engaged position shown in FIG. 33B. In this regard, the fastener driving device 400 is implemented so that when the battery 421 is in the partially engaged position shown in FIG. 33B, a secondary detent of the battery 421 remains engaged as discussed in detail below so that this electrical connection is maintained. Furthermore, by requiring the user to place the mode switch 700 in a specific battery position, the controller 429 can be informed that the user may be about to remove the battery 421. Thus, the motor 405 can be operated in the reverse direction to position the carrier 442 in the home position to release the energy stored in the drive spring 403 as previously described.

Figure 33C:
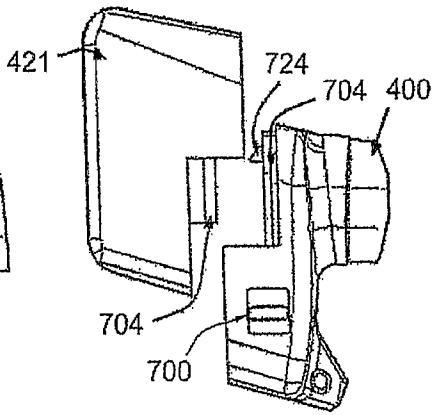
FIG. 33C is a side view of the mode switch and the battery removed.

From the partially engaged position shown in FIG. 33B, the battery 421 can be grasped and slid upwardly to overcome the secondary detent to electrically disengage the battery 421 from the fastener driving device 400 and to fully remove the battery 421 as shown in FIG. 33C. In this regard, the battery 421 of the illustrated embodiment of the fastener driving device 400 is provided with dove tails 702 that slidingly engage channels 704 in the manner described in further detail below. However, the mode switch 700 (and the latch described below) are preferably implemented so that the user must release the mode switch 700 so that it reverts back to the default position before the battery 421 can be fully removed from the fastener driving device 400.

Figure 34D:
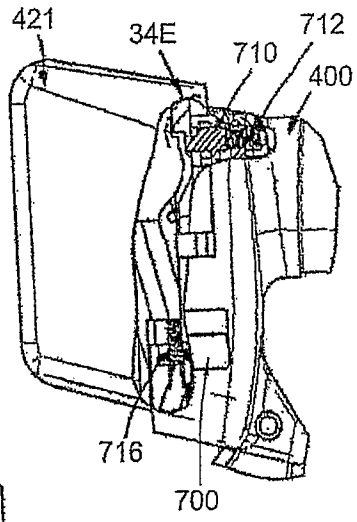
FIG. 34D is a partial cross sectional view of the fastener driving device with the mode switch being returned to the home position, and the latch engaging the secondary detent of the battery.
Figure 34C:
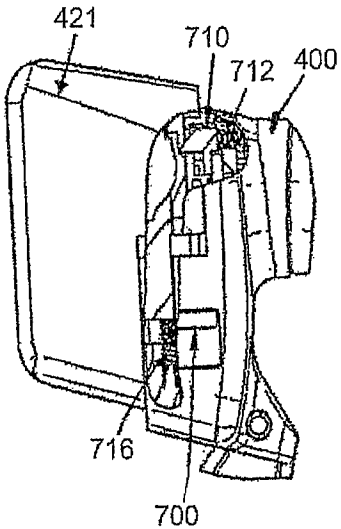
FIG. 34C is partial cross sectional view of the fastener driving device in the battery position, and the latch engaging a secondary detent of the battery.
Figure 34A:
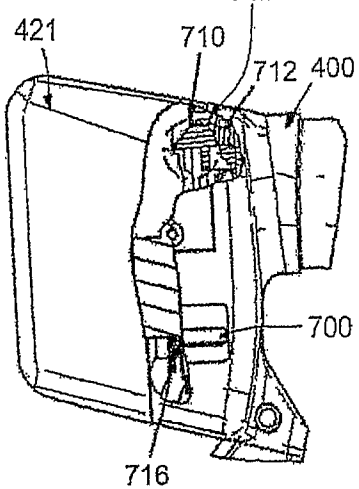
FIG. 34A is a partial cross sectional view of the mode switch with the battery fully engaged as shown in FIG. 33A, and a latch engaging a primary detent of the battery.
Figure 34E:
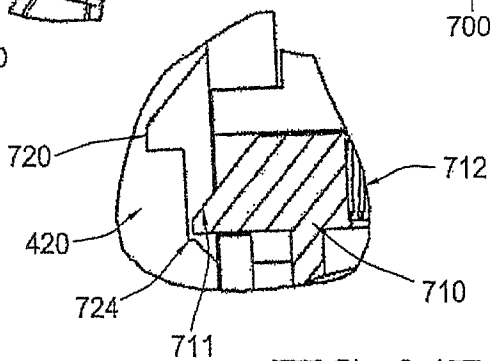
FIG. 34E is an enlarged cross sectional view of the latch engaging the secondary detent of the battery when the battery is in the partially engaged position.
Figure 34B:
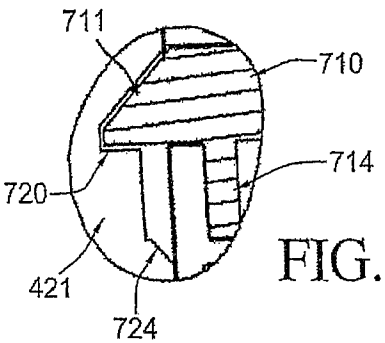
FIG. 34B is an enlarged cross sectional view of the latch engaging the primary detent of the battery.

Referring to FIGS. 34A and 34B, the fastener driving device 400 is provided with a latch 710 that is mechanically interconnected with the mode switch 700 via extension 714, only part of which is shown in these figures. The latch 710 engages with the primary detent 720 that is provided on the battery 421 when the battery 421 is fully engaged to the fastener driving device 400 as shown in FIG. 34A. In this regard, the latch 710 is provided with a ramp surface 711 for facilitating the re-engagement of the battery 421 onto the fastener driving device 400, the latch 710 being retractably biased toward engagement with the battery 421 by the spring 712.

When the mode switch 700 is moved to the battery position shown in FIG. 34C, the latch 710 is retracted away from the battery 421 in a direction against the bias of the spring 712 so that the latch 710 clears the primary detent 720. The battery spring 716 mounted to the fastener driving device 700 which is compressed when the battery 421 is fully engaged on the fastener driving device 700, now expands to displace the battery 421 to the partially engaged position shown in FIG. 34C. The mode switch 700 then retracts to the home position as described previously, and as shown in FIG. 34D. The latch 710 engages the secondary detent 724 of the battery 421 as most clearly shown in FIG. 34E. The battery spring 716 is implemented so that the battery 421 is not pushed with sufficient force for the latch 710 to become disengaged from the secondary detent 724. The battery 421 can then be grasped and with application of additional force by the user, slid upwardly to fully remove the battery 421 from the tool.

As previously noted, in the partially engaged position shown in FIGS. 34C and 34D, the electrical connection between the battery 421 and the components of the fastener driving device 700 is maintained. This maintained electrical connection allows the controller 429 to operate the motor 405 in the reverse direction to allow the carrier 442 to be returned to the home position from a pre-compressed position, and to ensure that the carrier 442 is in the home position, thus, releasing the energy stored in the drive spring 403.

In this regard, the controller 429 can be implemented to not only monitor the duration of the time in which the fastener driving device 400 is in the pre-compressed state as previously described, but can also monitor the position of the mode switch 700 so that if it is moved to the battery position which suggests the fastener driving device 400 may not be used for a while, the controller 429 drives the motor 405 in the reverse direction so as to position the carrier 442 and the driver 410 in the home position. As previously explained, such releasing of the energy in the drive spring 403 enhances the safety and durability of the fastener driving device 400 of the present invention.

FIGS. 35A and 35B illustrate an additional feature of a latch 730 operated by a mode switch 750. FIG. 35A shows the latch 730 engaging the secondary detent 724 that is provided on the battery 421, the battery 421 being shown in the partially engaged position. The latch 730 is biased by spring 712 to engage the detents of the battery 421, and the battery 421 is biased to the to the partially engaged position shown by the battery spring 716 in the manner previously described. However, the alternative embodiment shown in FIGS. 35A and 35B includes a battery lockout feature as described below.

In this regard, the latch 730 and a member 754 that is connected to the mode switch 750 interlock together when the mode switch 750 is moved to the battery position shown in FIG. 35A. This interlocking prevents the latch 730 from being retracted which would be required in order for the battery 421 to be fully removed. In the specific implementation shown, the distal end 756 of the member 754 extends into a pocket 734 that is provided on the latch 730 when the mode switch 750 is moved to the battery position, thereby interlocking these components so that the latch 730 cannot be retracted. As the mode switch 750 is released, it is biased to the home position as previously described. Correspondingly, the distal end 756 retracts, and is removed, from the pocket 734, thereby allowing the latch 730 to be retracted. Thus, with the mode switch 750 in the home position, the battery 421 can then be grasped, and with application of additional force by the user, slid upwardly to disengage the latch 730 from the battery 421 and allow full removal of the battery 421 from the tool.

Of course, any interlocking arrangement may be used in other implementations, and the present invention is not limited thereto the specific implementation shown and described above. The primary advantage of providing an interlocking feature is that it prevents quick removal of the battery 421 upon moving the mode switch 750 to the battery position, thereby ensuring that the battery 421 is still providing power to the fastener driving device 400 so that the carrier can be moved to the home position, and the spring energy can be substantially released as previously described to enhance safety and durability of the fastener driving device 400.

Figure 36:
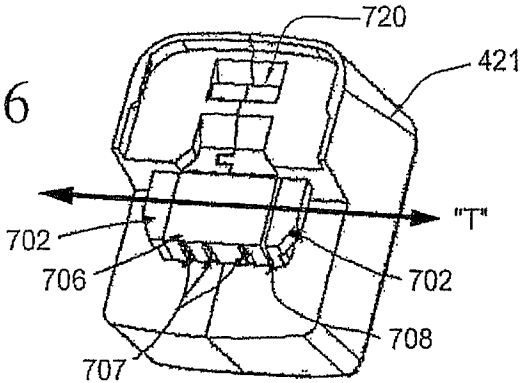
FIG. 36 is a perspective view of the battery in accordance with one example embodiment.
Figure 37B:
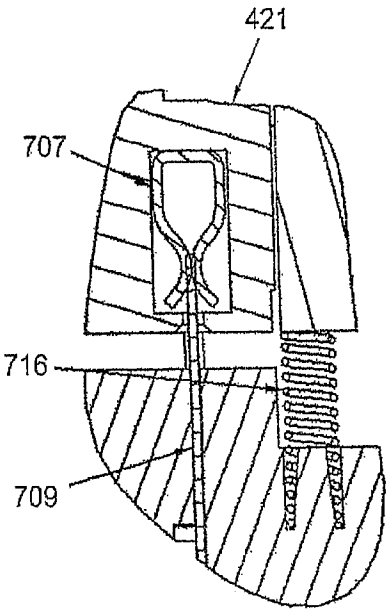
FIG. 37B is a partial cross sectional view of the electrical connection for the battery in the partially engaged position.
Figure 37A:
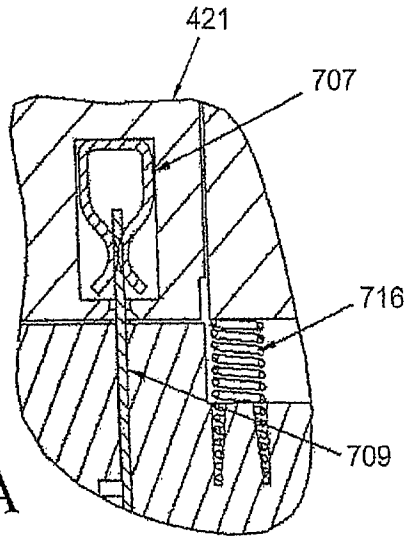
FIG. 37A is a partial cross sectional view of the electrical connection for the battery in the fully engaged position.

FIG. 36 is a perspective view of the battery 421 in accordance with one example embodiment. As can be seen, the battery is provided with dove tails 702 that engage the channels 704 shown in FIG. 33C as previously described. In addition, a connector terminal 706 with battery contacts 707 is provided for electrically connecting the battery 421 to the fastener driving device 400. In this regard, FIG. 37A is a partial cross sectional view of the electrical connection when the battery 421 in the fully engaged position. As can be seen, the battery contact 707 receives a tool contact 709 therein. Preferably, the battery contacts 707 and the tool contacts 709 are implemented so that they maintain electrical contact with each other even when the battery 421 has been moved to the partially engaged position by the battery spring 716 as shown in FIG. 37B so that the secondary detent is engaged as previously discussed. Again, this allows the motor 405 to be back driven (in a direction opposite the return direction) so as to decompress the drive spring 403 from the pre-compressed position if the user places the mode switch 700 in the battery release mode.

Figure 38B:
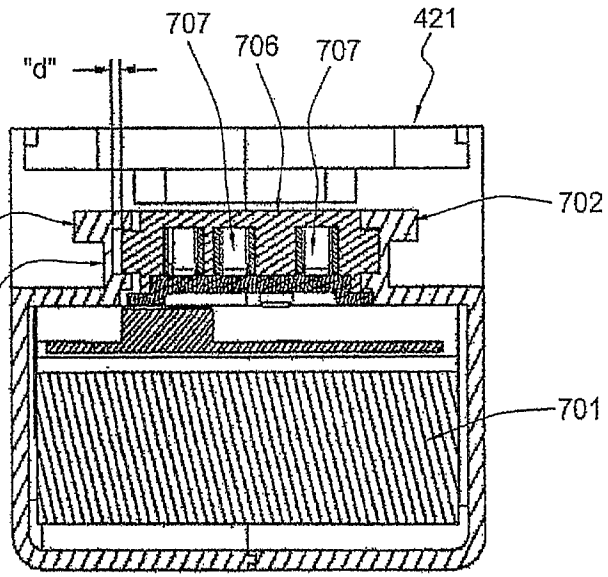
FIGS. 38A and 38B show cross sectional views of the battery and the connector terminal.
Figure 38A:
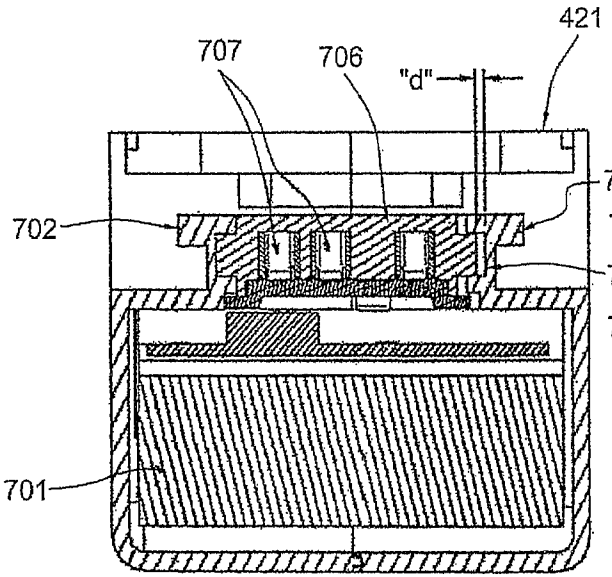

FIGS. 38A and 38B show a cross sectional view of the battery 421 and the connector terminal 706 discussed above. The battery includes a cell 701 that stores and releases electrical energy in any appropriate manner. In this regard, the cell 701 may be based on any appropriate technologies, for example, alkaline, nickel-cadmium, nickel metal hydride, lithium ion, fuel cells, etc. As can be seen, the connector terminal 706 is straddled between the dove tails 702, and is dimensioned slightly smaller than the distance between the dove tails 702, thereby forming a gap 708. This allows the connector terminal 706 to move slightly in the transverse direction shown by arrow "T" in FIG. 36. In particular, FIG. 38A shows the connector terminal 706 moved fully toward the left by distance "d", while FIG. 38A shows the connector terminal 706 moved fully toward the right by distance "d". This slight movement of the connector terminal 706 facilitates engagement of the tool contacts 709 with the battery contacts 707, thus, increasing durability of the electrical connection while also reducing manufacturing costs since highly precise alignment of the battery 421 and the channels 704 is not required. Of course, whereas the features of the battery 421 and the mode switch as described above relative to FIGS. 32A to 40B were in application to a fastener driving device, the present invention is not limited thereto, and these features may be applied to other power tools.

Referring again to FIG. 16, the controller 429 functions to receive user input to operate the fastener driving device 400 in the manner described above including the compression and release of the drive spring 403. In the preferred implementation, the controller 429 includes a processor that is mounted on a circuit board, and is programmed to control the fastener driving device 400 in the manner described. In this regard, the controller 429 is preferably shock mounted to help in attenuating the impact forces, and to allow economical electronic components to be used. In particular, the controller 429 is preferably implemented with solid state MOSFETs or relays to control the power to motor. Solid state MOSFETs are preferred because relays typically have spring biased contact elements that can be effected by shock loads (i.e. contact bounce/arcing) which can lead to diminished cycle life and/or increased resistance thru the relay. However, in general, hi-performance MOSFETs are more expensive than relays. Nonetheless, by shock mounting the controller 429, adequate isolation can be attained so that relay can be used for the controller 429 with minimal impact to performance if desired.

In addition, the controller 429 in the preferred embodiment may be implemented with timers that enable the various functions of the fastener driving device 400 described above, and enhance safety of the fastener driving device 400. In this regard, a pre-compression inactivity timer may be implemented to measures how long the carrier 442 is in the pre-compression position, and has not been activated. Upon reaching a time limit, the controller 429 can reverse the motor 405 to lower the carrier 442 to the home position as previously described, and further monitor bow long it takes for the carrier 442 to reach the home position. If a predetermined time limit is exceeded, a fault condition can be indicated. The controller 429 can also be implemented to place the fastener driving device 400 in a low power-consumption sleep mode where the sensors and/or other components may be de-energized if the allowed inactivity time is exceeded. This sleep mode can also be initiated by the controller if there is low battery charge. In addition, the controller 429 may be implemented with timers to monitor the time required to recover from a sleep mode or upon insertion of the battery 421 so that an error is indicated if coupler mechanism 440 is not initially engaged within a predetermined amount of time.

Furthermore, a nail drive timer may be provided to detect a jam condition. In particular, if the carrier 442 has left the pre-compression position to drive a fastener as detected by sensor 424, but has not reached the home position in a predetermined amount of time as detected by sensor 422, a jam is presumed to have occurred by the controller 429, and optional LEDs or other display device indicating a fault can be activated to inform the user. Of course, other LEDs may be provided an used for various purposes, such as providing light to the work area around the nose 419, well as to give the user feedback on the tool condition including the noted jam, internal fault, low battery, etc.

A trigger/trip timer may also be implemented in the controller 429 to determine if the user is holding the trigger 426 or the trip 425 on while not driving a nail, or determine if either of these components are stuck in the on position which is a hazard if the fastener driving device 400 is in the bump mode. Thus, upon exceeding a predetermined time period, the controller 429 can be implemented to de-activate the fastener driving device 400, such de-activation requiring the user to reset the device by toggling the trigger 426 on and off, or other action. Moreover, the controller 429 may be implemented with timers to perform diagnostics on the operation of the fastener driving device 400. For instance, a pre-compression timer may be provided to monitor the time required for the carrier 442 to move from the home position to the pre-compression position. If this time exceeds a predetermined limit, this can indicate some malfunction in the fastener driving device 400 including slippage or non-engagement of the coupler mechanism 440, indicate problems with the battery 421, or other problems with the motor 405 and/or gear train 404.

Of course, the controller 429 may also be implemented to monitor the voltage of the battery 421, and place the fastener driving device 400 in a sleep mode if the voltage is below a predetermined limit. Moreover, the current draw of the motor 405 can be monitored to ensure that a stall condition does not exist. If the current spikes and remains at an elevated level, the operation of the motor 405 can be terminated to avoid damaging the motor 405.

Figure 32C:
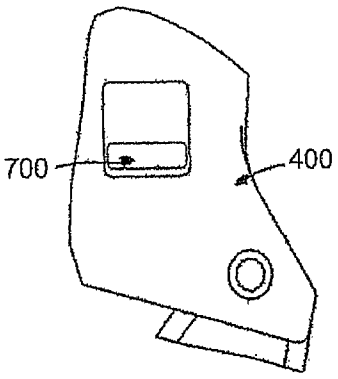
FIG. 32C is a side perspective view of the mode switch of FIG. 32A in the bump mode.
Figure 32B:
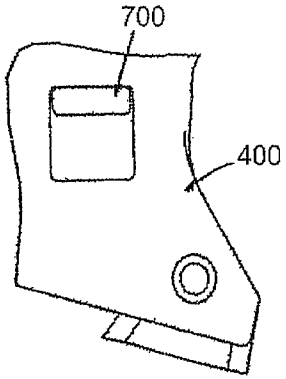
FIG. 32B is a side perspective view of the mode switch of FIG. 32A in a battery position.
Figure 32A:
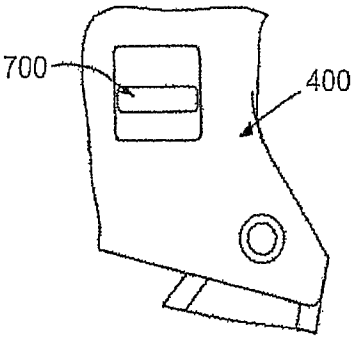
FIG. 32A is a side perspective view of a mode switch in accordance with one embodiment of the present invention, the mode switch being in the home position.
Figure 33B:
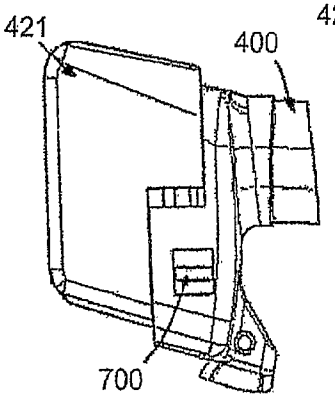
FIG. 33B is a side view of the mode switch and the battery in a partially engaged position.
Figure 33A:
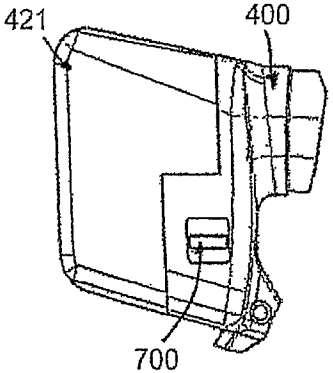
FIG. 33A is a side view of the mode switch and a battery fully engaged.

As also explained, the mode switch 700 shown in FIGS. 32A to 32C discussed above allows the user to select the manner in which the fastener driving device 400 is to be used, for instance, in a sequential mode, bump fire mode, and for installation or release of the battery 421. However, in other embodiments, the controller 429 can be implemented so that a mode switch 700 is not required. For instance, the controller 429 may be implemented so that the sequence of operation of the trip 425 and the trigger 426 determines the mode of operation of the fastener driving device 400. In particular, actuation of the trigger 426 first implies that the user likely intends to use the fastener driving device 400 in a bump mode. Conversely, actuation of the trip 245 first implies that the user likely intends to use the fastener driving device 400 in sequential mode. Of course, in yet other implementations, sequence of operation could be implemented mechanically in a manner similar to pneumatic tools so that a mode switch would not be provided or required. The sensor that monitors the trip 425 can be eliminated and mechanical linkage that interacts mechanically with the trigger switch can be used.

Figure 39:
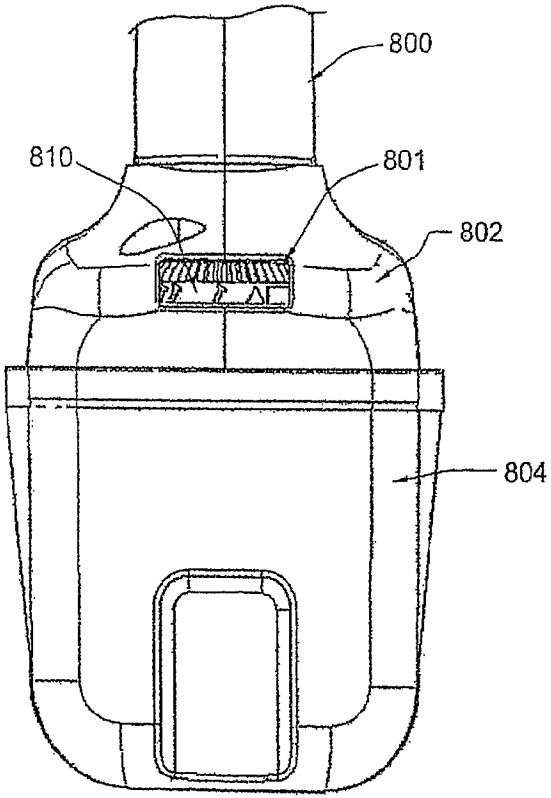
FIG. 39 is a top view of a mode switch and a battery of a fastener driving device in accordance with another embodiment.

FIG. 39 is a top view of a small portion of a fastener driving device 800 that is provided with a battery 804 and a mode switch 810 in accordance with another embodiment. Only the distinguishing portions of the fastener driving device 800 is shown for clarity. As can be seen, the mode switch 810 is implemented as a rotary member that can be turned by the user through a window 801 provided in the housing 802 to select between the various operational modes of the fastener driving device 800, including sequential mode, bump mode and battery release mode.

Figure 40A:
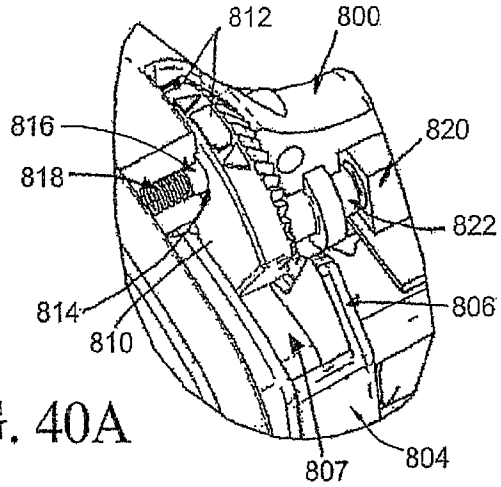
FIG. 40A is a partial perspective view of the fastener driving device with the mode switch in the battery position.

FIG. 40A is a partial perspective view of the fastener driving device 800 with the mode switch 810 in the battery position with a portion of the housing removed for clarity. In this respect, the mode switch 810 includes a plurality of symbols 812 that indicate the position of the mode switch 810, and detents 814 that correspond to these positions. The detents 814 are engaged by a ball 816 that is biased by spring 818 so as to provide a positive "click" and feedback to the user as to proper positioning of the mode switch 810. In addition, in the illustrated embodiment, the mode switch 810 is mechanically connected to a rotary switch 820 via a shaft 822. The rotary switch 820 is electrically connected to the controller (not shown) of the fastener driving device 800 so that the controller can control the fastener driving device 800 in the manner desired by the user.

Figure 40B:
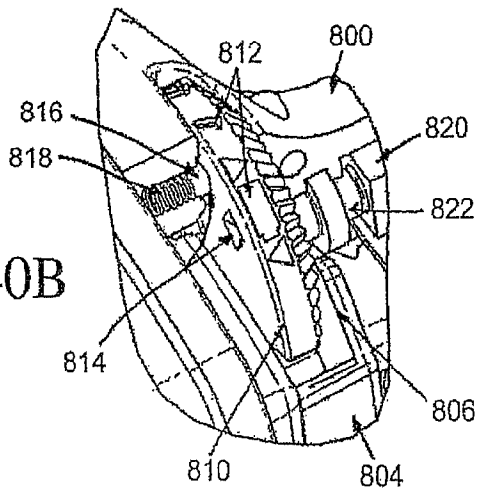
FIG. 40B is a partial perspective view of the fastener driving device with the mode switch in the sequential mode.

As shown in FIG. 40A, the battery 804 of the illustrated embodiment is further provided with a flange 806 that defines a switch pocket 807 in the battery 804. When the mode switch 810 in the battery position, the mode switch 810 is outside of the switch pocket as shown in FIG. 40A. The battery 804 can be removed without interference from the flange 806. However, when the mode switch 810 is rotated by the user to be in the operation mode, such as the sequential mode as shown in FIG. 40B or the bump mode, a least a portion of the mode switch 810 is received within the switch pocket 807. Correspondingly, the mode switch 810 prevents the battery 804 from being removed until the mode switch is 810 is moved to the battery position. As previously described, this allows the controller of the fastener driving device 800 to reverse drive the motor and position the carrier in the home position to thereby release the energy stored in the drive spring before the battery is removed.

Figure 41A:
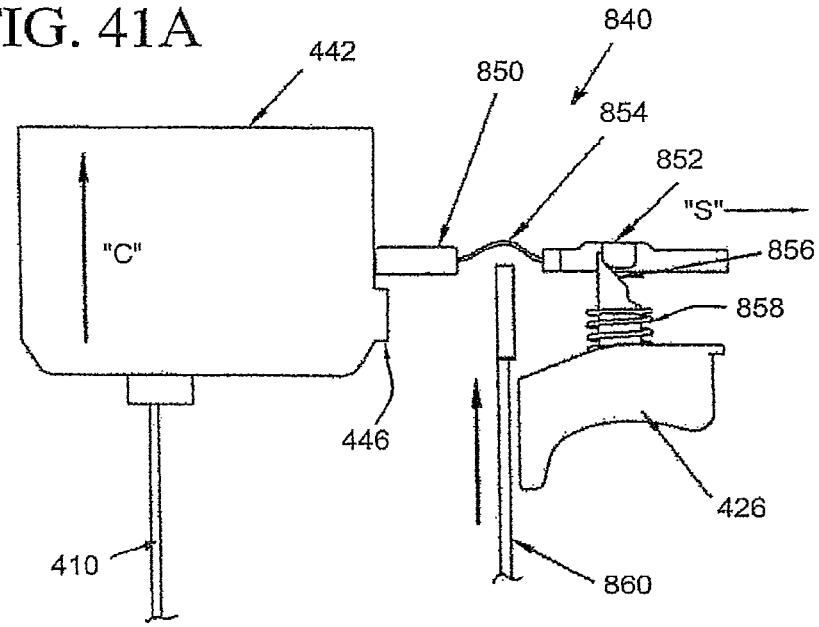
FIG. 41A is a schematic illustration of a safety interlock mechanism in accordance with one embodiment of the present invention.

As noted above in discussion related to FIG. 20, the carrier 442 may be provided with a safety block 446 which can be engaged by optional safety interlock mechanism to prevent unintentional displacement of the carrier 442. In this regard, FIG. 41A is a schematic illustration of such a safety interlock mechanism 840 in accordance with one embodiment of the present invention. The safety interlock mechanism 840 is illustrated as being implemented on a fastener driving tool such as described above relative to FIG. 16 where the carrier 442 is moved to a pre-compressed position. Thus, as previously explained, the carrier 442 need only be moved slightly further to complete the return stroke, at which time, upon actuation of a trip (not shown) and trigger 426, the carrier 442 can be moved through the drive stroke in which the driver 410 drives a fastener into a workpiece.

In the illustrated implementation, the interlock mechanism 840 uses the safety block 446 that is provided on the carrier 442 to prevent the carrier 442 from unintentionally completing its return stroke to initiate its drive stroke. In this regard, the interlock mechanism 840 includes a movable locking bar 850 that is biased to prevent the movement of the carrier 442 by blocking the return travel path of the safety block 446 as shown in FIG. 41A, thereby blocking the completion of the return stroke (in direction of arrow "C") by the carrier 442. The locking bar 850 may be biased in any appropriate manner, such as by a spring (not shown). The locking bar 850 is interconnected to a trigger interface 852 by a connecting wire 854. The trigger interface 852 engages a cam surface 856 of the trigger 426 which is biased by spring 858 to the unactuated position shown in FIG. 41A. In addition, the trip (not shown) of the fastener driving device is connected to the trip member 860 so that when the trip is actuated, the trip member 860 is displaced upwardly in the direction of arrow "C" in the present implementation to contact the connecting wire 854.

Figure 41B:
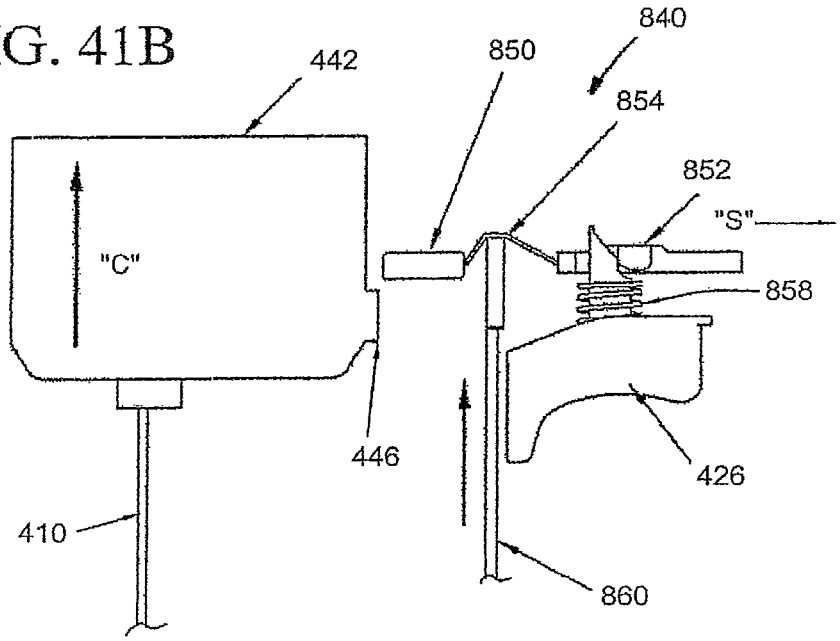
FIG. 41B is a schematic illustration of the safety interlock mechanism of FIG. 41A with both the trip and the trigger actuated.

The length of the connecting wire 854 is such that both the trigger 426 and the trip must be actuated in order for the locking bar to be retracted sufficiently in the direction of arrow "S" against the biasing force so that return travel path of the safety block 446 is no longer impeded by the locking bar 850, and the carrier 442 can complete its return stroke to initiate its drive stroke. In this regard, FIG. 41B shows the safety interlock mechanism 840 when both the trip and the trigger 426 is actuated. As can be seen, the trip member 860 is displaced upwardly in the direction of arrow "C" to contact the connecting wire 854, and displace a portion thereof upwardly. Correspondingly, the effective length of the connecting wire 854 in the direction of arrow "S" has been shortened by the trip member 860 so that the distance between the locking bar 850 and the trigger interface 852 is shortened.

In addition, actuation of the trigger 426 causes the cam surface 856 to engage the trigger interface 852, thereby moving the trigger interface 852 in the direction of arrow "S". The locking bar 850 is also correspondingly moved in the direction of arrow "S" since it is connected to the trigger interface 852 by the connecting wire 854. The combination of effective shortening of the length of the connecting wire 854 in the direction of arrow "S" by the trip member 860, and the lateral displacement of the trigger interface 852 (and thus, the locking bar 850), moves the locking bar 850 sufficiently in the direction "S" so that it clears the return travel path of the safety block 446 as shown in FIG. 41B. Thus, the carrier 442 can complete its return stroke to initiate its drive stroke. In the illustrated implementation, the order in which the trigger 426 and the trip are actuated does not impact the retraction of the locking bar 850.

The connecting wire 854 is dimensioned such that individual actuation of either the trigger 426 or the trip alone, is insufficient to displace the locking bar 850 to clear the return path of the safety block 446. Correspondingly, the interlock mechanism 840 can be used to prevent unintentional displacement of the carrier 442, and to require actuation of both the trigger 426 and the trip in order for the carrier 442 to complete its return stroke. As can be appreciated, the interlock mechanism 840 enhances the safety of the fastener driving device to prevent driving of a fastener if, for example, the controller malfunctions and undesirably moves the carrier 442 through the full return stroke. Moreover, this functionality can be attained using a single, light weight, and compact interlock mechanism rather than having separate mechanisms for the trigger and the trip which adds to tool weight and cost. Of course, the interlock mechanism 840 may be implemented differently in other embodiments. For instance, the carrier may be provided with a pocket that is engaged by a pivoting member that swings into the pocket to prevent movement of the carrier.

Figure 42:
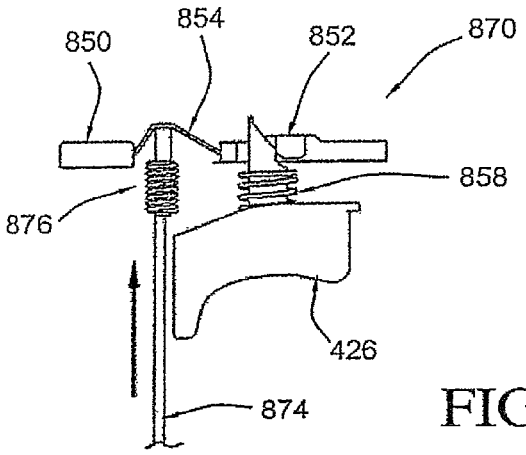
FIG. 42 is a schematic illustration of a safety interlock mechanism in accordance with another embodiment.

FIG. 42 is a schematic illustration of a safety interlock mechanism 870 in accordance with another embodiment. The interlock mechanism 870 is substantially similar to the embodiment described relative to FIGS. 41A and 41B, except that the trip member 874 is implemented with a compliant member, which in the illustrated implementation, is a spring 876 that can compress. The spring 876 effectively limits the extent to which the locking bar 850 can be retracted so that further actuation of the trip and/or trigger 426 after the full retraction of the locking bar 850 merely results in the compression of the spring 876. Correspondingly, providing such a compliant member reduces the likelihood of jamming when the trigger 426 and/or trip (and correspondingly, the trip member 874) are subjected to additional displacement beyond that required for actuation.

Figure 43:
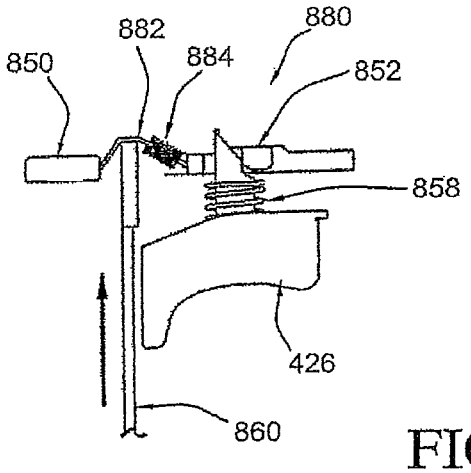
FIG. 43 is a schematic illustration of a safety interlock mechanism in accordance with still another embodiment.

FIG. 43 is a schematic illustration of a safety interlock mechanism 880 in accordance with still another embodiment that incorporates a compliant member like the embodiment of FIG. 42. The interlock mechanism 880 differs in that the connecting wire 882 is provided with a spring 884 that can expand in length. Thus, upon further actuation of the trip and/or trigger 426 after the full retraction of the locking bar 850, the spring 884 expands, and effectively limits the extent to which the locking bar 850 can be retracted.

Figure 44B:
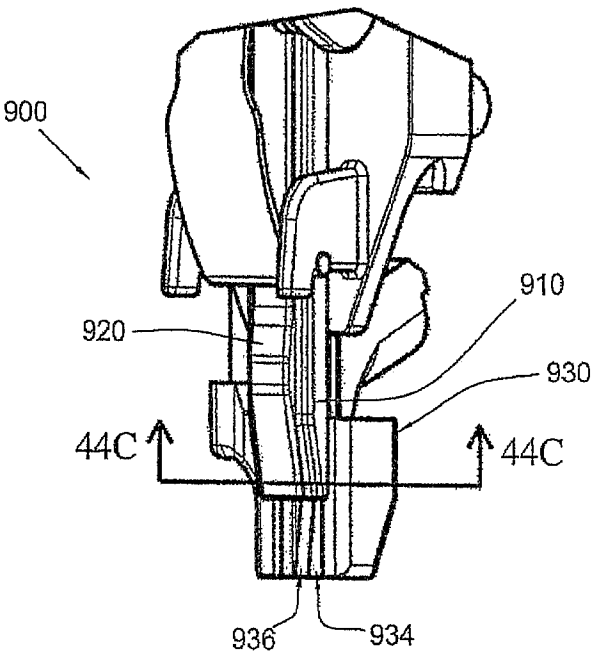
FIG. 44B is a perspective view of the nose/trip assembly of FIG. 44A.
Figure 44A:
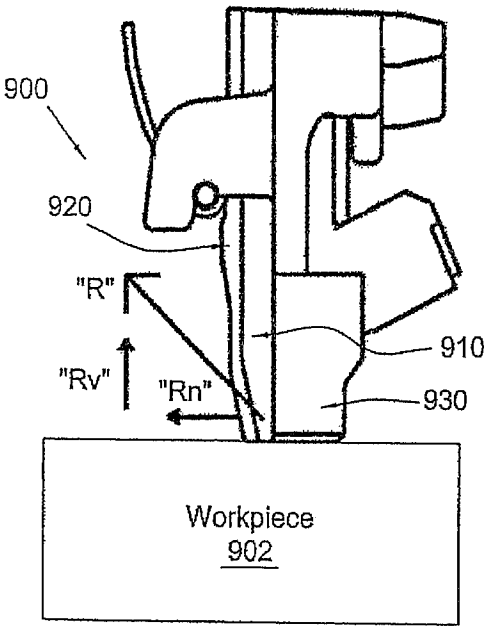
FIG. 44A is a side profile view of a nose/trip assembly in accordance with one embodiment of the present invention.

FIGS. 44A to 44E show various views of a nose/trip assembly 900 in accordance with one embodiment of the present invention which can be advantageously used with the various fastener driving devices discussed above. The nose/trip assembly 900 of the illustrated embodiment includes a nose 910, nose door 920, and a trip 930. FIG. 44A shows the trip 930 actuated, and FIG. 44B shows the trip 430 unactuated. The trip 930 is biased to extend beyond the nose 920 as shown in FIG. 44B. Thus, as can be seen by comparing FIGS. 44A and 44B, when the trip 930 is actuated, it is vertically displaced relative to the nose 910 in the manner known.

FIG. 44A illustrates a side profile view of the nose/trip assembly 900 being used to drive a fastener into a workpiece 902, and the resultant recoil force which acts in the direction of arrow "R". As can be seen, the recoil has both a vertical component in the direction of arrow "Rv", and a horizontal component in the direction of arrow "Rh". These components of the recoil impact the drive quality differently, i.e. the quality with which the tool can drive a fastener into a workpiece.

As previously noted, the vertical recoil is commonly accounted for with additional driver extension beyond the end of the nose. The horizontal recoil component tends to cause the driver of the tool to slip off the head of the fastener prior to completing the drive stroke, and can cause only partial driving (incomplete) driving of the fastener into the workpiece. Consequently, the horizontal component of recoil has a larger negative impact on drive quality that the vertical component. As explained herein, the nose/trip assembly 900 is implemented with features that diminish the negative effects of the horizontal component of recoil as a fastener is being driven into a workpiece.

Figure 44E:
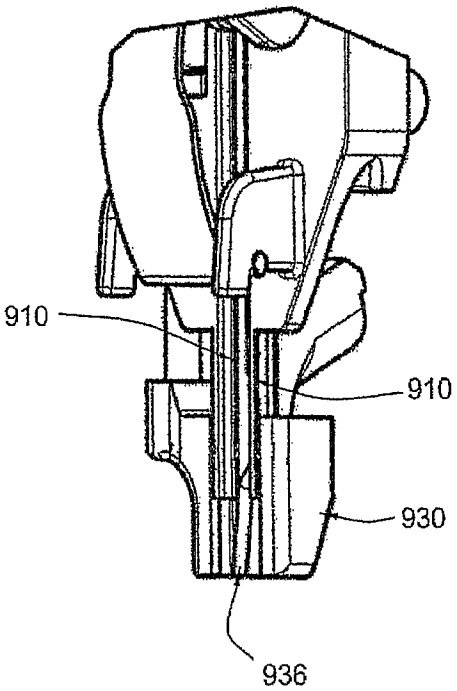
FIG. 44E is a perspective view of the nose/tip assembly of FIG. 44A with the door removed.
Figure 44D:
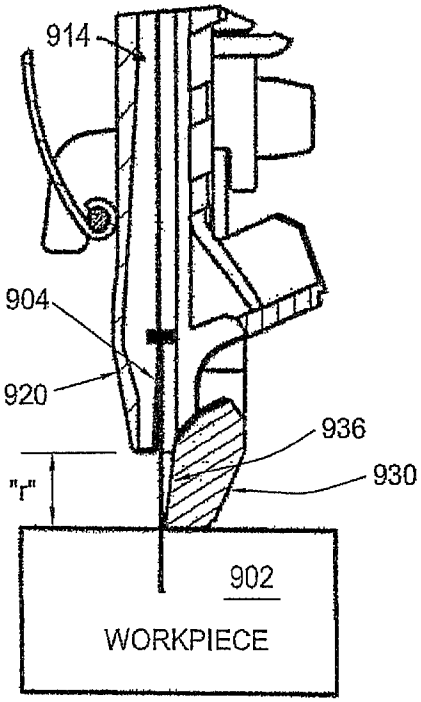
FIG. 44D is a cross sectional, side profile view of the nose/trip assembly of FIG. 44A.
Figure 44C:
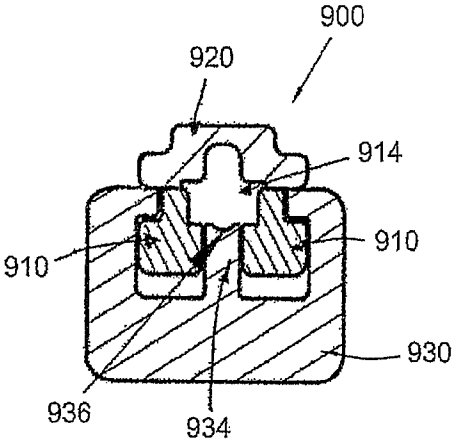
FIG. 44C is a cross sectional view of the nose/trip assembly of FIG. 44A as viewed along 44C-44C.

Referring to the cross sectional view of FIG. 44C, the nose 910 defines a drive channel 914 through which a driver (not shown) drives a fastener, the nose door 920 enclosing the drive channel 914. The nose door 920 can be pivoted and removed as shown in FIG. 44E. As can be appreciated from FIGS. 44C and 44E, the nose 910 and the trip 930 of the nose/trip assembly 900 in accordance with the present invention differs from conventional assemblies in that the nose 910 is forked so as to have two prongs, and the trip 930 includes a land 934 that is positioned between the forks of the nose 910. Furthermore, as most clearly shown in FIG. 44C, the land 934 includes a curved contact surface 936 for contacting the shank of the fastener being driven. The contact surface 936 is angled from the vertical nose 910 as clearly shown in the cross sectional view of FIG. 44D as well as the perspective views of FIGS. 44B and 44E. As explained below, the land 934 functions to guide the fastener as it is being driven into the workpiece, and limits the horizontal movement of the fastener driving device due to recoil.

In particular, the cross sectional view of FIG. 44D shows the nose/trip assembly 900 immediately after actuation of the drive sequence shown in FIG. 44A, and during the course of the drive stroke in which fastener 904 is being driven into the workpiece 902. The fastener 904 being driven in the illustrated example use of the invention is a nail, but may be other types of fasteners in other example uses. The nose has been moved vertically by a distance "r" off of the workpiece due to the vertical component of the recoil. However, by the time such vertical movement occurs, the fastener 904 has been already partially driven into the workpiece 902 as shown by the driver (not shown) of the fastener driving device. In addition, the trip 930 remains in contact with the workpiece 902 longer than the nose 920 during recoil since it is biased to extend beyond the nose 920. During recoil, as the fastener driving device is moved in the horizontal direction by the horizontal component of recoil, the contact surface 936 of the land 934 abuts against the shank of the partially driven fastener 904. Thus, the partially driven fastener 904 obstructs further movement of the fastener driving device in the horizontal direction. Correspondingly, the driver maintains its engagement with the head of the fastener 904, and does not slip off therefrom so that the fastener 904 is continued to be driven into the workpiece 902 as the driver continues its drive stroke in the drive channel 914.

In addition, as can also be seen by careful examination of FIG. 44D, the land 934 and its contact surface 936 are angled and extends into the drive channel 914. The angling of the contact surface 936 and extending it into the drive channel 914 ensures that the shank of the fastener 904 is already in contact with the contact surface 936 of the trip 930 before the fastener penetrates the workpiece 902, or is very close to contacting the contact surface 936 so that such contact is quickly made during the drive stroke with the slightest movement in the horizontal direction due to the horizontal component of recoil. It should also be noted that such angling can be implemented within the guide surfaces of the nose as well in order to allow the fastener to penetrate the workpiece as far forward (toward the nose door) as practicable. In such an implementation, the slight forward movement of the fastener driver tool due to the horizontal component of recoil acts to move the driver toward the central axis of the fastener being driven.

It should be evident from the above that the trip 930 of the illustrated embodiment serves to guide the fastener as well since a portion of the drive channel 914 is defined by the contact surface 934 of the trip 930. However, as clearly shown in FIG. 44C, the trip 930 is wrapped around the nose 910, and only a small portion of the drive channel 914 is defined by the contact surface 934 of the trip 930. Thus, the force applied by the fastener to the trip 930 as the fastener is driven is minimized, and primarily borne by the prongs of the nose 910 which is structurally more rigid than the trip 930 since it does not move. Such implementation also minimizes the breaks in the drive channel 914 of the nose/trip assembly 900 that can create catch junctions for the fastener. Correspondingly, the likelihood of jams occurring is decreased. In addition, the profile of the trip 930 wrapped around the nose 910 is very small and is desirable in that it allows activation of the trip 930 at large tool angles relative to the workpiece. In addition, the small size allows better access to tight areas, and provides the user with a smaller area in which to gauge where the fastener will be driven in the workpiece.

Figure 54C:
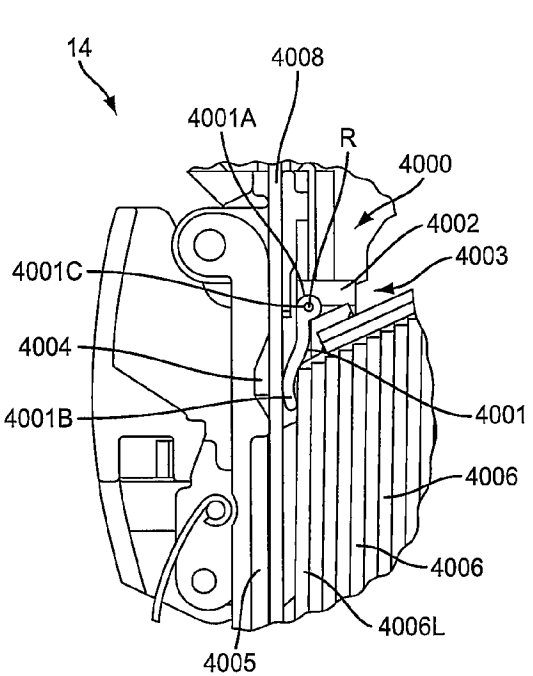
FIG. 54C is a cross sectional view of the safety device of FIG. 54A.
Figure 54B:
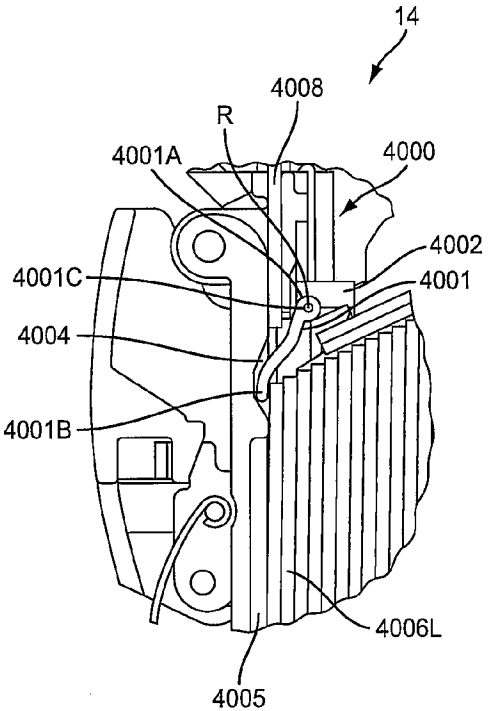
FIG. 54B is a cross sectional view of the safety device of FIG. 54A.
Figure 54A:
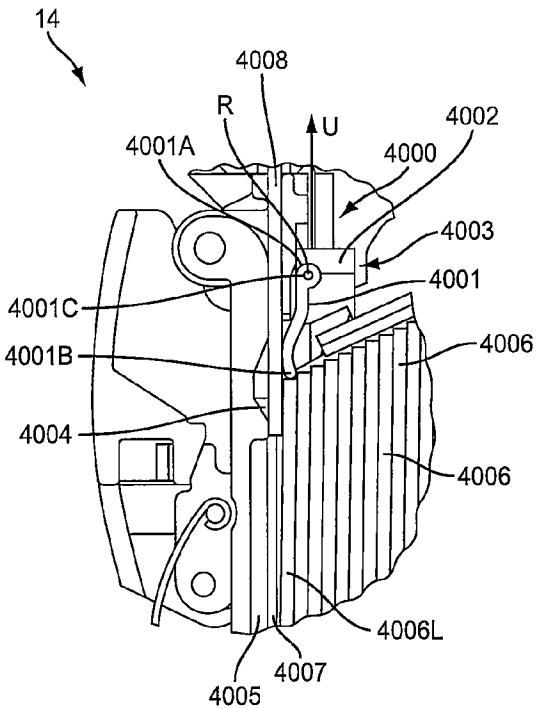
FIG. 54A is a cross sectional view of an embodiment of a safety device for use with the fastener driving device of the present invention.

FIGS. 54A to 54C are cross-sectional views of a nose assembly of a fastener driving device, according to an embodiment of the present invention. As depicted in FIGS. 54A to 54C, in one embodiment, the nose assembly 14 of the fastener driving device 10 includes a fastener lockout device 4000 that includes an elongated member 4001, which may be in the form of a lever. The elongated member 4001 is mounted to a segment 4002 of a contact trip assembly 4003 in a manner that allows the elongated member 4001 to pivot relative to the segment 4002. In an embodiment, the elongated member 4001 has a round extremity 4001A and a curved or arcuate opposite extremity 4001B. The round extremity 4001A may have an opening 40010C adapted to receive a fastener (not shown) for mounting the elongated member 4001 to the segment 4002 of the contact trip assembly 4003.

In an embodiment, the extremity 4001A of the elongated member 4001 can be mounted to the segment 4002 while the opposite extremity 4001B is free to move. The elongated member 4001 may be spring loaded and biased to pivot around an axis R (perpendicular to the page). In an embodiment, the extremity 4001A may be rotatably mounted to the segment 4002. In this embodiment, a resilient member (not shown) can be used to apply a force on the elongated member 4001, for example, to apply a force on the extremity 4001B, to pivot the elongated member 4001 around the axis R so as to bring the opposite extremity 4001B in a recess 4004 formed in a guiding member 4005 configured to guide a lead fastener 4006L, of a plurality of fasteners 4006, within the drive track 4007. The drive track 4007 is constructed and arranged to receive the plurality of fasteners 4006 one-by-one from a magazine (not shown) so they may be driven one-by-one into a workpiece (not shown) by a driver 4008.

In an embodiment, the elongated member 4001 may include a spring portion. In this case, the extremity 4001A of the elongated member 4001 can be fixedly attached to the segment 4002 while the opposite extremity 4001B of the elongated member 4001 is allowed to pivot under a torque force exerted from the torsion of the spring portion of the elongated member 4001. In an embodiment, the elongated member 4001 may be made from a resilient material enabling the elongated member 4001 to bend when a force is applied on its extremity 4001B and to return to its initial extended configuration where no force is exerted on its extremity 4001B.

During normal operation, when the trip mechanism 4003 is depressed in contact with a workpiece (not shown), the segment 4002 of the contact trip assembly 4003 moves in the direction U as indicated in FIG. 54A. Hence, the extremity 4001A of the lever 4001 moves upwardly with the segment 4002. As a result, the extremity 4001B of the lever 4001 moves out of the way of the head of the lead fastener 4006L. The head of the lead fastener 4006L is urged into the drive track 4007 and becomes exposed to the fastener driving element 4008. In this configuration, if the trigger 38 (shown in FIGS. 1 and 2) is actuated, the fastener driving element 4008 can strike the lead fastener 4006L to discharge the lead fastener 4006L. By repeating this operation, the plurality of fasteners 4006 can be driven one-by-one into the workpiece.

When the contact trip assembly 4003 is not depressed, the segment 4002 of the trip assembly 4003 does not move, as depicted in FIG. 54B. Hence, the extremity 4001A of elongated member 4001 does not move and the extremity 4001B remains lodged in the recess 4004. As a result, the elongated member 4001 remains extended across the drive track 4007. If the driver 4008 is accidentally actuated, the driver 4008 will strike the elongated member 4001 and urge the elongated member 4001 to pivot counterclockwise and move out of the way of the driver 4008 in the drive track 4007, as depicted in FIG. 54C. Because the extremity 4001B of the elongated member 4001 abuts the head of the lead fastener 4006L in the drive track 4007, the pivoting of the elongated member 4001 will result in the head of lead fastener 4006L, which was initially in the drive track 4007, to move with the extremity 4001B out of the way of the driver 4008. As a result, the lead fastener 4006L will not be driven even if the driver 4008 is accidentally actuated, i.e., the fastener driving device will dry fire.

In other words, if the driver 4008 is brought to a position in which a distal end of the driver 4008 is above the head of the lead fastener 4006L, as shown in FIG. 54B, without the contact trip 4003 being depressed, the elongated member 4001 will move into position into the drive track 4007 and rest its extremity 4001B against the head of the lead fastener 4006L. If the driver 4008 is accidently actuated without the contact trip 4003 being depressed, the driver 4008 will strike the elongated member 4001 and will push the elongated member 4001 along with the head of the lead fastener 4006L out of the driver track in a direction towards the magazine. Thus, the lead fastener 4006L will not be discharged from the fastener driving device.

By using the fastener lockout device 4000 according to embodiments of the invention, the head of the lead fastener 4006L will only be presented to the driver 4008 when the contact trip 4003 is depressed. Otherwise, the fastener lockout device 4000 (specifically the elongated member 4001), will keep the driver 4008 from contacting the head of the lead fastener 4006.

The fastener lockout device 4000 described above can be used in any type of fastener driving device including fastener driving devices using compressed air or gas-type, flywheel-type, chemical-type, or any other stored energy fastener driving device.

Figure 55:
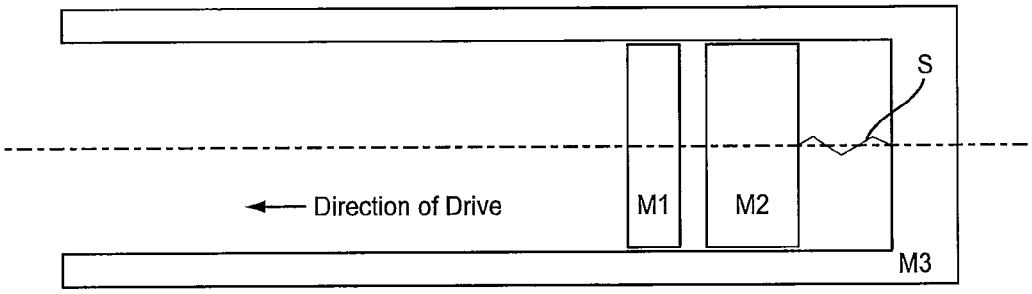
FIG. 55 is a schematic representation of a common recoil suppression mechanism.

FIG. 55 is a schematic representation of a recoil suppression device. The device includes a driver M1, counter mass M2, tool M3 and a spring S. In a fastening tool, an impulsive force would be introduced between the driver and the counter mass M2 of FIG. 55 to act against the driver mass M1. In so doing, M1, M2, spring S, and the tool M3 act as a traditional spring mass system, the response of which is well known, and the overall displacement (recoil) of M3 would be delayed and reduced. The impulsive force is typically created by introducing high pressure gases into the chamber, e.g. pneumatic or combustion, or by other means, such as pre-compressing and releasing a mechanical or gas spring. Pneumatic or combustion fastening tools introduce energized gases into the chamber very quickly, but pre-compressing a mechanical or gas spring takes a significant amount of time and the pre-compression force would fully bias counter mass M2 and compress spring S prior to the drive stroke, rendering it ineffective for use in recoil suppression. In addition, a mechanical spring has about 3-orders of magnitude more mass than a gas spring, or the gasses used in a pneumatic or combustion impulse devices, and dynamically one third of the spring mass should be included as part of the system's moving mass. Also, it would be beneficial to partially compress the drive spring and hold it in position prior to the actual drive. An additional problem arises due to the unfavorable geometry constraints in that the center of force of the drive spring is further away from the tool center of gravity, causing a greater degree of rotational motion. This in turn causes some of the drive energy to be misdirected from the direction of drive as noted hereinabove.

Figure 56:
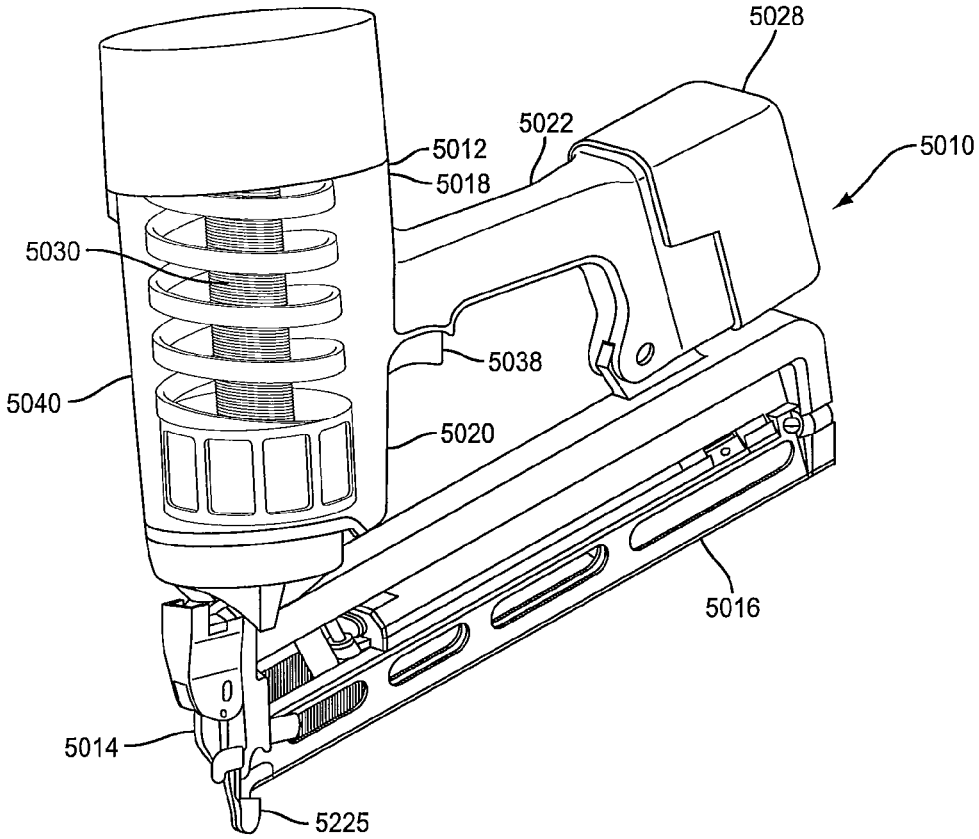
FIG. 56 is a perspective view of a spring powered fastener driving device which incorporates the recoil suppression device of the present invention.

As illustrated in FIG. 56, the fastener driving device 5010 according to the present invention includes a housing assembly 5012, a nose assembly 5014, and a magazine 5016 that is operatively connected to the nose assembly 5014 and is supported by the housing assembly 5012. The device 5010 also includes a power operated system 5018 that is constructed and arranged to drive fasteners that are supplied by the magazine 5016 into a workpiece. The housing assembly 5012 includes a main body portion 5020, and a handle portion 5022 that extends away from the main body portion 5020, as shown in FIG. 56. The portion of the main body portion 5020 is translucent in FIG. 56 so that features contained within the main body portion 5020 may be viewed. Such a translucent body is generally not used in the field. The handle portion 5022 is configured to be gripped by the user of the fastener driving device 5010.

The nose assembly 5014 is connected to the main body portion 5020 of the housing assembly 5012. The nose assembly 5014 defines a drive track (not shown) that is configured to receive a fastener driver. The drive track is constructed and arranged to receive fasteners from the magazine 5016 so that they may be driven, one by one, into the workpiece by the power operated system 5018, as will be discussed in further detail below. In the illustrated embodiment, the power operated system 5018 includes a power source 5028, a motor, a reduction gear box connected to the motor, a lead screw or threaded shaft 5030 that is operatively connected to the motor via the gear box, a coupler mechanism, a trigger 5038, and a drive spring 5040. Details of the power operated system are set forth hereinbelow.

As shown in FIG. 56, the power source 5028 is a battery, although the illustrated embodiment is not intended to be limited in any way. It is contemplated that other types of power sources may be used for powering the motor. For example, it is contemplated that the motor may be electrically operated with a power cord connected to an outlet. In addition, a fuel cell may be utilized to allow the fastener driving device to be portably implemented. Of course, these are examples only, and the power source may be implemented differently without departing from the spirit and scope of the present invention.

Figure 57:
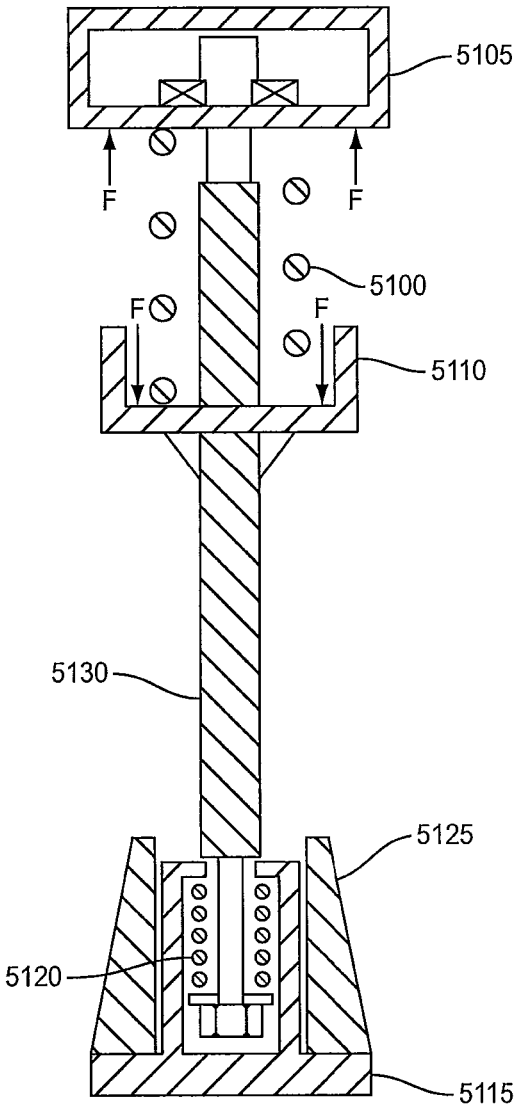
FIG. 57 is a schematic representation of the recoil suppression device of the present invention.

With reference to FIG. 57, the concept of the present invention is illustrated in schematic form in order to set forth the basic logic of the present invention. That is, as illustrated in FIG. 57, the force of the spring 5100 during loading is balanced between the cap assembly 5105, which includes a drive train, and carriage 5110, which is connected to the driver and operatively connected to lead screw 5130. Therefore the drive spring force is not exerted on or seen in any way by the frame 5115. The carriage 5110 may be connected to the lead screw 5130 via a latching nut 5132, or any other coupler mechanism described above. The latching nut 5132 is fixed to the lead screw 5130 during compression of the spring 5100, and is free during the drive. The frame 5115 is coupled to the cap assembly 5105 via a spring 5120 of much lower force and rate than the drive spring 5100. The coupling spring 5120 is sized to prevent perceptible movement between the frame 5115 and the cap assembly 5105. The force is minimal so only a small impulse is transferred to the frame 5115 during the drive event. Another consideration for the sizing of the coupling spring 5120 is that during the wind up of the drive spring 5100 the coupling spring must fully extend to its initial length and as the wind up time is over 20 times that of the drive time the coupling spring 5120 can be much lighter than the drive spring 5100 in force and rate.

Therefore, during the drive most of the initial reaction caused by the high acceleration of the driver mass which includes the carriage 5110 and a portion of the drive spring 5100 is taken by the counter mass which includes the cap 5105 and a portion of the drive spring 5100. Therefore the frame and nose remain only slightly affected (by whatever can be transmitted thru the coupling spring 5120) until the allowed stroke of the coupling spring 5120 is reached. The end of stroke for the coupling spring 5100 is timed to occur just prior to the piston driver contacting the impact absorber or bumper 5125 (which is explained in greater detail herein below). In doing so, the lead screw 5130 is in tension when the high impact forces are transmitted to it. Because the drive is under 10 milliseconds the delay between the end of stroke of the recoil absorber and the impact of the driver into the bumper is of very short duration, on the order of 3 milliseconds. This time period is so short that the operator cannot perceive a change in motion. If a fastener were not driven the frame motion would be close to balanced because the momentum of the driver and counter mass are close to equal.

Preferably, the mass of the counter weight should be of a sufficient amount, such that the loss of energy due the energy being disbursed into the counter weight is only a small percentage of the energy released by the drive spring. This provides for an efficient use of the energy for driving the fastener. That is, during the drive stroke, energy loss occurs because the spring is accelerating two masses, namely the counter mass and the moving mass, consequently, there is movement in opposite directions, one in the direction of the drive and the other in a direction opposite the drive. The mass being moved away is using up energy according to the well known formula $E=\frac{1}{2} m v^2$. The lost energy may be approximated by $E2=E1\times M1/(M1+M2)$, where E2 is the energy lost to the counter weight, E1 is the available energy of the drive spring (had one end of the spring been fixed), M1 is the mass of the driver and M2 is the mass of the counter weight. Stated otherwise, the lost energy decreases as the counter weight increases with respect to the driver weight as is readily exemplified by FIG. 58.

Figure 58:
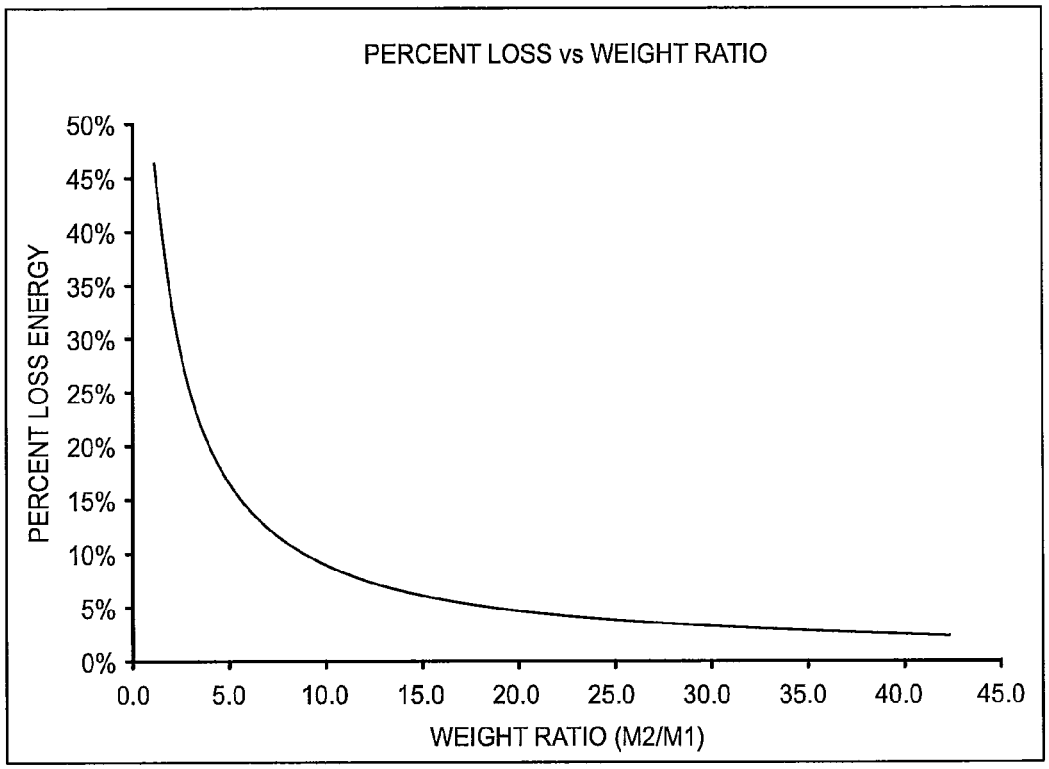
FIG. 58 is a graph of percent loss versus weight ratio.

As can be readily appreciated from FIG. 58, the counter weight should be at least 8 times the driver mass. That is, as the weight of the counter weight approaches 8 times that of the driver mass, the percentage of energy loss falls below 10%. Further, as the weight ratio reaches and exceeds 15, the percentage of loss is small compared to the total output. One further observation is that a loss of drive energy will not necessarily even be seen by the operator. This is due to the fact that enough stroke may be gained to offset the loss due to the lighter mass, and a gain in the component of force in the direction of drive is realized due to the decrease in rotational motion as the center of gravity of the counter mass is much closer to the drive axis as the original center of gravity of the tool.

With reference to FIGS. 59 to 62, a fastener driving device 5150 that is implemented in a cordless manner in accordance with the present invention is illustrated. Referring to these figures, the fastener driving device 5150 includes housing 5218, and a power source such as a removable battery (not shown). The fastener driving device 5150 further includes a nose that includes a drive channel which receives a fastener to be driven into the workpiece by the driver 5210. The fastener driving device 5150 of the illustrated embodiment would also be provided with a magazine that stores a plurality of fasteners therein, and feeds a fastener, one by one, into the drive channel.

Figure 59:
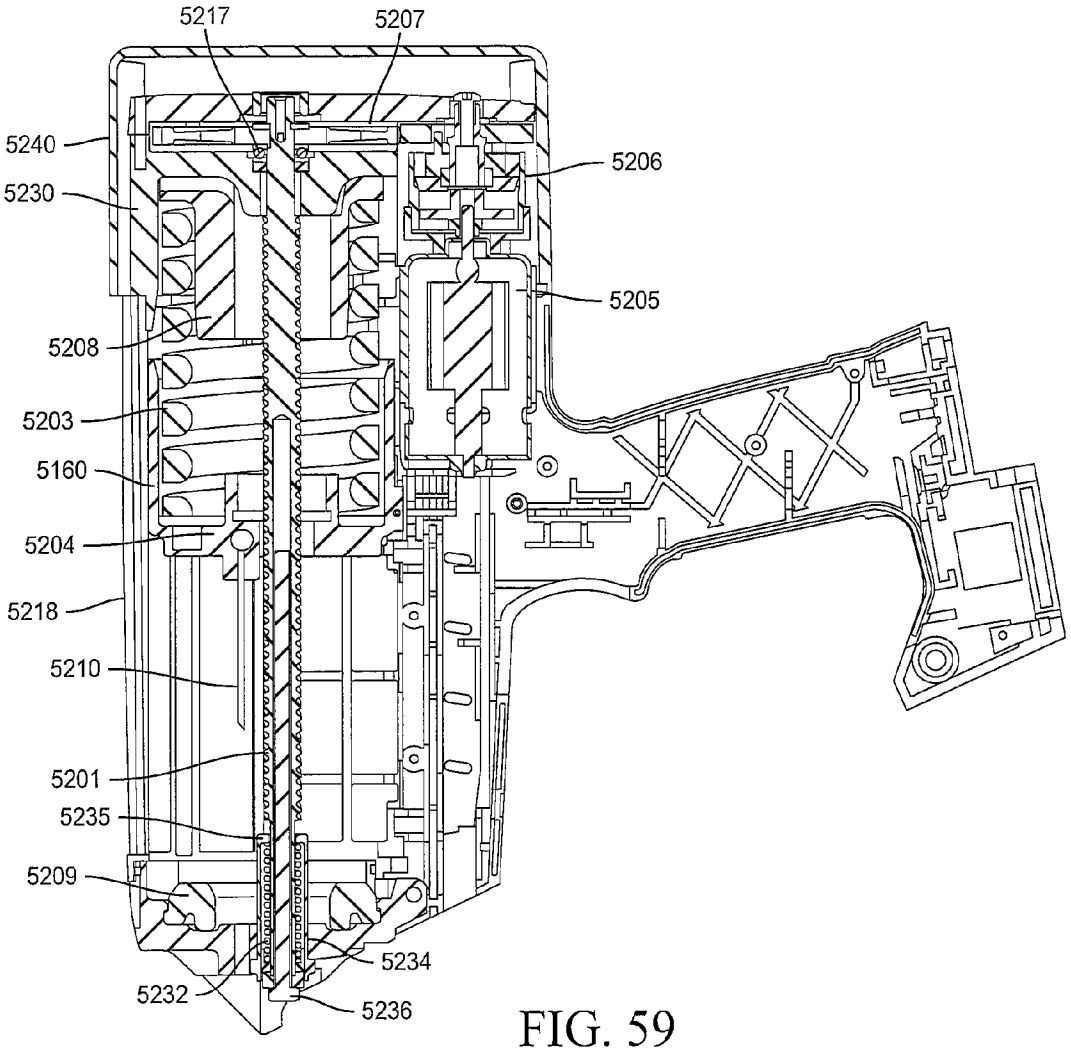
FIG. 59 is a cross-sectional view of the fastener driving device including the recoil suppression device of the present invention in the loaded state.
Figure 61:
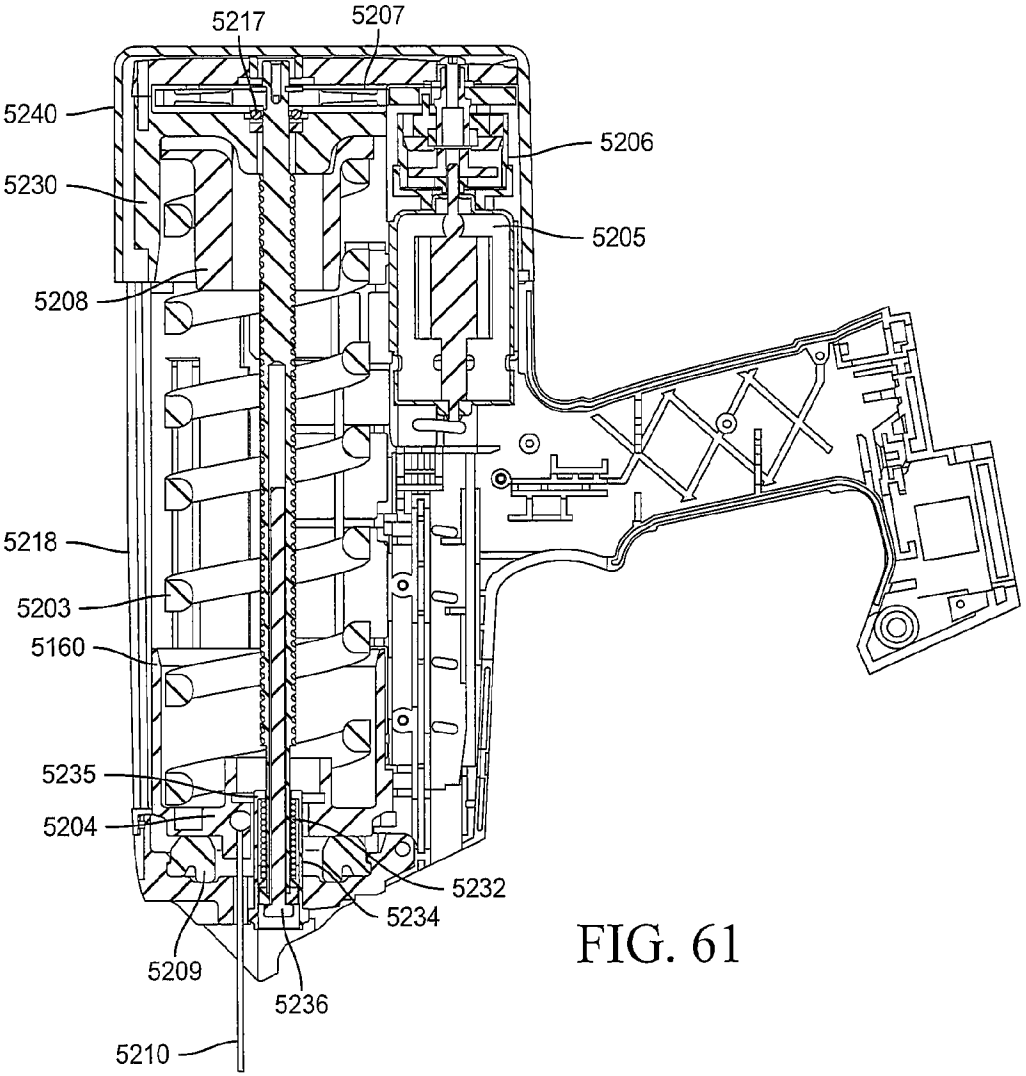
FIG. 61 is a cross-sectional view of the fastener driving device including the recoil suppression device of the present invention in the unloaded state.

As most clearly shown in FIGS. 59 and 61, the fastener driving device 5150 in the illustrated implementation includes a motor 5205, a gear train 5207, a clutch 5206, a threaded shaft 5201, a drive spring 5203, a top seat 5208, and a bumper 5209. The threaded shaft 5201 is retained at its ends with bearings 5217 in the housing 5218, and is implemented as a lead screw in the embodiment shown. However, the threaded shaft 5201 may be any rotary-to-linear motion converter such as a ball screw, an acme screw, and the like. At one end, the threaded shaft 5201 is connected via the gear train 5207 to the clutch 5206 and the motor 5205. A coupler mechanism 5160 with a carrier 5204 is also provided in the illustrated embodiment to allow compression of the drive spring 5203 as described in further detail below.

Position sensors may also be provided to indicate the position of the carrier 5204. The position sensors would preferably be non-contact sensors (for example, Hall Effect sensors) triggered with a magnet in the carrier 5204. Of course, the sensors can be any appropriate type of sensors, and could also be contact type sensors in other embodiments which are mechanically toggled by the motion of the carrier 5204, optical sensors, or other sensors.

The gear train 5207 may be implemented with spur, helical, bevel and/or planetary gears to optimize arrangements and the final gear ratio. The clutch 5206 may be similar in functionality to the clutch taught in U.S. Pat. No. 3,243,023, or any of the clutches described herein. The important functionality of the clutch 5206 is that the input shaft of the gear train 5207 is free to drive the output shaft (which ultimately rotates the threaded shaft 5201) in both directions, but when the input shaft is stationary, the output shaft is restrained from back driving the input shaft. Thus, the clutch 5206 precludes back driving of the motor 5205, and the drive spring 5203 can be maintained in the compressed configuration. By allowing the drive spring 5203 to be maintained compressed, the clutch 5206 further allows clearing of any jams that may occur in the fastener driving device 5150.

It should be noted that the threaded shaft 5201 and various components of the coupler mechanism 5160 are positioned in the drive spring 5503. In this regard, the drive spring 5203 is implemented as a coil spring, and includes a plurality of loops that encircle the longitudinal axis of the drive spring 5203, the loops defining an interior of the spring. It should be noted that the terms "axis", "axial" and derivatives thereof are used herein in the conventional sense, cylindrical components such as the described drive spring 5203 being understood as having a central axis about which the component is centered. The positioning of the threaded shaft 5201 and various components of the coupler mechanism 5160 in the interior of the drive spring 5203 keeps the overall size of the fastener driving device 5150 small, and allows the fastener driving device 5150 to substantially resemble traditional fastening tools in shape and form. In addition, this positioning of the threaded shaft 5201 in the interior of the spring also advantageously aids in centering the compression load of the drive spring 5203 during compression of the drive spring 5203, thereby reducing overturning moments.

Not shown in FIGS. 59 to 62 are further details of the fastener driving device 5150 which may include a contact trip 5225, and a trigger 5238, illustrated in FIG. 56, which are used as inputs by the user for operating the fastener driving device 5150. The device may further include a controller that is adapted to electronically control the operation of the fastener driving device 5150 in response to the inputs of the user. This being known and disclosed in the above noted application. The controller may be implemented with an electronic processor, relays, and/or power MOSFETs and switches on a circuit board, the processor receiving electrical signals from the contract trip 5225, a trigger 5226, position sensors and possibly a mode switch, to appropriately control the operation of the fastener driving device 5150, including the compression and release of the drive spring 5203. In this regard, the mode switch allows the user to select the manner in which the fastener driving device 5150 is to be used, for instance, in a sequential mode, bump fire mode, and for installation or release of the battery, as described above.

Referring further to FIGS. 59 to 62, the driver 5210 is connected to the carrier 5204 with the driver 5210 moving linearly in the nose in a drive channel. The coupler mechanism 5160 is implemented so that the carrier 5204 can be displaced through a return stroke to compress the drive spring 5203, and to quickly release the carrier 5204 so that the drive spring 5203 rapidly expands to move the carrier 5204 and the driver 5210 through a drive stroke. In the above regard, fastener driving device 5150 may include the coupling mechanism of the above noted application which includes the coupler mechanism 5160 which is provided with a nut that threadingly engages the threaded shaft 5201, and moves along the length of the threaded shaft 5201. As explained, in the noted application, various components of coupler mechanism 5160 are operable to engage (i.e. couple) the carrier 5204 to the nut so as to allow compression of the drive spring 5203, and to disengage (i.e. decouple) the carrier 5204 from the nut to allow the driver 5210 to drive a fastener into a work piece. The details of the coupler mechanism are hereby incorporated herein by reference.

The threaded shaft 5201 and the coupler mechanism 5160 implementation shown is advantageous with respect to the tool weight and mechanical arrangements, thus, allowing for a more desirable handheld tool. As mentioned above and most clearly shown in FIGS. 50 and 52, positioning the threaded shaft 5201 and various components of the coupler mechanism 5160 inside the drive spring 5203 keeps the overall size of the fastener driving device 2150 small and aids in centering the compression load of the spring 5230. Of course, the threaded shaft 5201 can also be arranged outside the drive spring 5203 in other embodiments, but arrangement and mechanical advantages can be attained by providing the mechanism inside the drive spring 5203.

As noted hereinabove, the frame 5218 is coupled to the cap 5230 of FIG. 59 by way of a coupling sprig 5232. The coupling spring 5232 is of a much lower force and rate than the drive spring 5203. As noted with respect to the schematic representation of the present invention set forth in FIG. 57, the coupling spring 5232 is sized to prevent perceptible movement between the frame 5218 and the cap 5230. The force is minimal so only a small impulse is transferred to the frame 5218 during the drive event. Another consideration for the sizing of the coupling spring 5232 is that during the compression of the drive spring 5203 the coupling spring must extend to its initial length. Further, because the compression time is more than 20 times that of the drive time the coupling spring 5232 can be much lighter than the drive spring 5203 in force and rate.

Figure 60:
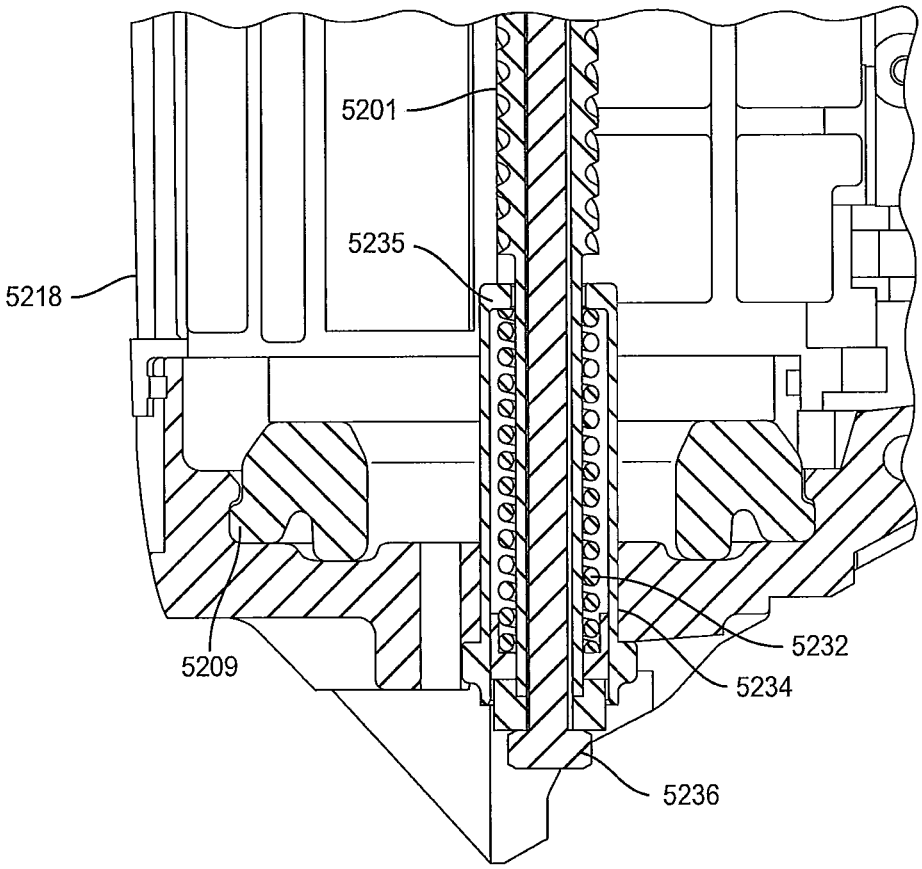
FIG. 60 is an expanded view of the tip of the fastener driving device shown in FIG. 4.
Figure 62:
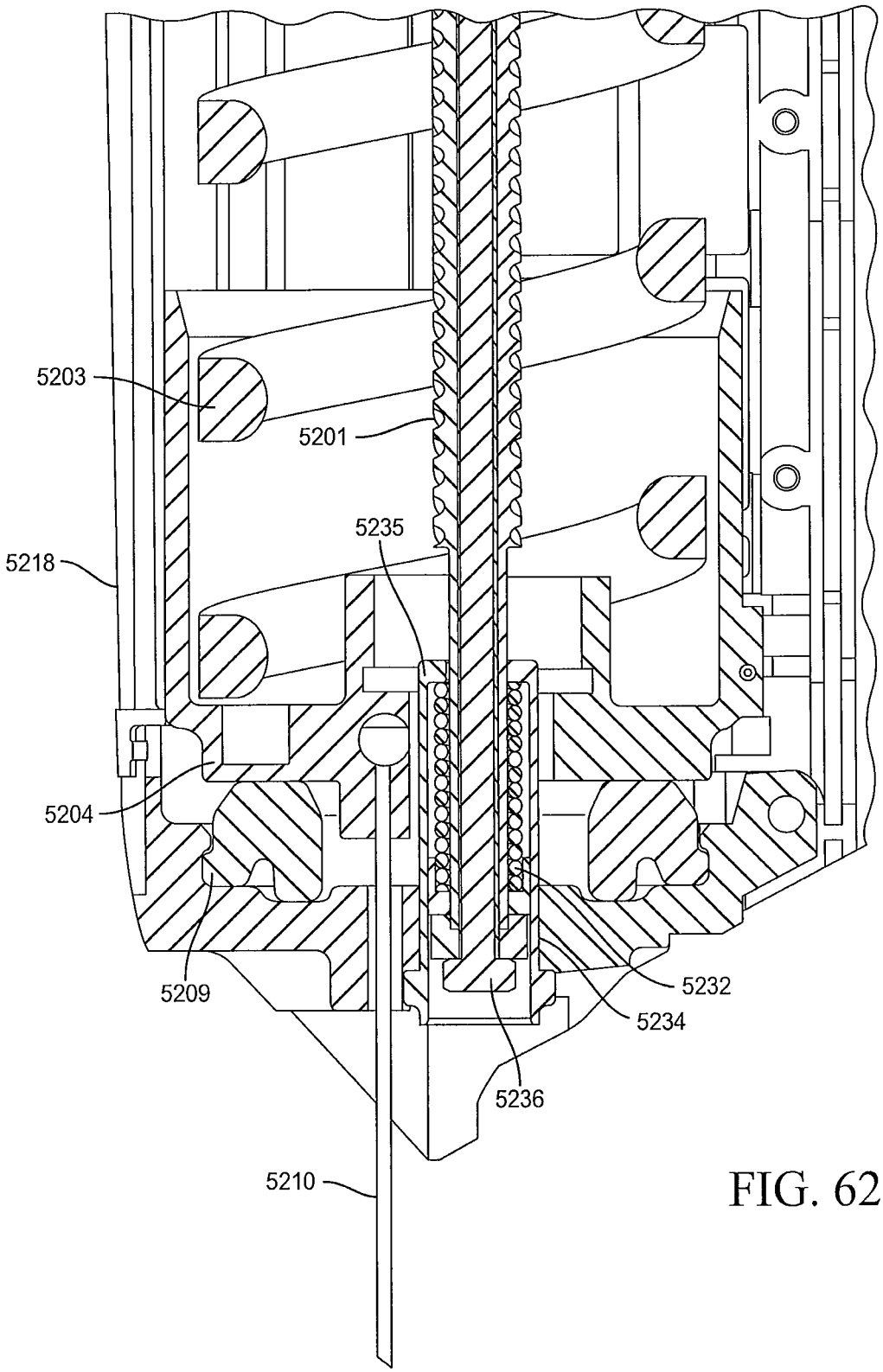
FIG. 62 is an expanded view of the tip of the fastener driving device shown in FIG. 61.

The coupling spring 5232, best illustrated in FIGS. 60 and 62, is housed in a sleeve 5234 which is supported by the frame 5218 at a lower end thereof. The sleeve 5234 includes a reduced upper end 5235 which is contacted by an upper end of the coupling spring 5232, and which permits the distal end of the threaded shaft to extend therethrough. A lower end of the coupling spring 5232 is supported by a threaded fastener 5236 that is threaded into the threaded shaft 5201, thereby effectively connecting the lower end of the coupling spring 5232, via the threaded screw 5201, to the cap 5230 which includes the gear train 5207, clutch 5206 and motor 5205 referred to in their totality as the counter mass.

As can be appreciated from a comparison of FIGS. 59 and 61, upon triggering of the release mechanism, the drive screw 5201 is permitted to move from the state illustrated in FIG. 59 to that illustrated in FIG. 61, thereby driving the carrier 5204 including the driver 5210 toward the nose assembly and into contact with the bumper 5209. This in turn generates recoil in the device which is suppressed due to the fact that the cap 5230, including the gear train 5207, the clutch 5206, the motor 5205 and the drive screw 5201 are permitted to move within the device in a direction opposite that of the carrier 5204. As noted above, the longitudinal connection between the drive screw 5201 and the frame 5218 is carried out by way of the coupling spring 5232 which maintains a bias between the threaded fastener 5236 and the drive screw 5201 and the reduced upper end 5235 of the sleeve 5234. The cap 5230, including the gear train 5207, the clutch 5206, the motor 5205 and bearings are covered by a shroud 5240 which is spaced sufficiently from the cap 5230, the gear train 5207, the clutch 5206, the motor 5205 and bearings to permit them to be displaced upwardly within the shroud 5240 as is apparent from FIGS. 59 and 61.

Similar to the schematic illustration set forth in FIG. 57, the force of the drive spring 5203 during loading is balanced between the cap 5230 and carriage 5204. Therefore, the drive spring force is not exerted on or seen in any way by the frame 5218. The frame 5218 is coupled to the cap 5230 via the coupling spring 5232 of much lower force and rate than that of the drive spring 5203. The coupling spring 5232 is sized to prevent perceptible movement between the frame 5218 and the cap 5230. The force is minimal so only a small impulse is transferred to the frame 5218 during the drive event. Another consideration for the sizing of the coupling spring 5232 is that during the wind up of the drive spring 5203 after a drive event, the coupling spring 5232 must fully extend to its initial length. As noted above, the wind up time is over 20 times that of the drive time, therefore, the coupling spring 5218 can be much lighter than the drive spring 5203 in force and rate.

During the drive event, most of the initial reaction caused by the high acceleration of the driver mass which includes the carriage 5204 and a portion of the drive spring 5203 is taken by the counter mass, in his case the cap 5230 which includes the gear train 5207, clutch 5206 and motor 5205 and a portion of the drive spring 5203, referred to in their totality as the counter mass. Therefore the frame 5218 and nose remain only slightly affected (by whatever can be transmitted thru the coupling spring 5232) until the allowed stroke of the coupling spring 5232 is reached. The end of stroke for the coupling spring 5232 is timed to occur just prior to the piston driver contacting the impact absorber or bumper 5209. In doing so, the treaded shaft 201 is in tension when the high impact forces are transmitted to it.

Given this construction and because the drive stroke is somewhat under 10 milliseconds, the delay between the end of drive stroke and the impact of the carrier 5204 into the bumper is of a very short duration, on the order of 3 milliseconds. This time period is so short that the operator cannot perceive a change in motion. If a fastener were not driven the frame motion would be close to balanced because the momentum of the driver and counter mass are close to equal.

While embodiments of the present invention with respect to recoil suppression are disclosed with reference to a spring driven tool, it may be possible to suppress recoil in other types of tools in a similar manner.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

What is claimed is:

1. A fastener driving device comprising:

a fastener driver configured to drive a fastener into a workpiece during a drive stroke;

an energy storage source configured to store potential energy and to release the potential energy to the fastener driver to initiate the drive stroke;

a motor constructed and arranged to provide energy to the energy storage source; and a drive train operatively connected to the motor and to the energy storage source, the drive train comprising a clutch configured to transfer the energy from the motor to the energy storage source, and to restrain the potential energy stored in the energy storage source when the motor is in an off condition, wherein the clutch comprises a housing having an inner surface;

a drive planet carrier rotationally coupled to the motor and positioned within the inner surface of the housing, the drive planet carrier having a plurality of drive members;

an anvil rotatably coupled with the drive planet carrier and positioned within the inner surface of the housing, the anvil having a plurality of projections extending in a radial direction relative to a central axis of rotation; and a plurality of elongated breaking pads rotatably movable between a first orientation and a second orientation, each breaking pad being supported by the drive planet carrier and disposed between one of the projections of the anvil and one of the drive members of the drive planet carrier, the breaking pads being constructed and arranged to allow rotational movement of the anvil when the motor is providing energy to the energy storage source and the breaking pads are in the first orientation, and to substantially prevent rotation of the anvil when the motor is not providing energy to the energy storage source when the breaking pads are in the second orientation, wherein the second orientation is tilted relative to the first orientation.

2. A fastener driving device according to claim 1, wherein the anvil member comprises a plurality of cam surfaces located between the projections, and wherein each breaking pad includes a first surface configured to engage one of the cam surfaces when the motor is providing energy to the energy storage source, and a second surface that is angled with respect to the first surface, the second surface configured to engage a second cam surface when the motor is not providing energy to the energy storage source, wherein when the second surface of the breaking pad engages the cam surface, the breaking pad causes the anvil to be locked relative to the inner surface of the housing.

3. A fastener driving device comprising a fastener driver configured to drive a fastener into a workpiece during a drive stroke;

an energy storage source configured to store potential energy and to release the potential energy to the fastener driver to initiate the drive stroke;

a motor constructed and arranged to provide energy to the energy storage source; and a drive train operatively connected to the motor and to the energy storage source, the drive train comprising a clutch configured to transfer the energy from the motor to the energy storage source, and to restrain the potential energy stored in the energy storage source when the motor is in an off condition;

a rotatably mounted threaded shaft;

a carrier connected to the fastener driver and configured to engage a part of the energy storage source; and a coupler mechanism configured to engage the threaded shaft and the carrier to allow transfer of the energy from the motor to the energy storage source, the coupler mechanism being operable to releasably couple the carrier to the threaded shaft to lift the carrier along the threaded shaft during a return stroke and to release the carrier to initiate the drive stroke.

4. A fastener driving device according to claim 3, wherein the coupler mechanism comprises a fixed nut and a free nut, the fixed nut being threadingly engaged with the threaded shaft and the free nut being rotatable relative to the fixed nut and being configured to be coupled to the carrier, the free nut and the fixed nut having ratcheting features constructed and arranged to lock the free nut to the fixed nut to couple the threaded shaft to the carrier during the return stroke.

5. A fastener driving device according to claim 4, wherein the ratcheting features are one directional to allow the fixed nut to spin with the threaded shaft when the threaded shaft is rotated in a direction that is opposite a direction of rotation during the return stroke.

6. A fastener driving device comprising:

a fastener driver;

a magazine for carrying a supply of fasteners to the fastener driver;

an energy storage source configured to store potential energy that moves the fastener driver through a drive stroke; and a reversible motor configured to rotate a shaft in a first direction to move the fastener driver through a return stroke, the motor operable upon completion of the drive stroke, to move the fastener driver partially through the return stroke a predetermined amount to partially pre-energize the energy storage source, the motor further operable to fully energize the energy storage source after receiving a signal for the drive stroke, the motor further configured to rotate the shaft in a second direction opposite the first direction to de-energize the energy storage source;

a nose assembly carried by a housing, the nose assembly having a fastener drive track;

the magazine constructed and arranged to feed successively leading fasteners from the supply of fasteners contained therein into the drive track;

the fastener driver configured to enter the drive track during the drive stroke and drive a leading fastener into a workpiece;

a contact trip constructed and arranged to be moved from a normally biased inoperative position into an operative position when the contact trip is pressed against the workpiece; and a fastener lockout operatively coupled to the contact trip, the fastener lockout being constructed and arranged to extend into the drive track in a path of the fastener driver to prevent the leading fastener from being driven by the fastener driver when the contact trip is in the inoperative position.

7. A fastener driving device according to claim 6, wherein the fastener lockout comprises a lever having a first extremity and a second extremity opposite the first extremity, the first extremity being operatively coupled to the contact trip, wherein the lever is movable from a first position in which the second extremity of the lever is positioned in a recess formed in the drive track and is in contact with a head of the leading fastener, and a second position in which the second extremity of the lever is positioned out of the drive track and is not in contact with the head of the leading fastener.

8. A fastener driving device according to claim 7, wherein the lever is constructed and arranged to pivot in and out of the drive track.

9. A fastener driving device according to claim 7, wherein the first extremity of the lever is rotatably mounted to a segment of the contact trip.

10. A fastener driving device according to claim 7, wherein the fastener lockout further comprises a resilient member configured to apply a force on the lever to bias the second extremity of the lever towards a guiding member configured to guide the leading fastener in the drive track.

11. A fastener driving device comprising:

a frame;

a fastener driver movably mounted within the frame and constructed and arranged to drive a fastener into a workpiece during a drive stroke;

an energy storage source configured to store potential energy and to release the potential energy to the fastener driver to initiate the drive stroke;

a motor constructed and arranged to provide energy to the energy storage source;

a drive train operatively connected to the motor and to the energy storage source, the drive train being configured to transfer the energy from the motor to the energy storage source, and to restrain the potential energy stored in the energy storage source when the motor is in an off condition; and a recoil suppression device constructed and arranged to suppress an amount of recoil when the fastener driver drives the fastener into the workpiece, the recoil suppression device comprising a counter mass configured to be displaceable in a direction opposite a direction the fastener driver travels during the drive stroke, wherein the counter mass includes the drive train.

12. A fastener driving device according to claim 11, wherein an output shaft of the motor and the drive train are oriented substantially parallel to the fastener driver.

13. A fastener driving device according to claim 12, wherein the counter mass includes the motor.

14. A fastener driving device according to claim 11, further comprising a cap coupled to the frame, wherein the counter mass is mounted within the cap.

15. A fastener driving device according to claim 14, further comprising a coupling spring configured to couple the cap to the frame and prevent substantial movement between the cap and the frame.

* * * * *